US005960388A

United States Patent [19]

Nishiguchi et al.

[11] Patent Number: 5,960,388

[45] Date of Patent: Sep. 28, 1999

[54] VOICED/UNVOICED DECISION BASED ON FREQUENCY BAND RATIO

[75] Inventors: Masayuki Nishiguchi, Kanagawa; Jun Matsumoto; Shinobu Ono, both of Tokyo, all of Japan

[73] Assignee: Sony Corporation, Tokyo, Japan

[21] Appl. No.: 08/871,335

[22] Filed: Jun. 9, 1997

Related U.S. Application Data

[62] Division of application No. 08/150,082, filed as application No. PCT/JP93/00323, Feb. 18, 1993, Pat. No. 5,765,127.

[30] Foreign Application Priority Data

Mar. 18, 1992 [JP] Japan ..... P4-91422
Mar. 18, 1992 [JP] Japan ..... P4-92259

[51] Int. Cl.[6] ..... G10L 7/00

[52] U.S. Cl. ..... 704/208

[58] Field of Search ..... 704/200, 201, 704/205–209, 214, 229, 230, 219; 370/62

[56] References Cited

U.S. PATENT DOCUMENTS

| | | | |
|---|---|---|---|
| 4,710,812 | 12/1987 | Murakami et al. | 348/418 |
| 5,010,574 | 4/1991 | Wang | 395/2.31 |
| 5,195,166 | 3/1993 | Hardwick et al. | 704/200 |
| 5,216,747 | 6/1993 | Hardwick et al. | 704/208 |
| 5,226,084 | 7/1993 | Hardwick et al. | 704/219 |
| 5,226,108 | 7/1993 | Hardwick et al. | 704/200 |
| 5,247,579 | 9/1993 | Hardwick et al. | 704/230 |
| 5,272,529 | 12/1993 | Frederiksen | 348/422 |
| 5,272,698 | 12/1993 | Champion | 370/62 |
| 5,274,741 | 12/1993 | Taniguchi et al. | 395/2.31 |
| 5,317,567 | 5/1994 | Champion | 370/62 |
| 5,361,323 | 11/1994 | Murata et al. | 395/2.1 |
| 5,383,184 | 1/1995 | Champion | 370/62 |
| 5,440,345 | 8/1995 | Shimoda | 348/411 |
| 5,473,727 | 12/1995 | Nishiguchi et al. | 704/208 |
| 5,630,012 | 5/1997 | Nishiguchi et al. | 704/208 |
| 5,664,052 | 9/1997 | Nishiguchi et al. | 704/208 |

FOREIGN PATENT DOCUMENTS

| | | | |
|---|---|---|---|
| 58-53357 | 11/1983 | Japan | G10L 1/00 |
| 59-2033 | 1/1984 | Japan | G10L 1/00 |
| 62-271000 | 11/1987 | Japan | G10L 7/04 |
| 63-201700 | 8/1988 | Japan | G10L 7/04 |
| 2-7100 | 1/1990 | Japan | G10L 7/04 |
| 4-122999 | 4/1992 | Japan | G10L 7/08 |

OTHER PUBLICATIONS

Gersho et al., "Variable Rate Vector Quantization," Vector Quantization and Signal Compression, Gerso et al. Kluwer Academic Publishers, pp. 127, 204–206, 461–470, 602–605, 631–640, Nov. 1991.

Gersho et al. "Vector Quantization Techniques in Speech Coding" and "Pitch and Voicing Determination," Advances in Speech Signal Processing, Editors, Furui and Sondi, Dekker, pp. 3–84, Jan. 1991.

*Primary Examiner*—David D. Knepper
*Attorney, Agent, or Firm*—Limbach & Limbach L.L.P.

[57] ABSTRACT

Input audio signal is divided on a block-by-block basis. Frequency domain conversion is done on each of the blocks. Voiced bands of the frequency domain data for one of the blocks are searched for a voiced band $B_{VH}$ with the highest center frequency if it is decided that there are one or more shift points of voiced (V)/unvoiced (UV) decision data of all the bands. The number $N_V$ of voiced bands having center frequency less than that of the band $B_{VH}$ is found, so as to decide whether a proportion of the voiced bands is equal to or higher than a predetermined threshold $N_{th}$, thereby deciding one V/UV boundary point. Thus, it is possible to replace the V/UV decision data for each band by information on one demarcation in all bands, thereby reducing data volume and bit rate.

4 Claims, 37 Drawing Sheets

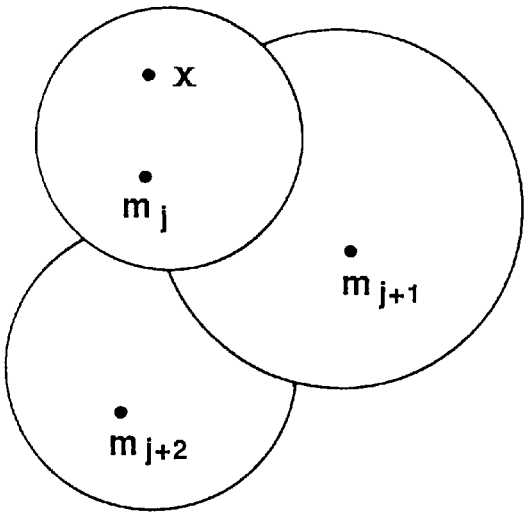
FIG.47
FIG.49A
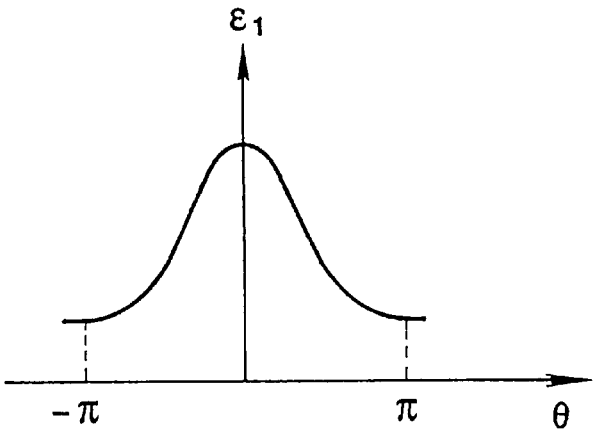
FIG.49B
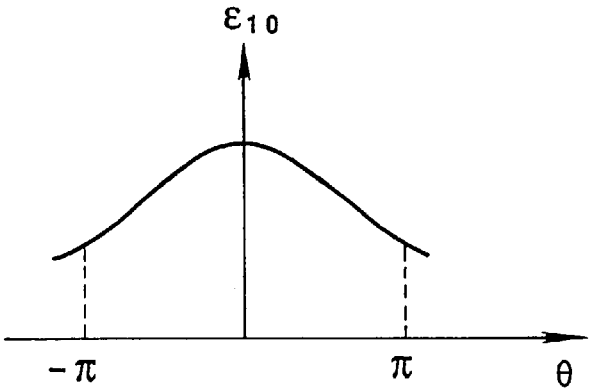

VOICED/UNVOICED DECISION BASED ON FREQUENCY BAND RATIO

This is a divisional of application Ser. No. 08/150,082, filed Dec. 6, 1993, which is a 35 USC 371 of PCT/JP93/00323, now U.S. Pat. No. 5,765,127 filed Feb. 18, 1993.

TECHNICAL FIELD

This invention relates to a high efficiency encoding method for encoding data on the frequency axis produced by dividing input audio signals, such as voice signals or acoustic signals, on the block-by-block basis, and transforming the audio signals into signals on the frequency axis.

BACKGROUND ART

A variety of encoding methods have been known, in which signal compression is carried out by utilizing statistical characteristics of audio signals, including voice signals and acoustic signals, in the time domain and in the frequency domain, and characteristics of human auditory sense. These encoding methods are roughly divided into encoding in the time domain, encoding in the frequency domain and analysis-synthesis encoding.

As an example of high efficiency encoding of voice signals, when quantizing various information data, such as spectral amplitude or parameters thereof, like LSP parameters, $\alpha$ parameters or k parameters, in partial autocorrelation (PARCOR) analysis-synthesis encoding, multiband excitation encoding (MBE), single-band excitation encoding (SBE), harmonic encoding, side-band coding (SBC), linear predictive coding (LPC), discrete cosine transform (DCT), modified DCT (MDCT) or fast Fourier transform (FFT), it has been customary to carry out scalar quantization.

Meanwhile, in the voice analysis-synthesis system such as the PARCOR method, since the timing of changing over the excitation source is on the block-by-block (frame-by-frame) basis on the time axis, voiced and unvoiced sounds cannot exist jointly within the same frame. As a result, it has been impossible to produce high-quality voices.

However, in the MBE encoding, the band for voices within one block (frame) is divided into plural bands, and voiced/unvoiced decision is performed for each of the bands. Thus, improvements to sound quality can be observed. However, the MBE encoding is disadvantageous in terms of bit rate, since voiced/unvoiced decision data obtained for each band must be transmitted separately.

Also, scalar quantization has been difficult to implement because of the increased quantization noise if it is attempted to lower the bit rate to e.g. about 3 to 4 kbps for further increasing the quantization efficiency.

It may be contemplated to adopt vector quantization. However, with the number of bits b of an output (index) of the vector quantization, the size of a codebook of a vector quantizer is increased in proportion to $2^b$, and the operation volume for codebook search is also increased in proportion to $2^b$. However, since an extremely small number b of bits of output increases the quantization noise, it is desirable to reduce the size of the codebook or the operation quantity for codebook search while maintaining a certain larger value of the bit number b. Besides, the coding efficiency cannot be increased sufficiently if the data transformed into those on the frequency axis are directly processed by vector quantization. Thus, a technique for further increasing the compression ratio is needed.

In view of the above-described status of the art, it is an object of the present invention to provide a high efficiency encoding method whereby the voiced/unvoiced sounds decision data produced for each band may be transmitted with a reduced number of bits without deteriorating the sound quality.

It is another object of the present invention to provide a high efficiency encoding method whereby the size of the codebook for the vector quantizer or the operation volume for codebook search can be diminished without lowering the number of output bits of vector quantization, and whereby the compression ratio at the time of vector quantization can be increased further.

DISCLOSURE OF THE INVENTION

According to the present invention there is provided a high-efficiency encoding method comprising the steps of: dividing input voice signals into blocks with each block as a unit and transforming the voice signals into signals on a frequency axis to find corresponding data on the frequency axis; dividing the data on the frequency axis into plural bands; deciding, for each of the bands, whether sound contained therein is voiced or unvoiced; detecting a band of the highest frequency of the bands found to be bands for the voiced sound; and finding, in accordance with the number of the band from the lowermost frequency side to the detected band, information about a boundary point between a voiced sound region and an unvoiced sound region on the frequency axis. Accordingly, since the boundary point between the voiced sound region and the unvoiced sound region is in one position of the plural bands, boundary point data can be transmitted with a small number of bits. Also, since distinction between the voiced sound region and the unvoiced sound region is carried out for every band in the block (frame), the synthetic sound quality can be improved.

It is noted that, if the ratio of the number of bands of the voiced sound to the number of the bands of the unvoiced sound from the lower most frequency side to the detected band equals and exceeds a predetermined threshold, the position of the detected band is used as the boundary point between the voiced sound region and the unvoiced sound region. The number of the bands may also be reduced in advance to a constant number so that the boundary point can be transmitted with a smaller fixed number of bits.

According to the present invention, there is also provided a high efficiency encoding method comprising the steps of: dividing input audio signals into blocks and transforming the block signals onto the frequency axis to find data on the frequency axis as an M-dimensional vector; dividing the data of the M-dimensional vector on the frequency axis into plural groups and finding a representative value for each of the groups to lower the M dimension to an S dimension, where S<M; processing the S-dimensional data by first vector quantization; processing output data of the first vector quantization by inverse vector quantization to find a corresponding S-dimensional code vector; expanding the S-dimensional code vector to an original M-dimensional vector; and processing, with second vector quantization, data representing relation between the expanded M-dimensional vector and the data on the frequency axis of the original M-dimensional vector. Accordingly, by carrying out the vector quantization having a codebook of hierarchical structure, wherein the M-dimensional vector is dimensionally lowered to the S-dimensional vector for vector quantization, the operation volume of codebook search and the size of the codebook can be reduced significantly, making effective application of a correction code possible.

Data transformed on the block-by-block basis and compressed in a non-linear fashion can be used as the data on the frequency axis of the M-dimensional vector.

According to the present invention, there is also provided a high efficiency encoding method comprising the steps of: compressing, in a non-linear fashion, data obtained by dividing input audio signals into blocks and transforming the data into data on the frequency axis so as to find data on the frequency axis as the M-dimensional vector; and processing the data on the frequency axis of the M-dimensional vector with vector quantization.

An inter-block difference of data to be quantized may be taken and processed with vector quantization.

In this manner, by non-linearly compressing the data on the frequency axis and processing the data with vector quantization, the quality of quantization can be improved. Also, by taking the inter-block difference, the compression ratio can be increased further.

BRIEF DESCRIPTION OF THE DRAWINGS

FIG. 47 is a schematic view for explaining a third example of the vector quantization method.

FIG. 49 is a graph for explaining a Gaussian noise employed in the voice analysis-synthesis method.

BEST MODE FOR CARRYING OUT THE INVENTION

Figure 1:
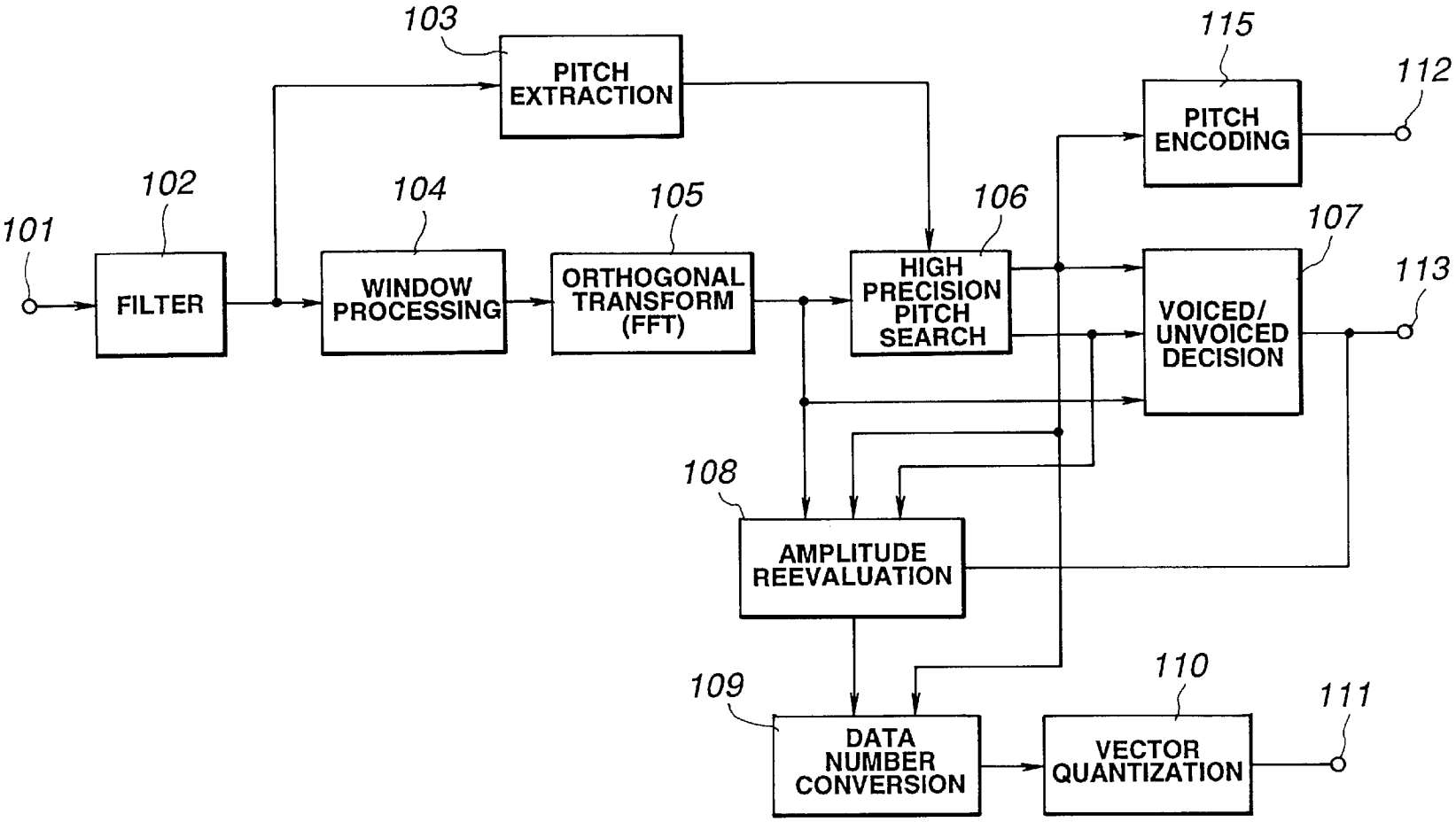
FIG.1 (PRIOR ART)
FIG. 1 is a functional block diagram showing a schematic arrangement of an analysis side or encoder side of a synthesis-analysis encoding device for voice signals as a specific example of a device to which a high efficiency encoding method of the present invention is applied.

Referring to the drawings, preferred embodiments of the high efficiency encoding method according to the present invention will be explained.

For the high efficiency encoding method, it is possible to employ an encoding method comprising converting signals on the block-by-block basis into signals on the frequency axis, dividing the frequency band of the resulting signals into plural bands and distinguishing voiced (V) and unvoiced (UV) sounds from each other for each of the bands, as in the case of the MBE (Multi-band Excitation) encoding method which will be explained later.

That is, in a general high efficiency encoding method according to the present invention, a voice signal is divided into blocks each consisting of a predetermined number of samples, e.g. 256 samples, and the resulting signal on the block-by-block basis is transformed into spectral data on the frequency axis by orthogonal transform, such as FFT. At the same time, the pitch of the voice in each block is extracted, and the spectrum on the frequency axis is divided into plural bands at an interval according to the pitch. Then, voiced (V)/unvoiced sound (UV) distinction is made for each of the divided bands. The V/UV sound distinction data is encoded and transmitted along with spectral amplitude data.

A concrete example of a multi-band excitation (MBE) vocoder, which is a kind of a synthesis-analysis encoder for voice signals (so-called vocoder) to which the high efficiency encoding method of the present invention can be applied, is hereinafter explained with reference to the drawings.

The MBE vocoder, which is now to be explained, is disclosed in D. W. Griffin and J. S. Lim, "Multiband Excitation Vocoder", IEEE Trans. Acoustics, Speech and Signal Processing, vol.36, No. 8, August 1988, pp. 1223–1235. In contrast to a conventional partial auto-correlation (PARCOR) vocoder in which voiced regions and unvoiced regions are changed over on the block-by-block basis or on the frame-by-frame basis at the time of voice modeling, the MBE vocoder performs modeling on the assumption that there exist a voiced region and an unvoiced region in a concurrent region on the frequency axis, that is, within the same block or frame.

FIG. 1 is a schematic block diagram showing an overall arrangement of an embodiment of the MBE vocoder to which the present invention is applied.

Figure 5A:
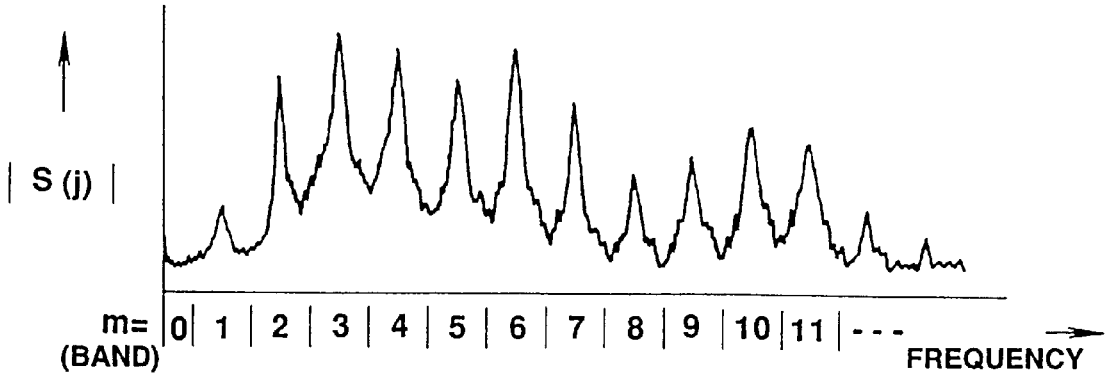
FIG. 5 is a diagram showing power spectrum of spectral data, spectral envelope and excitation signals on the frequency axis.
Figure 5B:
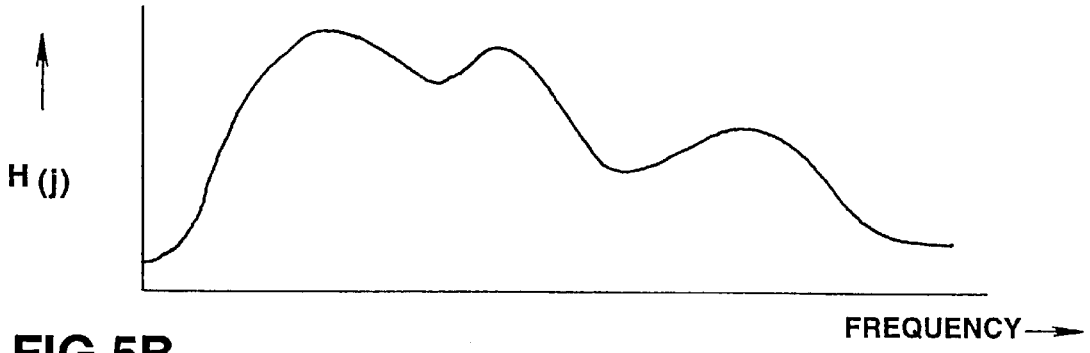
Figure 5C:
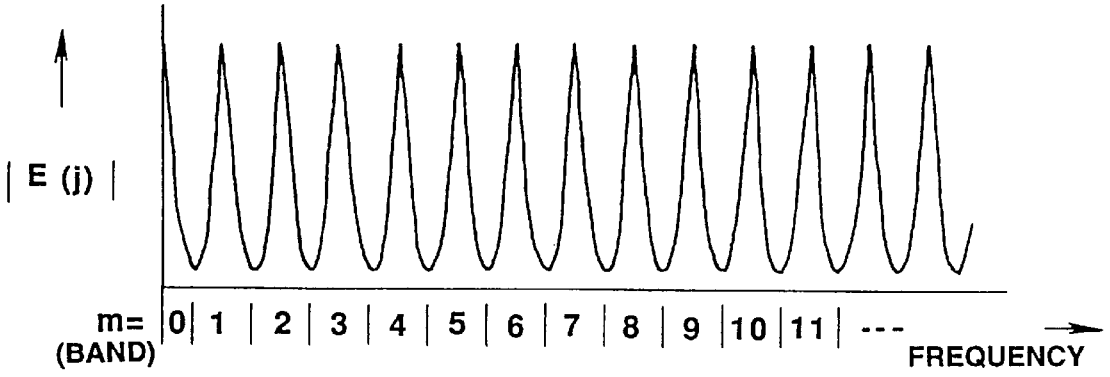

Referring to FIG. 1, a voice signal is supplied to an input terminal 101 and is then transmitted to a filter such as a high-pass filter (HPF) 102, so as to be freed of so-called DC offset and at least low-frequency components of not higher than 200 Hz for limiting the frequency band to e.g. 200 to 3400 Hz. A signal obtained from the filter 102 is supplied to a pitch extraction section 103 and to a window processing section 104. The pitch extraction section 103 divides input voice signal data into blocks each consisting of a predetermined number of samples or N samples, e.g. 256 samples or cuts out by means of a rectangular window, and carries out pitch extraction for voice signals within each block. These blocks each consisting of 256 samples are moved along the time axis at an interval of a frame having L samples, e.g. 160 samples, as shown by A in FIG. 5, so that an inter-block overlap is (N−L) samples, e.g. 96 samples. The window processing section 104 multiplies the N samples of each block by a predetermined window function, such as a hamming window, and the windowed blocks are sequentially moved along the time axis at an interval of L samples per frame.

This window processing can be expressed by the formula $$x_W(k,q)=x(q)w(kl-q) \tag{1}$$

where k denotes a block number and q denotes a time index of data or sample number. The formula shows that the q'th data of input signal x(q) before processing is multiplied by a window function of the k'th block w(kl−q) to give data $x_W(k, q)$. The window function $w_r(r)$ for a rectangular window shown by A in FIG. 2 within the pitch extraction section 103 is expressed by the following.

$$\begin{aligned} w_r(r) &= 1 \quad 0 \le r < N \\ &= 0 \quad r < 0,\ N \le r \end{aligned} \tag{2}$$

Figure 2A:
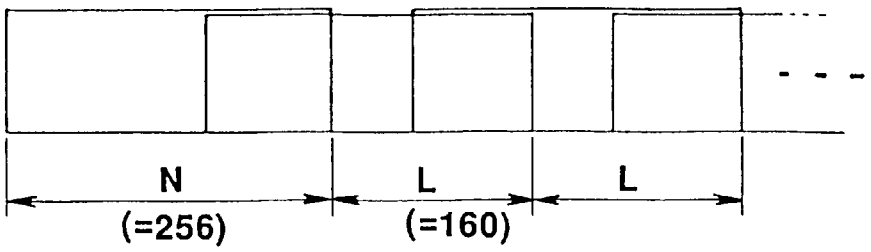
FIG. 2 is a diagram for explaining window processing.
Figure 2B:
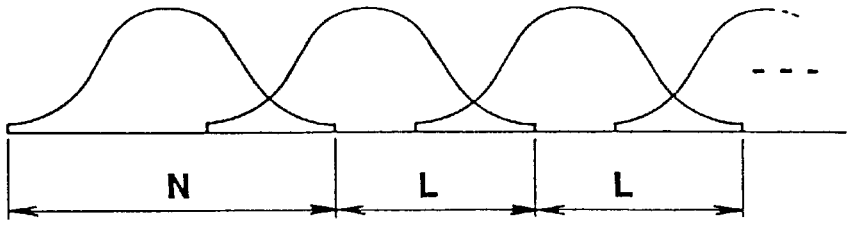

The window function $w_h(r)$ for a hamming window shown by B in FIG. 2 at the window processing section 104 is as follows.

$$\begin{aligned} w_h(r) &= 0.54 - 0.46\cos(2\pi r/(N-1)) \quad 0 \le r < N \\ &= 0 \qquad\qquad\qquad\qquad\qquad\qquad r < 0,\ N \le r \end{aligned} \tag{3}$$

If the window function $w_r(r)$ or $w_h(r)$ is used, a non-zero domain of the window function w(r) (=w(kl−q)) of the above formula (1) is $$0 \leqq kL-q < N$$

and modification of this is expressed by the following formula.

$$kL-N<q \leqq kL$$

Figure 3:
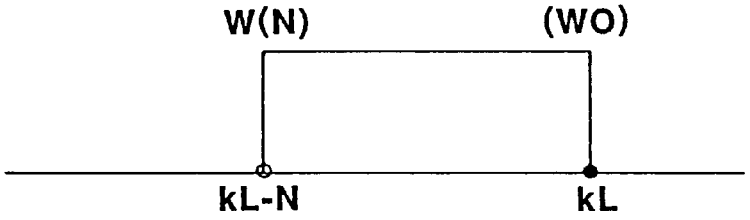
FIG. 3 is a diagram for explaining a relation between the window processing and a window function.

Therefore, it is when kL−N<q≦kL that the window function $w_r(kL-q)=1$ holds for the rectangular window, as shown in FIG. 3. The above formulas (1) to (3) indicate that the window having a length of N (=256) samples is advanced at a rate of L (=160) samples at a time. Non-zero sample trains at each N (0≦r<N) point, divided by each of the window functions of the formulas (2) and (3), are indicated by $x_{wr}(k, r)$ and $x_{wh}(k, r)$, respectively.

Figure 4:
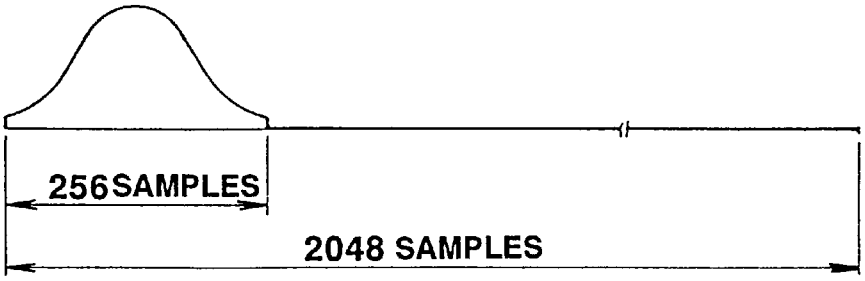
FIG. 4 is a diagram showing time axis data as an object of orthogonal transform (FFT) processing.

The window processing section 104 adds 0-data for 1792 samples to a 256-sample block sample train $x_{wh}(k, r)$ multiplied by the hamming window of formula (3), thus producing 2048 samples, as shown in FIG. 4. The data sequence of 2048 samples on the time axis are processed with orthogonal transform, such as fast Fourier transform, by an orthogonal transform section 105.

The pitch extraction section 103 carries out pitch extraction based on the above one-block N-sample sample train $x_{wr}(k, r)$. Although pitch extraction may be performed using periodicity of the temporal waveform, periodic spectral frequency structure or auto-correlation function, the center clip waveform auto-correlation method is adopted in the present embodiment. As for the center clip level in each block, a sole clip level may be set for each block. However, the peak level of signals of each subdivision of the block (each sub-block) is detected and, if a large difference in the peak level between the sub-blocks, the clip level is progressively or continuously changed in the block. The peak period is determined on the basis of the peak position of the auto-correlated data of the center clip waveform. At this time, plural peaks are found from the auto-correlated data belonging to the current frame, where auto-correlation is found from 1-block N-sample data as an object. If the maximum one of these peaks is not less than a predetermined threshold, the maximum peak position is the pitch period. Otherwise, a peak is found which is in a certain pitch range satisfying the relation with a pitch of a frame other than the current frame, such as a preceding frame or a succeeding frame, for example, within a range of ±20% with respect to the pitch of the preceding frame, and the pitch of the current frame is determined based on this peak position. The pitch extraction section 103 performs relatively rough pitch search by an open loop. The extracted pitch data are supplied to a fine pitch search section 106, where a fine pitch search is performed by a closed loop.

Integer-valued rough pitch data extracted by the pitch extraction section 103 and data on the frequency axis from the orthogonal transform section 105 are supplied to the fine pitch search section 106. The fine pitch search section 106 produces an optimum fine pitch data value with floating decimals by oscillation of ± several samples at a rate of 0.2 to 0.5 about the pitch value as the center. An analysis-by-synthesis method is employed as the fine search technique for selecting the pitch so that the synthesized power spectrum is closest to the power spectrum of the original sound.

The fine pitch search is hereinafter explained. In the MBE decoder, such a model is presumed in which S(j) as spectral data on the frequency axis processed with orthogonal transform e.g. FFT is expressed by $$S(j)=H(j)|E(j)|0<j<J \tag{4}$$

where J corresponds to $\omega_S/4\pi=f_S/2$, and thus corresponds to 4 kHz if the sampling frequency $f_S=\omega_S/2\pi$is 8 kHz. In the formula (4), if the spectral data on the frequency axis S(j) has a waveform as shown by A in FIG. 5, H(j) represents a spectral envelope of the original spectral data S(j) shown by B in FIG. 5, whereas E(j) represents a spectrum of an equi-level periodic excitation signal as shown by C in FIG. 5. That is, the FFT spectrum S(j) is arranged into a model as a product of the spectral envelope H(j) and the power spectrum |E(j)| of the excitation signal.

The power spectrum |E(j)| of the excitation signal is formed by arraying the spectral waveform of a band for each band on the frequency axis in a repetitive manner, in consideration of periodicity (pitch structure) of the waveform on the frequency axis determined in accordance with the pitch. The one-band waveform can be formed by FFT-processing the waveform consisting of the 256-sample hamming window function with 0 data of 1792 samples added thereto, as shown in FIG. 4, as time axis signals, and by dividing the impulse waveform having bandwidths on the frequency axis in accordance with the above pitch.

Then, for each of the bands divided in accordance with the pitch, a value (amplitude)$|A_m|$ which will represent H(j) (or which will minimize the error for each band) is found. If upper and lower limit points of e.g. the m'th band (band of the m'th harmonic) are set to be $a_m$, $b_m$, respectively, an error $\epsilon_m$ of the m'th band is given by the following formula.

$$\varepsilon_m = \sum_{j=a_m}^{b_m} \{|S(j)| - |A_m||E(j)|\}^2 \tag{5}$$

The value of $|A_m|$ which will minimize the error $\epsilon_m$ is given as follows.

$$\frac{\partial \varepsilon_m}{\partial |A_m|} = -2\sum_{j=a_m}^{b_m} \{|S(j)| - |A_m||E(j)\}|E(j)| \tag{6}$$

$$\therefore |A_m| = \sum_{j=a_m}^{b_m} |S(j)||E(j)| \Big/ \sum_{j=a_m}^{b_m} |E(j)|^2$$

The error $\epsilon_m$ is minimized for $|A_m|$ in the above formula (6). Such amplitude $|A_m|$ is found for each band and the error $\epsilon_m$ for each band as defined by the formula (5) using each amplitude $|A_m|$ is found. The sum $\Sigma\epsilon_m$ of all the bands is found of the errors $\epsilon_m$ for each band. The sum $\Sigma\epsilon_m$ of all the bands is found for several minutely different pitches and a pitch is found which will minimize the sum $\Sigma\epsilon_m$ of the errors.

Several pitches above and below the rough pitch as found by the pitch extraction section 103 at an interval of e.g. 0.25 are provided. Then, the sum of the errors $\Sigma\epsilon_m$ is found for each of the minutely different pitches. If the pitch is determined, the bandwidth is determined. Using the power spectrum |S(j)| of the data on the frequency axis and the excitation signal spectrum |E(j)|, the error $\epsilon_m$ of formula (5) is found from formula (6) to find the sum $\Sigma\epsilon_m$ of all the bands. The sum $\Sigma\epsilon_m$ is found for each pitch, and a pitch which corresponds to the minimum sum of errors is determined as an optimum pitch. Thus, the finest pitch (such as 0.25 interval pitch) is found in the fine pitch search unit 106 to determine the amplitude $|A_m|$ corresponding to the optimum pitch.

In the above explanation of the fine pitch search, it is assumed that all the bands are of the voiced sound, for simplification. However, since the model is adopted in the MBE vocoder wherein an unvoiced area is present on the concurrent frequency axis, it becomes necessary to make distinction between the voiced sound and the unvoiced sound for each band.

Data of the optimum pitch and amplitude $|A_m|$ is supplied from the fine pitch search section 106 to a voiced/unvoiced distinction section 107 where voiced/unvoiced distinction is carried out for each band. For such a discrimination, a noise to signal ratio (NSR) is utilized. That is, NSR for the m'th band is given by the formula (7).

$$NSR = \frac{\sum_{j=a_m}^{b_m} \{|S(j)| - |A_m||E(j)|\}^2}{\sum_{j=a_m}^{b_m} |S(j)|^2} \tag{7}$$

If the NSR value is larger than a predetermined threshold of e.g. 0.3, that is, if the error is larger, it may be concluded that approximation of |S(j)| by $|A_m|$ |E(j)| for the band is not good, that is, the excitation signal |E(j)| is inappropriate as the base, so that the band is determined to be UV (unvoiced). Otherwise, it can be concluded that the approximation is acceptable so that the band is determined to be V (voiced).

An amplitude re-evaluation section 108 is supplied with data on the frequency axis from the orthogonal transform section 105, data of the amplitude $|A_m|$ evaluated to be fine pitch data from the fine pitch search section 106, and the V/UV distinction data from the V/UV distinction section 107. The amplitude re-evaluation section 108 again finds the amplitude for the band which has been determined to be unvoiced (UV) by the V/UV distinction section 107. The amplitude $|A_m|_{UV}$ for this UV band may be found by $$|A_m|_{uv} = \sqrt{\sum_{J=a_m}^{b_m} |S(j)|^2 / (b_m - a_m + 1)} \tag{8}$$

Data from the amplitude re-evaluation section 108 is supplied to a data number conversion section 109 which is a section for performing a processing comparable to sampling rate conversion. The data number conversion section 109 provides for a constant number of data in consideration of the changes of the number of divided bands on the frequency axis and hence the number of data, above all, the number of amplitude data, in accordance with the pitch. That is, if the effective bandwidth is set to be up to 3400 kHz, the effective bandwidth is divided into 8 to 63 bands in accordance with the pitch, and thus, the number $m_{MX}+1$ of the data of amplitude $|A_m|$ (including the amplitude of the UV band $|A_m|_{UV}$) is changed in a range of from 8 to 63. Consequently, the data number conversion section 109 converts the variable number $m_{MX}+1$ into data of a predetermined number $N_c$, such as 44.

In the present embodiment, dummy data which will interpolate the value from the last data in a block to the first data in the block is added to the amplitude data for the block of one effective band on the frequency axis, so as to expand the number of data to $N_F$. The resulting data is processed by bandwidth limiting type oversampling by an oversampling factor of $K_{OS}$, such as 8, to find amplitude data the number of which is $K_{OS}$ times the number of the amplitude data before the processing. The number equal to $((m_{MX}+1)\times K_{OS}))$ of the amplitude data is directly interpolated for expansion to a still larger number $N_M$, for example, 2048, and the $N_M$ units of data are sub-sampled for conversion into the above-mentioned predetermined number $N_C$, such as 44, of data.

Data from the data number conversion section 109, that is the above-mentioned M units of the amplitude data, are transmitted to a vector quantization section 110, where the data are grouped into data groups each consisting of a predetermined number of data. The data in each of these data groups are rendered into a vector and vector-quantized. Quantized output data form the vector quantization section 110 are outputted at an output terminal 111. Fine pitch data form the fine pitch search section 106 are encoded by a pitch encoder 115 and are them outputted via an output terminal 112.

The voiced/unvoiced(V/UV) distinction data from the voiced/unvoiced sound distinction section 107 is outputted via an output terminal 113. It is noted that the V/UV distinction data form the V/UV distinction section 107 may be data (V/UV code) representing the boundary point between the voiced region and the unvoiced region for all the bands, the number of which has been reduced to about 12. The data form the output terminals 111 to 113 are transmitted as signals of a predetermined transmission format.

These data are produced by processing data within each block consisting of the N-number e.g. 256 of samples. However, since the blocks are advanced on the time axis with the frame consisting of the L samples as a unit, the transmitted data can be produced on the basis of the frames as units. That is, the pitch data, V/UV decision data and the amplitude data are updated with a frame-based cycle.

Figure 6:
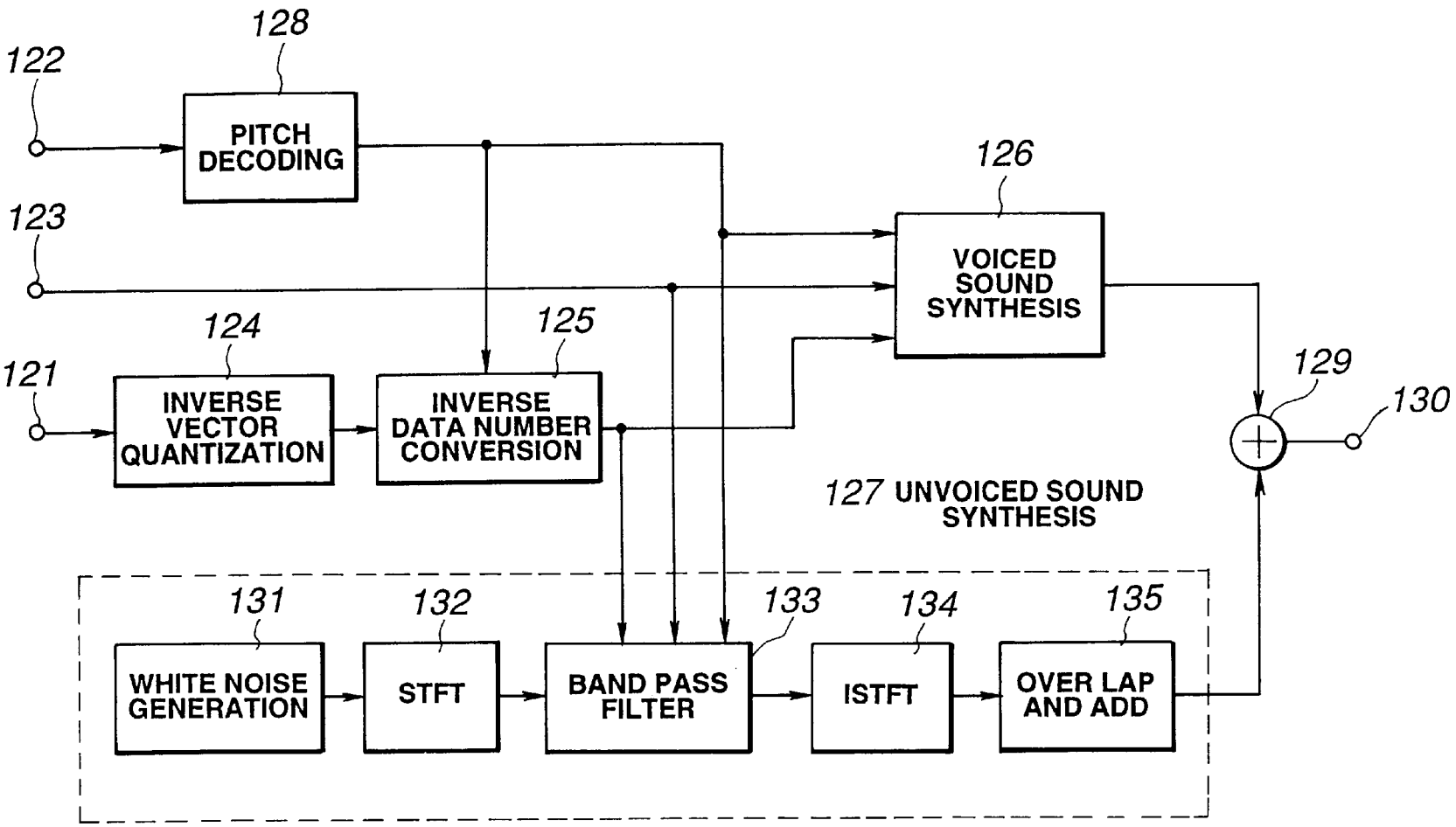
FIG. 6 is a functional block diagram showing a schematic arrangement of a synthesis side or decoder side of the synthesis-analysis encoding device for voice signals as a concrete example of a device to which the high efficiency encoding method of the present invention is applied.

Referring to FIG. 6, a schematic arrangement of the synthesizing (decoding) side for synthesizing voice signals on the basis of the transmitted data is explained.

Referring to FIG. 6, the above-mentioned vector-quantized amplitude data, the encoded pitch data, and the V/UV decision data are entered at input terminals 121 to 123, respectively. The quantized amplitude data from the input terminal 121 is supplied to an inverse vector quantization section 124 for inverse quantization, and is then supplied to a data number inverse conversion section 125 for inverse conversion. The data number inverse conversion section 125 performs a counterpart operation of the data number conversion performed by the data number conversion section 109, and resulting amplitude data is transmitted to a voiced sound synthesis section 126 and an unvoiced sound synthesis section 127. Encoded pitch data form the input terminal 122 is decoded by a pitch decoder 128 and is then transmitted to the inverse data number conversion section 125, the voiced sound synthesis section 126 and the unvoiced sound synthesis section 127. The V/UV decision data from the input terminal 123 is transmitted to the voiced sound synthesis section 126 and the unvoiced sound synthesis section 127.

The voiced sound synthesis section 126 synthesizes voiced sound waveform on the time axis by e.g. cosine wave synthesis, and the unvoiced sound synthesis section 127 synthesizes unvoiced sound waveform by filtering e.g. the white noise with a band-pass filter. The resulting voiced and unvoiced sound waveforms are summed by an adder 129 so as to be outputted from an output terminal 130. In this case, the amplitude data, the pitch data and the V/UV decision data are updated for each frame consisting of L units of, e.g. 160, samples. However, for improving inter-frame continuity or smoothness, the values of the amplitude data and the pitch data are rendered to be data values in e.g. the center positions in one frame, and data values up to the center position of the next frame (one frame during synthesis) is found by interpolation. That is, in one frame during synthesis, for example, from the center of the frame for analysis up to the center of the next frame for analysis, data values at the starting sample point and those at terminal sample point (or at the starting point of the next synthesis frame) are provided, and data values between these sample points are found by interpolation.

On the other hand, if the above-mentioned V/UV code is transmitted as V/UV decision data, all the bands can be divided into the voiced sound region (V region) and the unvoiced sound region (UV region) in one boundary point in accordance with the V/UV code, and the V/UV decision data may be produced in accordance with the demarcation. It is a matter of course that if the number of bands is reduced on the synthesis side (encoder side) to a predetermined number of, e.g. 12, bands, the number of the bands may naturally be solved or restored to the variable number conforming to the original pitch.

The synthesis processing by the voiced sound synthesis section 126 is explained in detail.

If the voiced sound for one synthesis frame (of L samples, such as 160 samples) on the time axis of the m'th band distinguished as the voiced sound is $V_m(n)$, it can be expressed by $$V_m(n)=A_m(n)\cos(\theta_m n))0\leq n<L \tag{9}$$

using the time index (sample number) within the synthesis frame. The voiced sounds of all the bands distinguished as voiced sounds are summed ($\Sigma V_m(n)$) to synthesize an ultimate voiced sound V(n).

In the above formula (9), $A_m(n)$ is the amplitude of the m'th harmonics interpolated from the starting edge to the terminal edge of the synthesis frame. Most simply, it suffices to interpolate the value of the m'th harmonics of the amplitude data updated on the frame-by-frame basis. That is, it suffices to calculate $A_m(n)$ from the following formula $$A_m(n)=(L-n)A_{0m}/L+nA_{Lm}/L \tag{10}$$

where $A_{0m}$ is the amplitude value of the m'th harmonics on the starting edge (n=0) of the synthesis frame and $A_{Lm}$ is the amplitude value of the m'th harmonics on the terminal edge of the synthesis frame (n=L: on the starting edge of the next synthesis frame).

The phase $\theta_m(n)$ in the above formula (9) may be found from $$\theta_m(n)=m\omega_{01}n+n^2m(\omega_{L1}-\omega_{01})/2L+\phi_{0m}+\Delta\omega n \tag{11}$$

where $\phi_{0m}$ is the phase of the m'th harmonics on the starting edge of the synthesis frame (n=0) (or initial phase of the frame), and $\omega_{01}$ is the fundamental angular frequency on the starting edge of the synthesis frame (n=0). $\omega_{L1}$ is the fundamental angular frequency on the terminal edge of the next synthesis frame (n=L). $\Delta\omega$ in the above formula (11) is set to be minimum so that the phase $\phi_{LM}$ for n=L is equal to $\theta_m(L)$.

The manner in which the amplitude $A_m(n)$ and the phase $\theta_m(n)$ for an arbitrary m'th band are found, in accordance with the results of V/UV distinction for n=0 and n=L, is hereinafter explained.

If the m'th band is of voiced sound for both n=0 and n=L, the amplitude $A_m(n)$ can be calculated by linear interpolation of the transmitted amplitude values $A_{0m}$ and $A_{Lm}$ from the above formula (10). As for the phase $\theta_m(n)$, $\Delta\omega$ is set so that $\theta_m(\mathbf{0})=\phi_{0m}$ for n=0 and $\theta_m(L)=\phi_{Lm}$ for n=L.

If the sound is V (voiced) for n=0 and UV (unvoiced) for n=L, the amplitude $A_m(n)$ is linearly interpolated so that the amplitude $A_m(\mathbf{0})$ becomes equal to 0 at $A_m(L)$ from the transmitted amplitude $A_{0m}$ for $A_m(\mathbf{0})$. The transmitted amplitude value $A_{Lm}$ for n=L is the amplitude value for the unvoiced sound and is employed for synthesizing the unvoiced sound as later explained. The phase $\theta_m(n)$ is set so that $\theta_m(\mathbf{0})=\phi_{0m}$ and $\Delta\Omega=0$.

If the sound is UV (unvoiced) for n=0 and (V) voiced for n=L, the amplitude $A_m(n)$ is linearly interpolated so that the amplitude $A_m(\mathbf{0})$ for n=0 is 0 and becomes equal to the transmitted amplitude $A_{Lm}$ for n=L. As for the phase $\theta_m(n)$, using the phase value $\theta_{Lm}$ on the terminal edge of the frame as the phase $\theta_m(\mathbf{0})$ for n=0, $\theta_m(\mathbf{0})$ is expressed by $$\theta_m(0)=\theta_{Lm}-m(\omega_{01}+\omega_{L1})L/2 \tag{12}$$

where $\Delta\omega=0$.

The technique of setting $\Delta\theta$ so that $\theta_m(L)$ is equal to $\phi_{Lm}$ when the sound is V (voiced) both for n=0 and n=L is explained. By setting n=L in the above formula (11), the following formula is obtained.

$$\begin{aligned}\theta_m(L) &= m\omega_{01}L+L^2m(\omega_{Lf}+\omega_{01})/2L+\phi_{0m}+\Delta\omega L\\ &= m(\omega_{01}+\omega_{Lf})L/2+\phi_{0m}+\Delta\omega L\\ &= \phi_{Lm}\end{aligned}$$

The above formula can be arranged to provide $$\Delta\omega=(\mathrm{mod}2\pi((\phi_{Lm}-\phi_{0m})-mL(\omega_{01}=\omega_{L1})/2\ )/L \tag{13}$$

where mod$2\pi$(x) is a function which returns the main value of x between $-\pi$ and $+\pi$. For example, if x=1.3$\pi$, mod$2\pi$(x)=−0.7$\pi$. If x=2.3$\pi$, mod$2\pi$(x)=0.3$\pi$, and if x=−1.3$\pi$, mod$2\pi$(x)=0.7$\pi$.

Figure 7A:
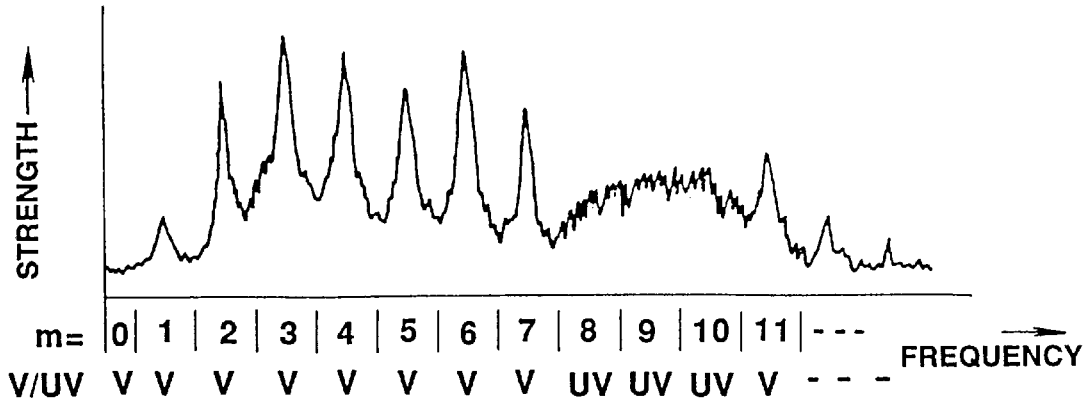
FIG. 7 is a diagram for explaining unvoiced sound synthesis at the time of synthesis of voice signals.

FIG. 7A shows an example of a spectrum of voiced signals, where the bands with the band numbers (harmonics numbers) of 8, 9 and 10 are of UV (unvoiced) sounds and the remaining bands are of V (voiced) sounds. The time axis signals of the bands of the V sounds are synthesized by the voiced sound synthesis section 126, and the time axis signals of the bands of the UV sounds are synthesized by the unvoiced sound synthesis section 127.

However, when the voiced (V) band region and the unvoiced (UV) band region are demarcated from each other at a sole point, the V/UV code transmitted may be set to 7 while all the other bands with m being not less than 8 may be made unvoiced band region. Alternatively, the V/UV code making all the bands V (voiced) may be transmitted.

The operation of synthesizing UV sounds by the UV sound synthesis section 127 is explained.

Figure 7B:
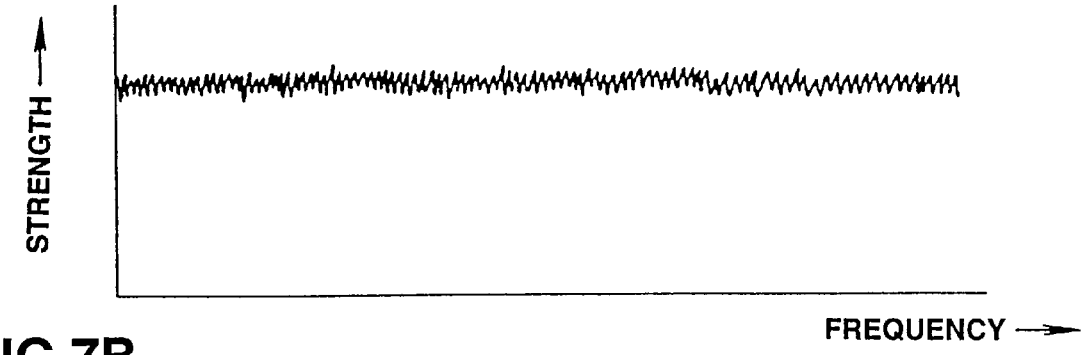
Figure 7C:
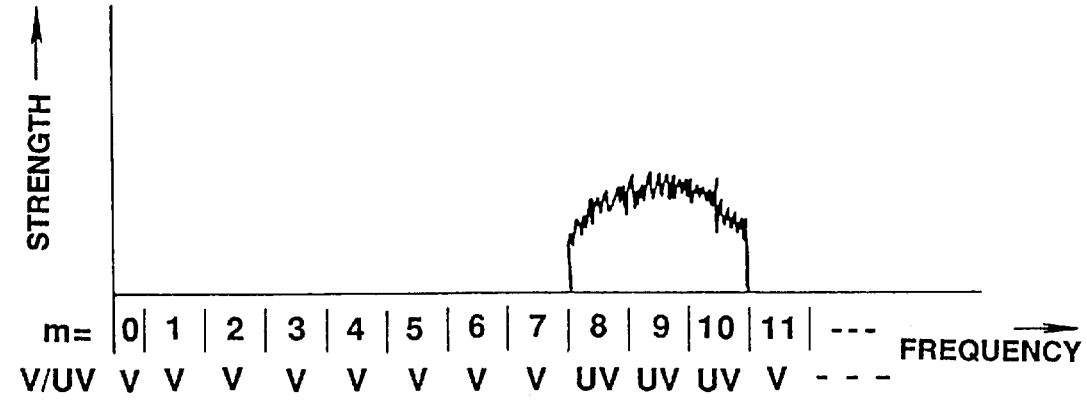

The white noise signal waveform on the time axis from a white noise generator 131 is multiplied by a suitable window function (e.g. a hamming window) at a predetermined length (such as 256 samples) and is processed with short term Fourier transform (STFT) by an STFT processor 132, thereby producing a power spectrum of the white noise on the frequency axis as shown by B in FIG.7. The power spectrum form the STFT processor 132 is transmitted to a band pass filter 133, where the spectrum is multiplied by the amplitude $|A_m|_{UV}$ for the UV bands (e.g. m=8, 9 or 10), as shown by C in FIG. 7, while the amplitude of the V bands is set to 0. The band pass filter 133 is also supplied with the above-mentioned amplitude data, pitch data and V/UV decision data.

Since the V/UV code which designates only one boundary point between the voiced (V) region and the unvoiced (UV) region of all the bands is employed as the V/UV decision data, the bands toward the lower frequency of the designated boundary point are set as the voiced (V) bands, and the bands toward the higher frequency of the designated boundary point are set as the unvoiced (UV) bands. The number of these bands may be reduced to a predetermined smaller number, e.g. 12.

An output form the band pass filter 133 is supplied to an ISTFT processor 134 while the phase is processed with inverse STFT processing using the phase of the original white noise, for conversion into signals on the time axis. An output from the ISTFT processor 134 is transmitted to an overlap and add section 135, where overlapping and addition are performed repeatedly with suitable weighting on the time axis for enabling restoration of the original continuous noise waveform, thereby synthesizing the continuous waveform on the time axis. An output signal form the overlap and add section 135 is supplied to the adder 129.

The V and UV signals, thus synthesized in the synthesis section 126, 127 and restored to the time axis signals, are summed by the adder 129 at a fixed mixture ratio, and then the reproduced signals are taken out from the output terminal 130.

Meanwhile, the arrangement of the voice analysis side (encoder side) shown in FIG. 1 and the arrangement of the voice synthesis side (decoder side) shown in FIG. 6, which have been described as hardware components, may also be realized by a software program using a digital signal processor (DSP).

Next, concrete examples of each part and portion of the above-mentioned synthesis-analysis encoder or vocoder for voice signals are explained in detail with reference to the drawings.

First, a concrete example of a pitch extraction method by the pitch extraction section 103 shown in FIG. 1, that is, a concrete example of a pitch extraction method for extracting pitch from the input voiced signal waveform is explained.

The voice sounds are divided into voiced sounds and unvoiced sounds. The unvoiced sounds, which are sounds without vibrations of the vocal cords, are observed as non-periodic noises. Normally, the majority of voice sounds are voiced sounds, and the unvoiced sounds are particular consonants called unvoiced consonants. The period of the voiced sounds is determined by the period of vibrations of the vocal cords, and is called a pitch period, the reciprocal of which is called a pitch frequency. The pitch period and the pitch frequency are important determinants of the height and intonation of voices. Therefore, exact extraction of the pitch period from the original voice waveform, hereinafter referred to as pitch extraction, is important among the processes of voice synthesis for analyzing and synthesizing voices.

The above-mentioned pitch extraction method is categorized into a waveform processing method for detecting the peak of the period on the waveform, a correlation processing method utilizing the strength of the correlation processing to waveform distortion, and a spectrum processing method utilizing periodic frequency structure of the spectrum.

Figure 8A:
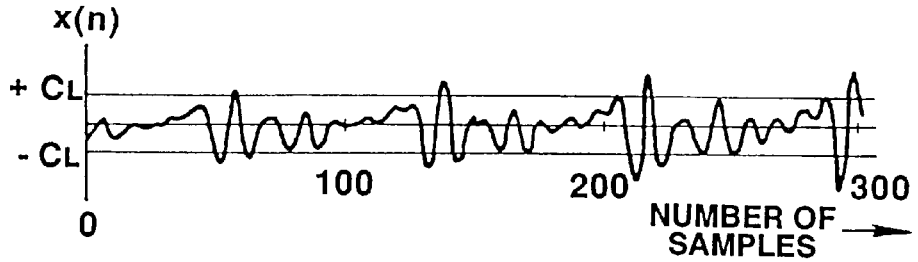
FIG. 8 is a waveform diagram for explaining a conventional pitch extraction method.
Figure 8B:
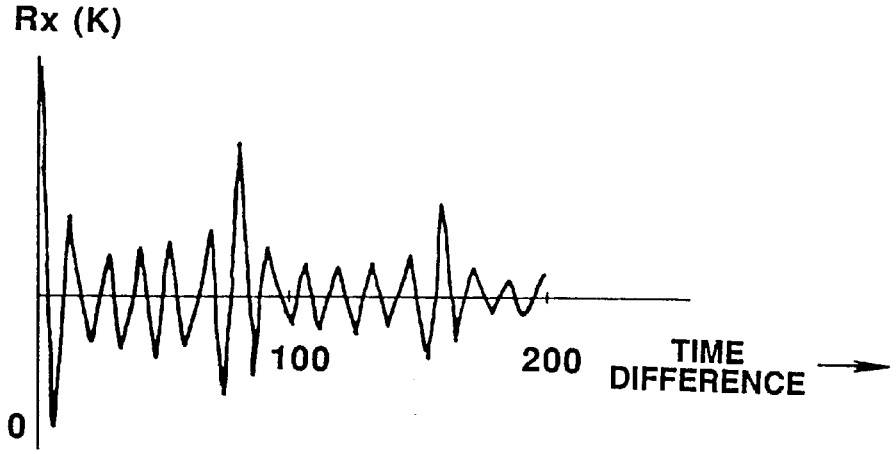
Figure 8C:
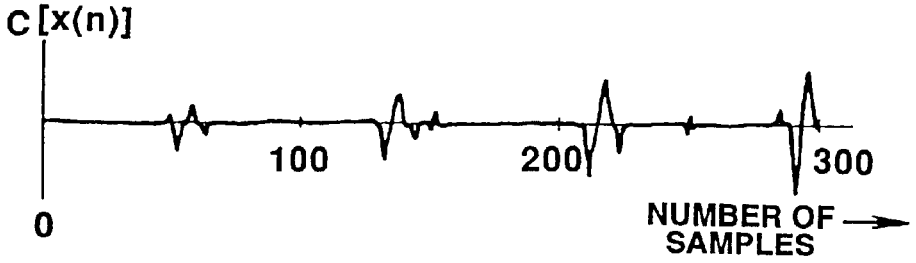
Figure 8D:
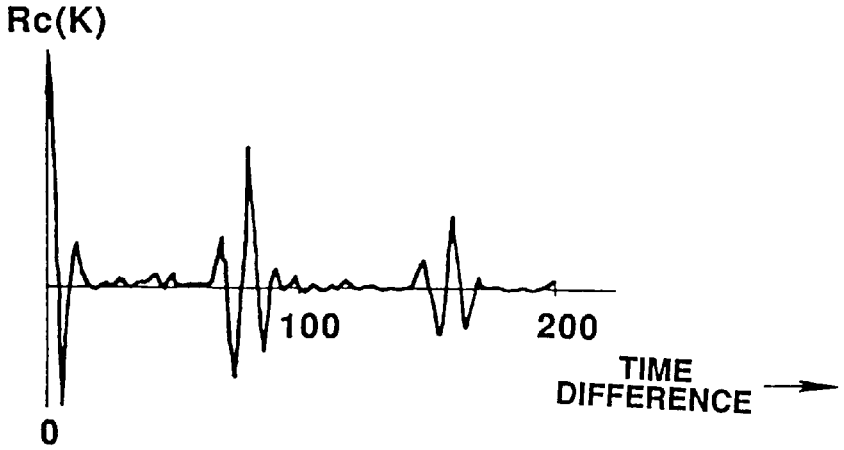

An auto-correlation method, which is one the correlation methods, is explained with reference to FIG. 8. FIG. 8A shows an input voice sound waveform x(n) for 300 samples, and FIG. 8B shows a waveform produced by finding an auto-correlation function of x(n) shown in FIG. 8A. FIG. 8C shows a waveform C[x(n)] produced by center clipping at a clipping level $C_L$ shown in FIG. 8A, and FIG. 8D shows a waveform Rc(k) produced by finding the auto-correlation of C[x(n)] shown in FIG. 8C.

The auto-correlation function of the input voice waveform x(n) for 300 samples shown in FIG. 8A is found to be a waveform Rx(k) shown in FIG. 8B, as described above. With the waveform Rx(k) of the auto-correlation function shown in FIG. 8B, a strong peak is found at the pitch period. However, a number of excessive peaks due to damping vibrations of the voice cords are also observed. In order to reduce these excessive peaks, it is conceivable to find the auto-correlation function from the center clip waveform C[x(n)] shown in FIG. 8C wherein the waveform smaller in the absolute value than the clipping level $\pm C_L$ shown in FIG. 8A is crushed. In this case, only several pulses are left at the original pitch interval in the center-clipped waveform C[x(n)] shown in FIG. 8C, and excessive peaks are reduced in the waveform of the auto-correlation function Re(k) found therefrom.

The pitch obtained by the above pitch extraction is an important determinant of the height and intonation of voices, as described above. The precise pitch extraction from the original voice waveform is adopted for e.g. high efficiency encoding of voice waveforms.

Meanwhile, in finding the pitch from the peak of the auto-correlation of the input voice signal waveform, the clipping level has been conventionally set so that the peak to be found by the center clipping appears sharply. Specifically, the clipping level has been set to be low so as to avoid the lack of the signal of a minute level due to clipping.

Accordingly, if there is sharp fluctuations of the input level such as setting up of the voice sound with the low clipping level, excessive peaks are generated at the time when the input level is increased. Thus, the effect of clipping is hardly obtained, leaving a fear of instability of pitch extraction.

Thus, a first concrete example of the pitch extraction method whereby secure pitch extraction may be possible even when the level of input voice waveform is sharply changed within one frame is explained hereinbelow.

That is, in the first example of the pitch extraction method, the voice signal waveform to be inputted is taken out on the block-by-block basis. In the pitch extraction method for extracting the pitch on the basis of center-clipped output signals, the block is divided into plural sub-blocks so as to find a level for clipping for each of the sub-blocks, and when the input signal is center-clipped, the clipping level is changed within the block on the basis of the level for clipping found for each of the sub-blocks.

Also, when there is a large fluctuation of the peak level between adjacent sub-blocks among the plural sub-blocks within the block, the clipping level in center clipping is changed within the block.

The clipping level in center clipping may be gradationally or continuously changed within the block.

According to this first example of the pitch extraction method, the input voice signal waveform taken out on the block-by-block basis is divided into plural sub-blocks, and the clipping level is changed within the block on the basis of the level for clipping found for each of the sub-blocks, thereby performing secure pitch extraction.

In addition, when there is a large fluctuation of the peak level between adjacent sub-blocks among the plural sub-blocks, the clipping level is changed within the block, thereby realizing secure pitch extraction.

The first concrete example of the pitch extraction method is explained with reference to the drawings.

Figure 9:
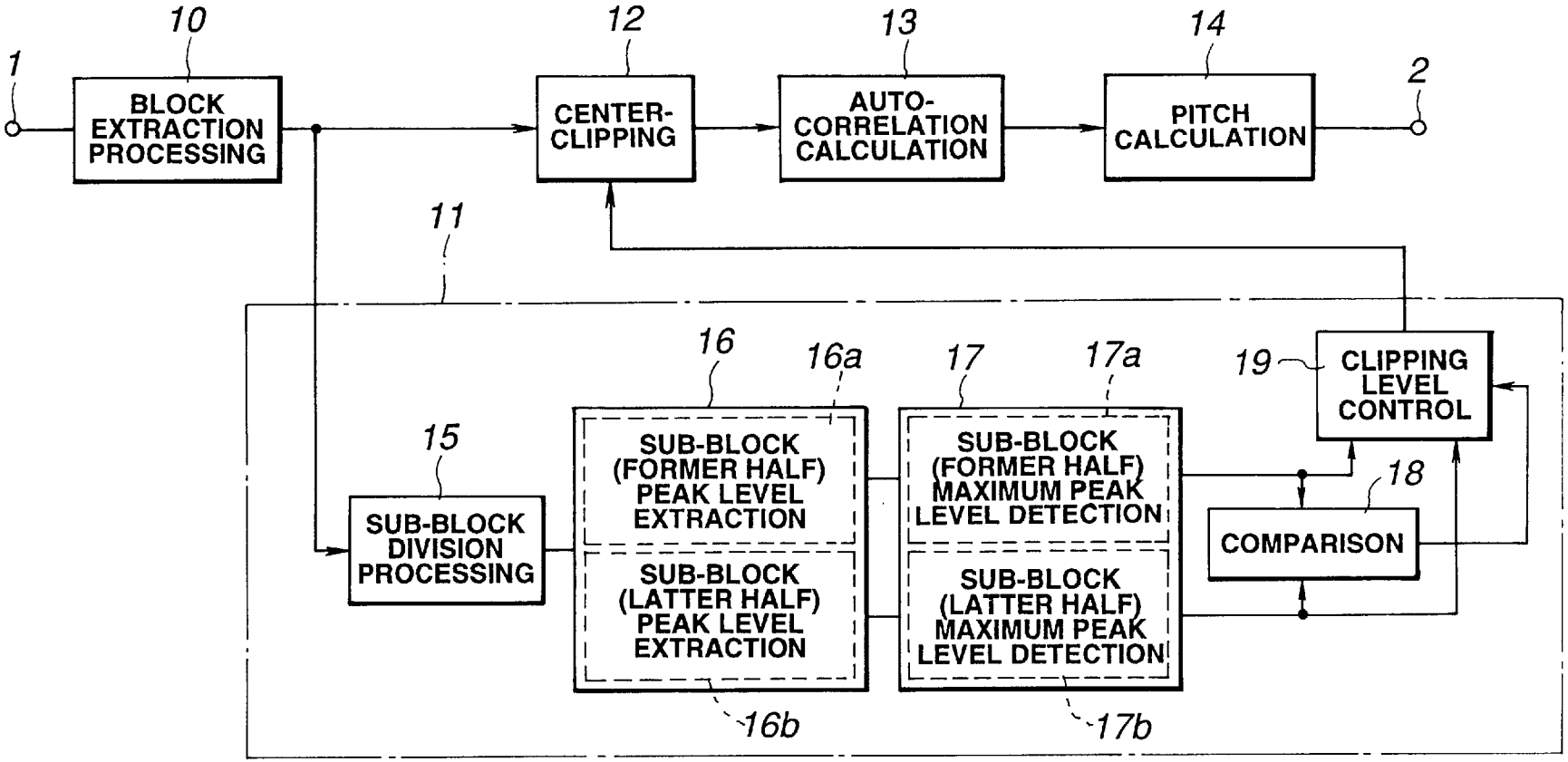
FIG. 9 is a functional block diagram for explaining a first example of the pitch extraction method employed in the high efficiency encoding method according to the present invention.

FIG. 9 is a functional block diagram for illustrating the function of the present embodiment of the pitch extraction method according to the present invention.

Referring to FIG. 9, there are provided, in this example: a block extraction processing section 10 for taking out, on the block-by-block basis, an input voice signal supplied from an input terminal 1; a clipping level setting section 11 for setting the clipping level from one block of the input voice signal extracted from the block extraction processing section 10; a center-clip processing section 12 for center-clipping one block of the input voice signal at the clipping level set by the clipping level setting section 11; an auto-correlation calculating section 13 for calculating an auto-correlation from the center-clip waveform from the center-clip processing section 12; and a pitch calculator 14 for calculating the pitch from the auto-correlation waveform from the auto-correlation calculating section 13.

The clipping level setting section 11 includes: a sub-block division section 15 for dividing one block of the input voice signal supplied from the block extraction section 10 into plural sub-blocks (two sub-blocks, i.e. former and latter halves, in the present embodiment); a peak level extraction unit 16 for extracting the peak level in each of the former half and latter half sub-blocks of the input voice signal divided by the sub-block division section 15; a maximum peak level detection section 17 for detecting the maximum peak level in the former and latter halves from the peak level extracted by the peak level extraction section 16; a comparator 18 for comparing the maximum peak level in the former half and the maximum peak level in the latter half from the maximum peak level detection section 17 under certain conditions; and a clipping level control section 19 for setting the clipping level from results of the comparison by the comparator 18 and the two maximum peak levels detected by the maximum peak level detection section 17, and for controlling the center-clip processing section 12.

The peak level extraction section 16*b* is constituted by sub-block peak level extraction sections 16*a*, 16*b*. The sub-block peak level extraction section 16*a* extracts the peak level from the former half produced by division of the block by the sub-block division section 15. The sub-block peak level extraction section 16*b* extracts the peak level from the latter half produced by division of the block by the sub-block division section 15.

The maximum peak level detection section 17 is constituted by sub-block maximum peak level detectors 17*a*, 17*b*. The sub-block maximum peak level detector 17*a* detects the maximum peak level of the former half from the peak level of the former half extracted by the sub-block peak level extraction section 16*a*. The sub-block maximum peak level detector 17*b* detects the maximum peak level of the latter half from the peak level of the latter half extracted by the sub-block peak level extraction section 16*b*.

Next, an operation of the present embodiment comprised of the functional block shown in FIG. 9 is explained with reference to a flowchart shown in FIG. 10 and a waveform view shown in FIG. 11.

Figure 10:
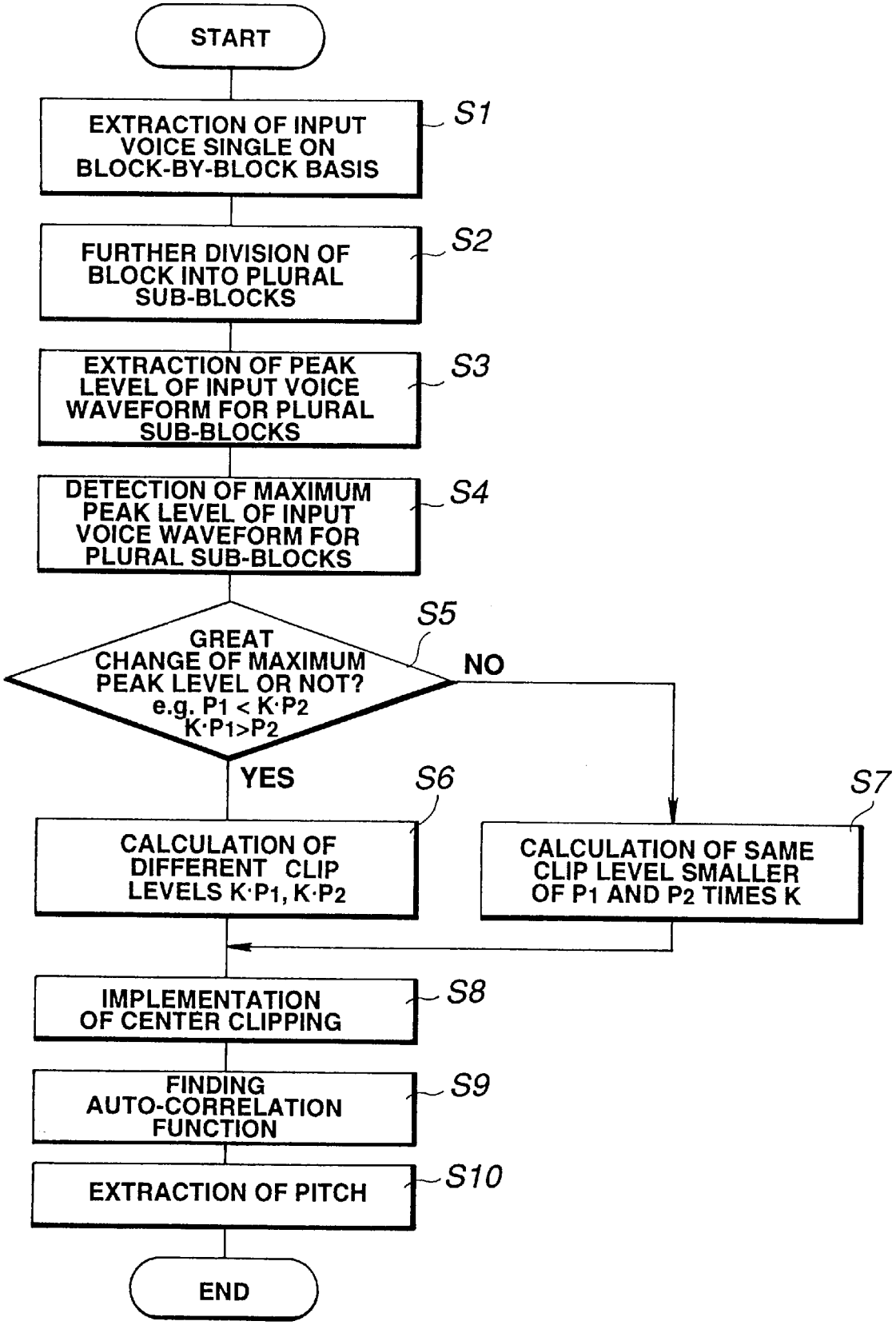
FIG. 10 is a flowchart for explaining movement of the first example of the pitch extraction method.
Figure 11A:
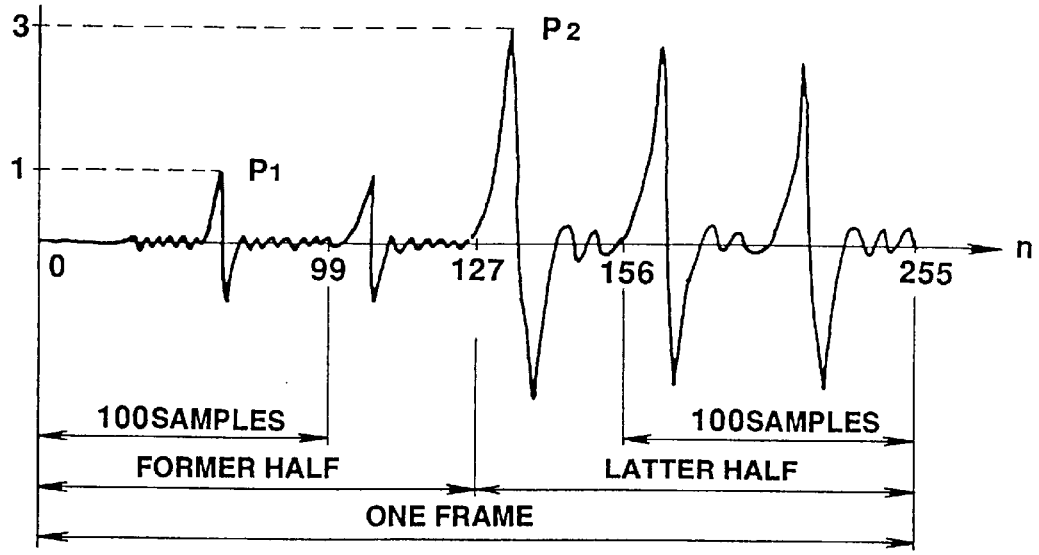
FIG. 11 is a waveform diagram for explaining the first example of the pitch extraction method.

First, in the flowchart of FIG. 10, if the operation is initiated, an input voice signal waveform is taken out on the block-by-block basis at step S1. Specifically, the input voice signal is multiplied by a window function, and partial overlapping is carried out to the input voice signal, so as to cut out the input voice signal waveform. Thus, the input voice signal waveform of one frame (256 samples) shown in FIG. 11A is produced. Then, the operation proceeds to step S2.

At step S2, one block of the input voice signal taken out at step 1 is further divided into plural sub-blocks. For example, in the input voice signal waveform of one block shown in FIG. 11A, the former half is set to n=0, 1, . . . , 127, and the latter half is set to n=128, 129, . . . , 255. Then, the operation proceeds to step S3.

At step S3, peak levels of the input voice signals in the former and latter halves produced by division at step S2 are extracted. This extraction is the operation of the peak level extraction section 16 shown in FIG. 9.

At step S4, maximum peak levels $P_1$ and $P_2$ in the respective sub-blocks are detected from the peak levels in the former and latter halves extracted at step S3. This detection is the operation of the maximum peak level detection section 17 shown in FIG. 9.

At step S5, the maximum peak levels $P_1$ and $P_2$ within the former and latter halves detected at step S4 are compared with each other under certain conditions, and detection is carried out as to whether the level fluctuation of the input voice signal waveform is sharp or not within one frame. The conditions mentioned here are that the maximum peak level $P_1$ of the former half is smaller than a value produced by the maximum peak level $P_2$ of the latter half multiplied by a coefficient k (0<k<1), or that the maximum peak level $P_2$ of the latter half is smaller than a value produced by the maximum peak level $P_1$ of the former half multiplied by a coefficient k (0<k<1). Accordingly, at this step S5, the maximum peak levels $P_1$ and $P_2$ of the former and latter halves, respectively, are compared with each other on the condition of $P_1<k\cdot P_2$ or $k\cdot P_1>P_2$. This comparison is the operation of the comparator 18 shown in FIG. 9. As a result of the comparison of the maximum peak levels $P_1$ and $P_2$ of the former and latter halves, respectively, under the above-mentioned conditions at step S5, if it is decided that the level fluctuation of the input voice signal is large (YES), the operation proceeds to step S6. If it is decided that the level fluctuation of the input voice signal is not large (NO), the operation proceeds to step S7.

Figure 11B:
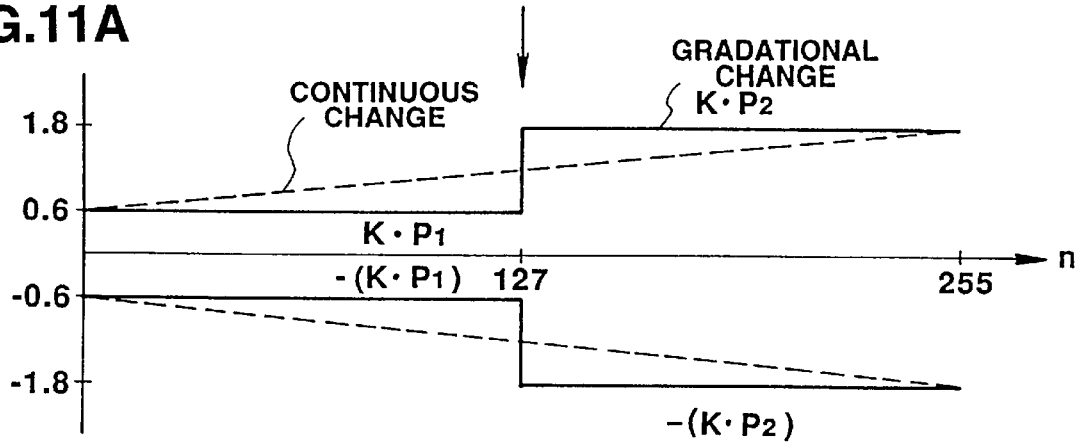

At step S6, in accordance with the result of decision at step S5 that the fluctuation of the maximum level is large, calculation is carried out with different clipping levels. In FIG. 11B, for example, the clipping level in the former half ($0\leqq n\leqq 127$) and the clipping level in the latter half ($128\leqq n\leqq 255$) are set to $k\cdot P_1$ and $k\cdot P_2$, respectively.

On the other hand, at step S7, in accordance with the result of decision at step S5 that the level fluctuation of the input voice signal is not large within one block, calculation is carried out with a unified clipping level. For example, the smaller of the maximum peak level $P_1$ and the maximum peak level $P_2$ is multiplied by k to produce $k\cdot P_1$ or $k\cdot P_2$. $k\cdot P_1$ or $k\cdot P_2$ is then clipped and set.

These steps S6 and S7 are operations of the clipping level control unit 19 shown in FIG. 9.

At step S8, center-clip processing of one block of the input voice waveform is carried out at a clipping level set at step S6 or S7. This center-clip processing is the operation of the center-clip processing section 12 shown in FIG. 9. Then, the operation proceeds to step S9.

At step S9, the auto-correlation function is calculated from the center-clip waveform obtained by center-clip processing at step S8. This calculation is the operation of the auto-correlation calculation unit 13 shown in FIG. 9. Then, the operation proceeds to step S10.

At step S10, the pitch is extracted from the auto-correlation function found at step 9. This pitch extraction is the operation of pitch calculation section 14 shown in FIG. 9.

FIG. 11A shows the input voice signal waveform wherein one block consists of 256 samples of N=0, 1, . . . , 255. In FIG. 11A, the former half is set to N=0, 1, . . . , 127, and the latter half is set to N=128, 129, . . . , 255. The maximum peak levels of the absolute value of the waveform are found within 100 samples of N=0, 1, . . . , 99 in the former half, and within 100 samples of N=156, 157, . . . , 255, respectively. The maximum peak levels thus found are $P_1$ and $P_2$, respectively. If the value of k is set to 0.6 for $P_1=1$, $P_2=3$, as shown in FIG. 11A, the following formula holds.

$$P_1(=1)<k\cdot P_2(=1.8)$$

Figure 11C:
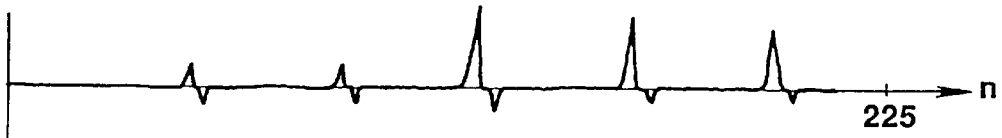
Figure 11D:
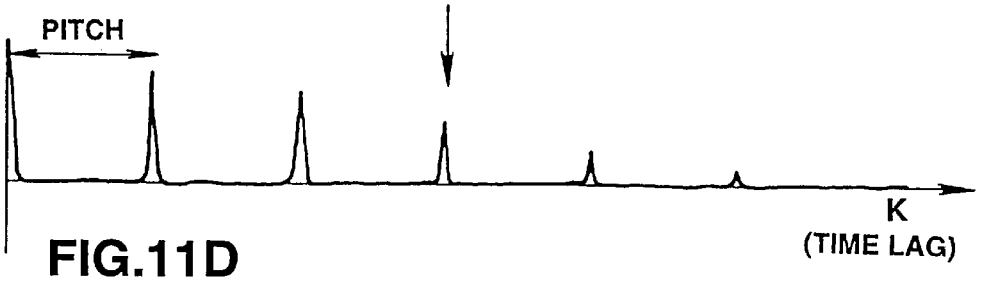

In this case, the clipping level of the former half is set to $k\cdot P_1=0.6$ and the clipping level of the latter half is set to $k\cdot P_2=1.8$ for the large level fluctuation of the input voice signal waveform. These clipping levels are shown in FIG. 11B. A waveform processed with center-clipping at the clipping levels shown in FIG. 11B is shown in FIG. 11C. The auto-correlation function of the center-clipped waveform shown in FIG. 11C is taken to be shown in FIG. 11D. From FIG. 11D, the pitch can be calculated.

The clipping level at the center-clip processing section 12 may be changed not only progressively within the block as described above, but also continuously as shown by a broken line in FIG. 11B.

If the first example of the pitch extraction method is applied to the MBE vocoder explained with reference to FIGS. 1 to 7, pitch extraction of the pitch extraction section 103 is carried out by detecting the peak level of the signal of each sub-block produced by dividing the block, and changing the clipping level progressively or continuously when the difference of the peak levels of these sub-blocks. Thus, even though there is a sharp fluctuation of the peak level, the pitch can be extracted securely.

That is, according to the first example of the pitch extraction method, secure pitch extraction is made possible by taking out the input voice signal on the block-by-block basis, dividing the block into plural sub-blocks, and changing the clipping level of the center-clipped signal on the block-by-block basis in accordance with the peak level for each of the sub-blocks.

In addition, according to the pitch extraction method, when the fluctuation of the peak levels of adjacent sub-blocks among the plural sub-blocks is large, the clipping level for each block is changed. Thus, even though there are sharp fluctuations such as rise and fall of voices, secure pitch extraction becomes possible.

Meanwhile, the first example of the pitch extraction method is not limited to the example shown by the drawings. The high efficiency encoding method to which the first example is applied is not limited to the MBE vocoder.

Other examples, i.e. second and third examples, of the pitch extraction method are explained with reference to the drawings.

In general, when the auto-correlation of the input voice signal is observed, there is a high possibility that the maximum of the peaks is the pitch. However, if the peaks of the auto-correlation do not appear clearly because of the level fluctuation of the input voice signal or the background noise, a correct pitch cannot be obtained with a pitch an integer times larger being caught, or it is decided that there is no pitch. It is also conceivable to limit an allowable range of the pitch fluctuations for avoiding the above problems. However, it has been impossible to follow a sharp change of the pitch of one speaker or an alternation of two or more speakers causing e.g. continuous changes between male voices and female voices.

Thus, a concrete example of the pitch extraction method whereby the probability of catching a wrong pitch becomes low and whereby the pitch can be extracted stably is proposed.

That is, the second example of the pitch extraction method comprises the steps of: demarcating an input voice signal on the frame-by-frame basis; detecting plural peaks from auto-correlation data of a current frame; finding a peak among the detected plural peaks of the current frame and within a pitch range satisfying a predetermined relation with a pitch found in a frame other than the current frame; and deciding the pitch of the current frame on the basis of the position of the peak found in the above manner.

With high reliability of the pitch of the current frame, plural pitches of the current frame are determined by the position of the maximum peak when the maximum among the plural peaks of the current frame is equal to or larger than a predetermined threshold, and the pitch of the current frame is determined by the position of the peak within the pitch range satisfying a predetermined relation with the pitch found in a frame other than the current frame when the maximum peak is smaller than the predetermined threshold.

Meanwhile, the third example of the pitch extraction method comprises the steps of: demarcating an input voice signal on the frame-by-frame basis; detecting all peaks from auto-correlation data of a current frame; finding a peak among all the detected peaks of the current frame and within a pitch range satisfying a predetermined relation with a pitch found in a frame other than the current frame; and deciding the pitch of the current frame on the basis of the position of the peak found in the above manner.

In the process of taking out the input voice signal on the frame-by-frame basis with blocks proceeding along the time axis as units, the input voice signal is divided into blocks each consisting of a predetermined number N, e.g. 256, of samples, and is moved along the time axis at a frame interval of L samples, e.g. 160 samples, having an overlap range of (N−L) samples, e.g. 96 samples.

The pitch range satisfying the predetermined relation is, for example, a range a to b times, e.g. 0.8 to 1.2 times, larger than a fixed pitch of a preceding frame.

If the fixed pitch is absent in the preceding frame, a typical pitch which is supported for each frame and is typical of a person to be the object of analysis, and the locus of the pitch is followed, using the pitch within the range a to b times, e.g. 0.8 to 1.2 times, the typical pitch.

Further, in case the person suddenly raises a voice of a pitch different from the past pitch, the locus of the pitch is followed, using a pitch capable of jumping pitches in the current frame regardless of the past pitch.

According to the second example of the pitch extraction method, the pitch of the current frame can be determined on the basis of the position of the peak among the plural peaks detected from the auto-correlation data of the current frame of the input voice signal demarcated on the frame-by-frame basis and within the pitch range satisfying the predetermined relation with the pitch found in a frame other than the current frame. Therefore, the probability of catching a wrong pitch becomes low, and stable pitch extraction can be carried out.

Also, the pitch of the current frame can be determined on the basis of the position of the peak among all the peaks detected from the auto-correlation data of the current frame of the input voice signal demarcated on the frame-by-frame basis and within the pitch range satisfying the predetermined relation with the pitch found in a frame other than the current frame. Therefore, the probability of catching a wrong pitch becomes low, and stable pitch extraction can be carried out.

Further, according to the third example of the pitch extraction method, the pitch of the current frame is determined by the position of the maximum peak when the maximum among the plural peaks of the current frame is equal to or higher than a predetermined threshold. The pitch of the current frame is determined by the position of the peak within the pitch range satisfying a predetermined relation with the pitch found in a frame other than the current frame when the maximum peak is smaller than the predetermined threshold. Therefore, the probability of catching a wrong pitch becomes low, and stable pitch extraction can be carried out.

Referring to the drawings, concrete examples in which the second and third examples of the pitch extraction method are applied to a pitch extraction device are explained hereinafter.

Figure 12:
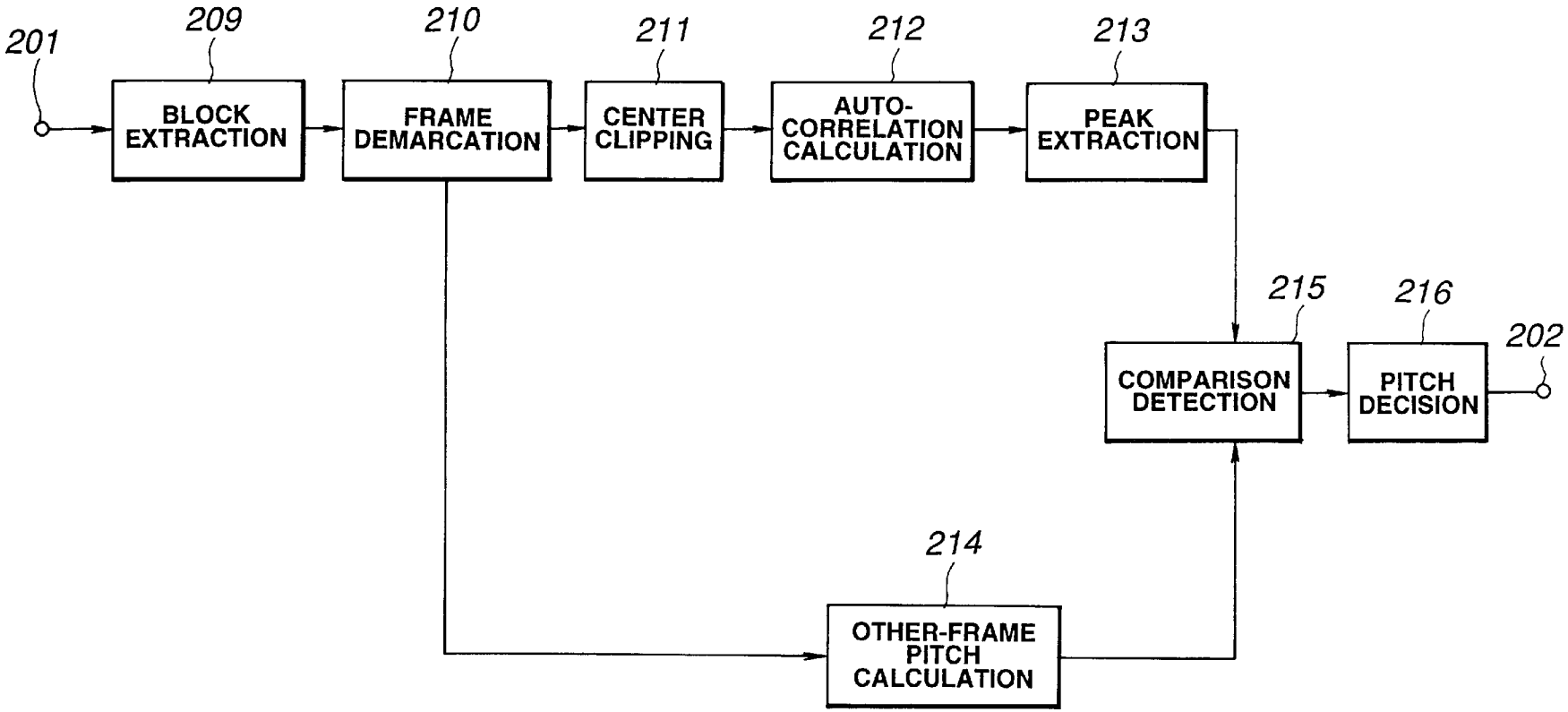
FIG. 12 is a functional block diagram showing a schematic arrangement of a concrete example to which a second example of the pitch extraction method employed in the high efficiency encoding method of the present invention is applied.

FIG. 12 is a block diagram showing a schematic arrangement of a pitch extraction device to which the second example of the pitch extraction method is applied.

The pitch extraction device shown in FIG. 12 comprises: a block extraction section 209 for taking out an input voice signal waveform on the block-by-block basis; a frame demarcation section 210 for demarcating, on the frame-by-frame basis, the input voice signal waveform taken out on the block-by-block basis by the block extraction section 209; a center-clip processing unit 211 for center-clipping the voice signal waveform of a current frame from the frame demarcation section 210; an auto-correlation calculating section 212 for calculating auto-correlation data from the voice signal waveform center-clipped by the center-clip processing section 211; a peak detection section 213 for detecting plural or all the peaks from the auto-correlation data calculated by the auto-correlation calculating section 212; an other-frame pitch calculating section 214 for calculating a pitch of a frame (hereinafter referred to as other frame) other than the current frame from the frame demarcation section 210; a comparison/detection section 215 for comparing the peaks as to whether the plural peaks detected by the peak detection section 213 are within a pitch range satisfying a predetermined function with the pitch of the other-frame pitch calculating section 214 and for detecting peaks within the range; and pitch decision section 216 for deciding a pitch of the current frame on the basis of the position of the peak found by the comparison/detection section 215.

The block extraction section 209 multiplies the input voice signal waveform by a window function, generating partial overlap of the input voice signal waveform, and cuts out the input voice signal waveform as a block of N samples. The frame demarcation unit 210 demarcates, on the L-sample frame-by-frame basis, the signal waveform on the block-by-block basis taken out by the block extraction section 209. In other words, the block extraction section 209 takes out the input voice signal as a unit of N samples proceeding along the time axis on the L-sample frame-by-frame basis.

The center-clip processing section 211 controls such characteristics as to disorder periodicity of the input voice signal waveform for one frame from the frame demarcation section 210. That is, a predetermined clipping level is set for reducing excessive peaks by way of damping vocal cords before calculating the auto-correlation of the input voice signal waveform, and a waveform smaller in the absolute value than the clipping level is crushed.

The auto-correlation calculating section 212 calculates, for example, periodicity of the input voice signal waveform. Normally, the pitch period is observed in a position of an strong peak. In the second example, the auto-correlation function is calculated after one frame of the input voice signal waveform is center-clipped by the center-clip processing section 211. Therefore, a sharp peak can be observed.

The peak detection section 213 detects plural or all the peaks from the auto-correlation data calculated by the auto-correlation calculating section 212. In short, the value r(n) of the n'th sample of the auto-correlation function becomes the peak when the value r(n) is larger than adjacent auto-correlations r(n−1) and r(n+1). The peak detection section 213 detects such a peak.

The other-frame pitch calculating section 214 calculates a pitch of a frame other than the current frame demarcated by the frame demarcation section 210. In the present embodiment, the input voice signal waveform is divided by the frame demarcation section 210 into, for example, a current frame, a past frame and a future frame. In the present embodiment, the current frame is determined on the basis of the fixed pitch of the past frame, and the determined pitch of the current frame is fixed on the basis of the pitch of the past frame and the pitch of the future frame. The idea of precisely producing the pitch of the current frame from the past frame, the current frame and the future frame is called a delayed decision.

The comparison/detection section 215 compares the peaks as to whether the plural peaks detected by the peak detection section 213 are within a pitch range satisfying a predetermined function with the pitch of the other-frame pitch calculating section 214, and detects peaks within the range.

The pitch decision section 216 decides the pitch of the current frame from the peaks compared and detected by the comparison/detection section 215.

The peak detection section 213 among the above-described component units and the processing of the plural or all the peaks detected by the peak detection section 213 are explained with reference to FIG. 13.

Figure 13A:
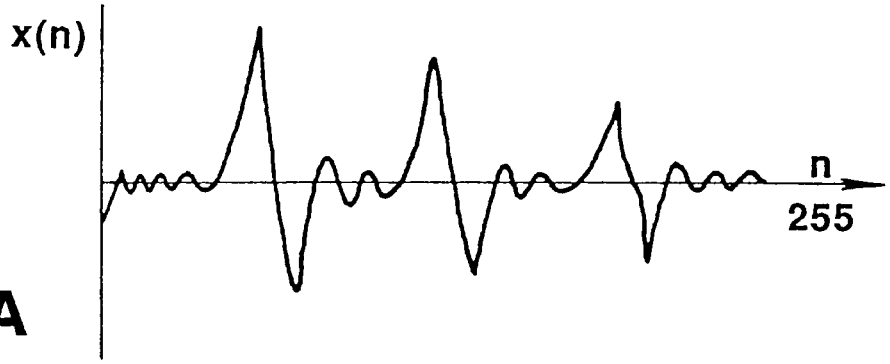
FIG. 13 is a waveform diagram for explaining processing of input voice signal waveform of the second example of the pitch extraction method.
Figure 13B:
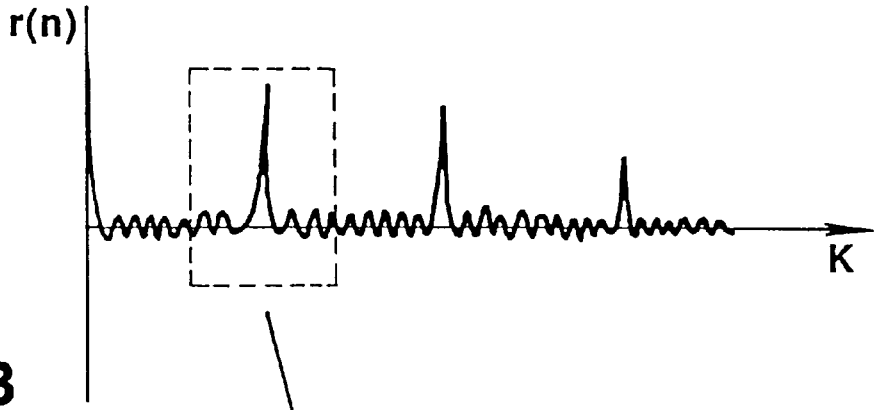

The input voice signal waveform x(n) indicated by A in FIG. 13 is center-clipped by the center-clip processing section 211, and then the waveform r(n) of the auto-correlation as indicated by B in FIG. 13 is found by the auto-correlation calculating section 212. The peak detection section 213 detects plural or all peaks having the waveform r(n) of the auto-correlation which can be expressed by formula (14)

$$r(n)>r(n-1), \text{ and } r(n)>r(n+1) \tag{14}$$

At the same time, a peak r'(n) produced by normalizing the value of auto-correlation r(n) as indicated by C in FIG. 13 is recorded. The peak r'(n) is the auto-correlation r(n) divided by the auto-correlation data r(0) for n=0. The auto-correlation data r(0), which is the maximum as a peak, is not included in the peaks expressed by the formula (14) since it does not satisfying the formula (14). The peak r'(n) is considered to be a volume expressing the degree of being a pitch, and is rearranged in accordance with its volume so as to produce $r'_S(n)$, P(n). The value $r'_S(n)$ rearranges r'(n) in accordance with its volume, satisfying the following condition:

$$r'_S(0)>r'_S(1)>r'_S(2)>\ldots>r'_S(j-1) \tag{15}$$

Figure 13C:
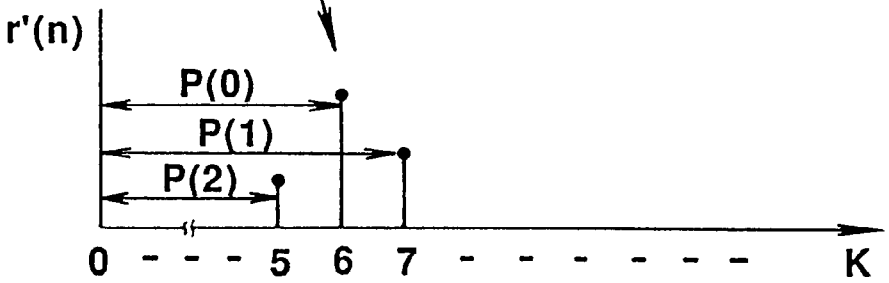

In this formula (15), j represents the total number of peaks. P(n) expresses an index corresponding to a large peak, as shown by C in FIG. 13. In FIG. 13C, the index of the largest peak in a position of n=6 is P(0). The index of the next largest peak (in a position of n=7) is P(1). P(n) satisfies the condition of $$r'(P(n))=r'(n) \tag{16}$$

The largest peak of $r'_S(n)$ produced by rearranging the normalized function r'(n) of the auto-correlation r(n) is $r'_S$(0). Pitch decision in case this largest or maximum peak value $r'_S$(0) exceeds a predetermined value given by, e.g., k=0.4 will be explained.

First, when the maximum peak value $r'_S$(0) exceeds the value k, the pitch decision is carried out as follows.

In the present embodiment, k is set to 0.4. If the maximum peak value $r'_S$(0) exceeds k=0.4, it means that the maximum peak value $r'_S$(0) is quite high as a maximum value of the auto-correlation. P(0) of this maximum peak value $r'_S$(O)is employed as the pitch of the current frame by the pitch decision section 216. Thus, there is a possibility that even when a speaker to be a target of the analysis suddenly raises a voice such as "Oh!" jumping of the pitch only in the current frame can be realized regardless of the pitches in the past and future frames. At the same time, the pitch at this time is judged to be a pitch typical of the speaker and is maintained. This is effective when the past pitch is lacking, such as when the analysis is resumed after the voice of the speaker is eliminated. In this case, P(0) is set as a typical pitch as follows.

$$P_t=P(0) \tag{17}$$

If the maximum peak value $r'_S$(0) is smaller than k=0.4, the following will hold.

If the pitch $P_{-1}$ (hereinafter referred to as past pitch) of the other frame is not calculated by the other-frame pitch calculating unit 214, that is, if the past pitch $P_{-1}$ is 0, k is lowered to 0.25 for comparison with the maximum peak value $r'_S(\mathbf{0})$. If the maximum peak value $r'_S(\mathbf{0})$ is larger than k, P(0) in the position of the maximum peak value $r'_S(\mathbf{0})$ is adopted as the pitch of the current frame by the pitch decision section 216. At this time, the pitch P(0) is not registered as a standard pitch.

On the other hand, if the pitch of the other frame is calculated by the other-frame pitch calculating section 214, the maximum peak value $r'_S(P_{-1})$ is sought in a range in the vicinity of the past pitch $P_{-1}$. In other words, the pitch of the current frame is sought in accordance with the position of the peak within a range satisfying a predetermined relation with the past pitch $P_{-1}$. Specifically, $r'_S(n)$ is searched within a range of $0 \leqq n<j$, of the past pitch $P_{-1}$ which is already found, and the minimum value of n satisfying $$0.8P_{-1}<P(0)<1.2P_{-1} \quad (18)$$

is found as $n_m$. The smaller the value of n is,the larger the peak after rearrangement is. The pitch $P(n_m)$ in the position of the peak $r'_S(n_m)$ which is $n_m$ is registered as a candidate for the pitch of the current frame.

Meanwhile, if the peak $r'_S(n_m)$ is 0.3 or larger, it can be adopted as the pitch. If the peak $r'_S(n_m)$ is smaller than 0.3, the possibility of its being the pitch is low, and therefore, the $r'_S(n)$ is searched within a range of $0 \leqq n<j$, of the typical pitch $P_t$ which is already found, and the minimum value of n satisfying $$0.8P_t<P(n)<1.2P_t \quad (19)$$

is found as $n_r$. The smaller the value of n is, the larger the peak after rearrangement is. The pitch $P(n_r)$ in the position of the peak $r'_s(n_r)$ which is $n_r$ is adopted as the pitch of the current frame. Thus, the pitch $P_0$ of the current frame is determined on the basis of the pitch $P_{-1}$ of the other frame.

Next, a method of precisely finding the pitch of the current frame from the pitch $P_0$ of the current frame, the pitch $P_{-1}$ of one past frame and the pitch $P_1$ of one future frame is explained, utilizing the above-mentioned idea of delayed decision.

The degree of the pitch of the current frame is represented by the value of r' corresponding to the pitch $P_0$, that is, $r'(P_0)$, and is set to R. The degrees of the pitches of the past and future frames are set to $R^-$ and $R^+$, respectively. Accordingly, the degrees R, $R^-$ and $R^+$ are $R=r'(P_0)$, $R^-=r'(P_{-1})$ and $R^+=r'(P_1)$, respectively.

If the degree R of the pitch of the current frame is larger than both the degree $R^-$of the pitch of the past frame and the degree $R^+$ of the pitch of the future frame, the degree R of the pitch of the current frame is considered to is the highest in reliability of the pitch. Therefore, the pitch $P_0$ of the current frame is adopted.

If the degree R of the pitch of the current frame is smaller than both the degree $R^-$ of the pitch of the past frame and the degree $R^+$ of the pitch of the future frame, with the degree $R^-$ of the pitch of the past frame being larger than the degree $R^+$ of the pitch of the future frame, $r'_S(n)$ is searched within a range of $0 \leqq n<j$, using the pitch $P_{-1}$ of the future frame as the standard pitch $P_r$, and the minimum value of n satisfying $$0.8P_r<P(n)<1.2\ P_r \quad (20)$$

is found as $n_a$. The smaller the value of n is, the larger the peak after rearrangement is. Then, the pitch $P(n_a)$ in the position of the peak $r'_a(n_a)$ which is $n_a$ is adopted as the pitch of the current frame.

Then, pitch extraction operation in the second example of the pitch extraction method is explained with reference to a flowchart of FIG. 14.

Figure 14:
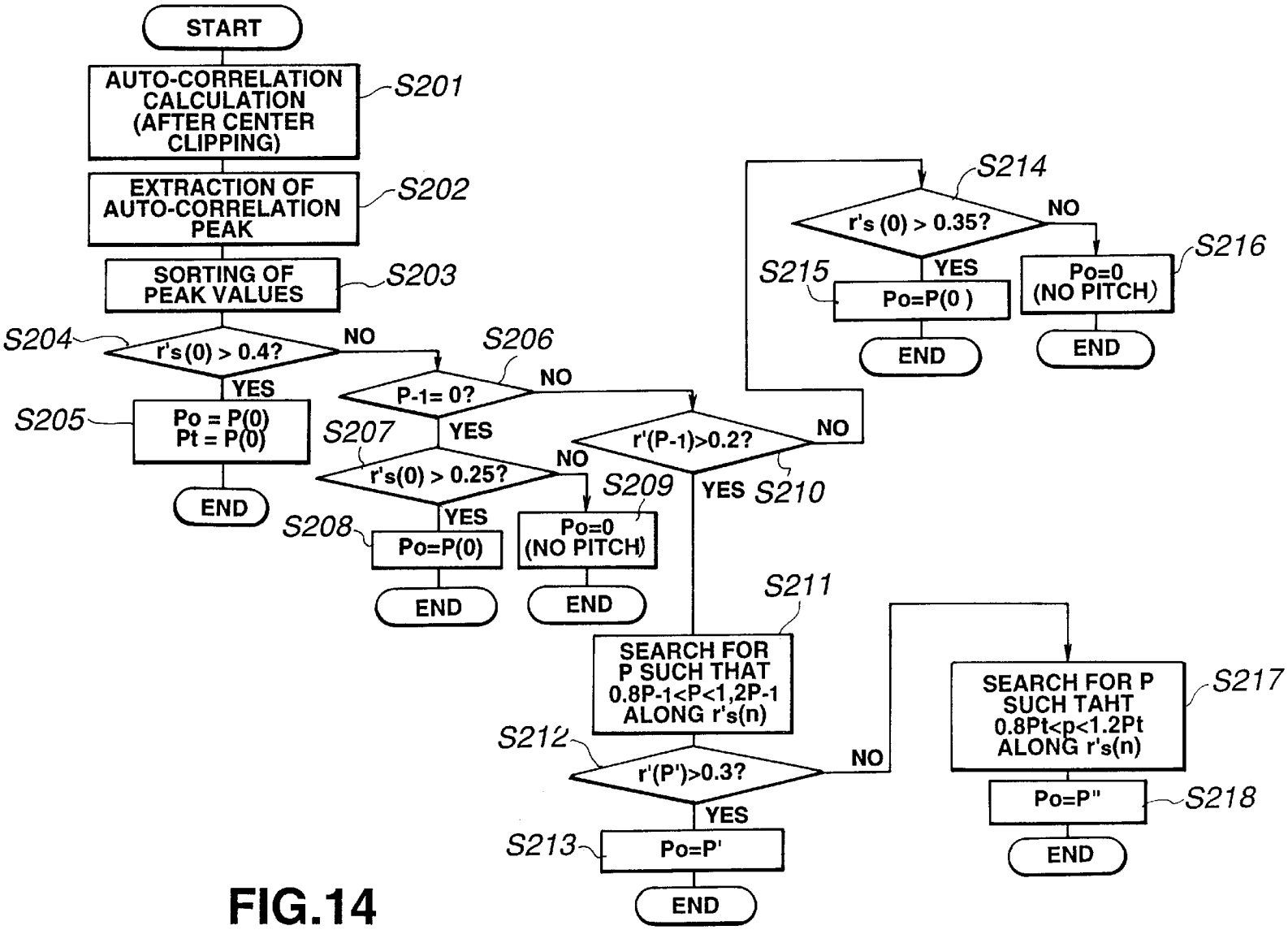
FIG. 14 is a flowchart for explaining movement of pitch extraction in the second example of the pitch extraction method.

Referring to FIG. 14, an auto-correlation function of an input voice signal waveform is found first at step S201. Specifically, the input voice signal waveform for one frame from the frame demarcation section 210 is center-clipped by the center-clip processing section 211, and then the auto-correlation function of the waveform is calculated by the auto-correlation calculating section 212.

At step S202, plural or all peaks (maximum values) meeting the conditions of the formula (14) are detected by the peak detection section 213 from the auto-correlation function of step S201.

At step S203, the plural or all the peaks detected at step S202 are rearranged in the sequence of their size.

At step S204, whether the maximum peak $r'_S(0)$ among the peaks rearranged at step S203 is larger than 0.4 or not is decided. If YES is selected, that is, if it is decided that the maximum peak $r'_S(0)$ is larger than 0.4, the operation proceeds to step S205. On the other hand, if NO is selected, that is, if the maximum peak $r'_S(0)$ is smaller than 0.4, the operation proceeds to step S206.

At step S205, it is decided that P(0) is the pitch $P_0$ of the current frame, as a result of decision on YES at step S204. P(0) is set as the typical pitch $P_t$.

At step S206, whether the pitch $P_{-1}$ is absent or not in a preceding frame is determined. If YES is selected, that is, if the pitch $P_{-1}$ is absent, the operation proceeds to step S207. On the other hand, if NO is selected, that is, if the pitch $P_{-1}$ is present, the operation proceeds to step S208.

At step S207, whether the maximum peak value $r'_S(0)$ is larger than k=0.25 or not is determined. If YES is selected, that is, if the maximum peak value $r'_S(0)$ is larger than k, the operation proceeds to step S208. On the other hand, if NO is selected, that is, if the maximum peak value $r'_S(0)$ is smaller than k, the operation proceeds to step S209.

At step S208, if YES is selected at step S207, that is, if the maximum peak value $r'_S(0)$ is larger than k=0.25, it is decided that P(0) is the pitch $P_0$ of the current frame.

At step S209, if NO is selected at step S207, that is, if the maximum peak value $r'_S(0)$ is smaller than k=0.25, it is decided that there is no pitch in the current frame, that is, $P_0=P(0)$.

At step 201, in accordance with the pitch $P_{-1}$ of the past frame not being 0 at step S206, that is, the presence of the pitch, whether the peak value at the pitch $P_{-1}$ of the past frame is larger than 0.2 or not is decided. If YES is selected, that is, if the past pitch $P_{-1}$ is larger than 0.2, the operation proceeds to step S211. If NO is selected, that is, if the past pitch $P_{-1}$ is smaller than 0.2, the operation proceeds to step S214.

At step S211, in accordance with the decision on YES at step 210, the maximum peak value $r'_S(P_{-1})$ is sought within a range from 80% to 120% of the pitch $P_{-1}$ of the past frame. In short, $r'_S(n)$ is searched within a range of $0 \leqq n<j$, of the past pitch $P_{-1}$ which is already found.

At step S212, whether the candidate for the pitch of the current frame sought at step S211 is larger than a predetermined value 0.3 or not is decided. If YES is selected, the operation proceeds to step S213. If NO is selected, the operation proceeds to step S217.

At step S213, in accordance with the decision on YES at step S212, it is decided that the candidate for the pitch of the current frame is the pitch $P_0$ of the current frame.

At step S214, in accordance with the decision at step S210 that the peak value $r'(P_{-1})$ at the past pitch $P_{-1}$ is smaller than 0.2, whether the maximum peak value $r'_S(0)$ is larger than 0.35 or not is decided. If YES is selected, that is, if the maximum peak value $r'_S(0)$ is larger than 0.35, the operation proceeds to step S215. If NO is selected, that is, if the maximum peak value $r'_S(0)$ is not larger than 0.35, the operation proceeds to step S216.

At step S215, if YES is selected at step S214, that is, the maximum peak value $r'_S(0)$ is larger than 0.35, it is decided that P(0) is the pitch $P_0$ of the current frame.

At step S216, if NO is selected at step S214, that is, the maximum peak value $r'_S(0)$ is not larger than 0.35, it is decided that there is no pitch present in the current frame.

At step S217, in accordance with the decision on NO at step S214, the maximum peak value $r'_S(P_t)$ is sought within a range from 80% to 120% of the typical pitch $P_t$. In short, $r'_S(n)$ is searched within a range of $0 \leqq n < j$, of the typical pitch $P_t$ which is already found.

At step S218, it is decided that the pitch found at step S217 is the pitch $P_0$ of the current frame.

In this manner, according to the second example of the pitch extraction method, the pitch of the current frame is decided on the basis of pitch calculated in the past frame. Then, it is possible to precisely set the pitch of the current frame decided from the past on the basis of the pitch of the past frame, the pitch of the current frame and the pitch of the future frame.

Figure 15:
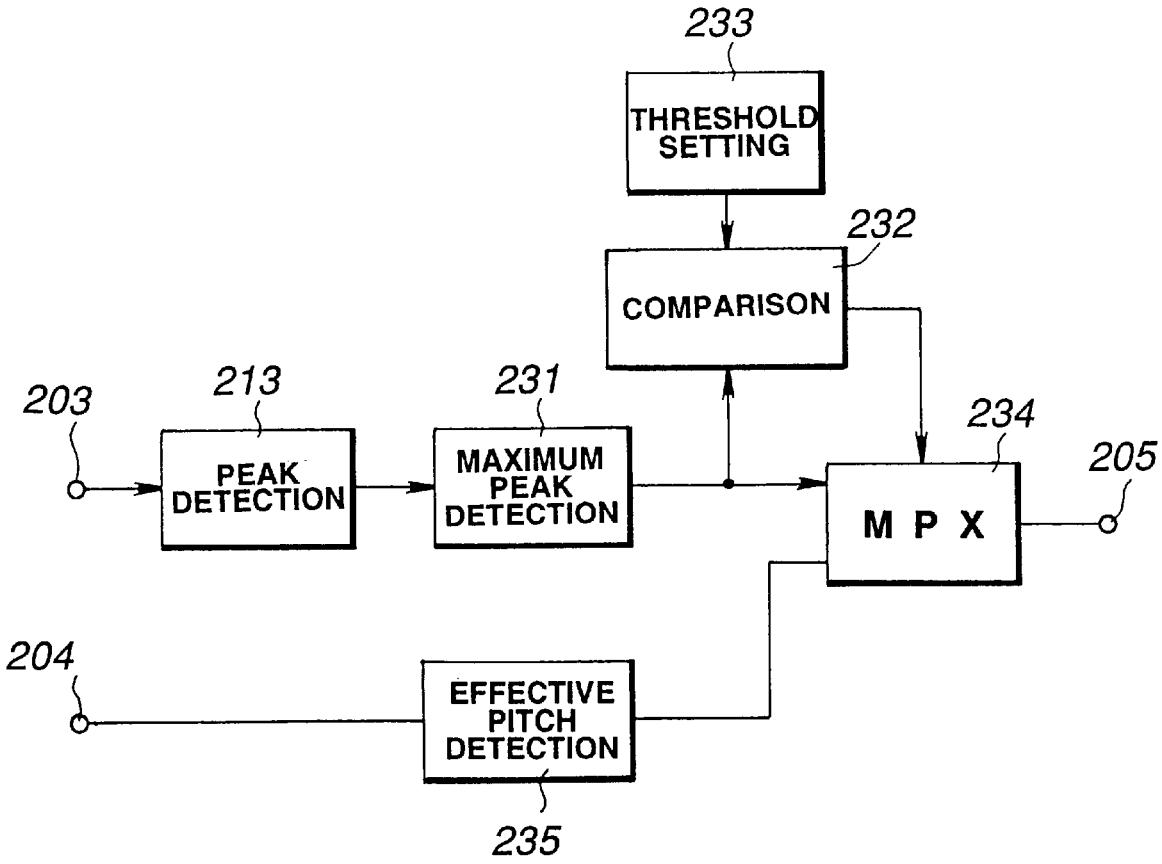
FIG. 15 is a functional block diagram showing a schematic arrangement of a concrete example to which a third example of the pitch extraction method is applied.

Next, a pitch extraction device to which the third example of the pitch extraction method is applied is explained with reference to FIG. 15. FIG. 15 is a functional block diagram for explaining the function of the third example, wherein illustrations of portions similar to those in the functional block diagram of the second example (FIG. 12) are omitted.

The pitch extraction device to which the third example of the pitch extraction method is applied comprises: a maximum peak detection section 231 for detecting plural or all peaks of the auto-correlation data supplied from an input terminal 203 by a peak detection section 213 and for detecting the maximum peak from the plural or all the peaks; a comparator 232 for comparing the maximum peak value from the maximum peak detection section 231 and a threshold of a threshold setting section 233; an effective pitch detection section 235 for calculating an effective pitch from pitches of other frames supplied via an input terminal 204; and a multiplexer (MPX) 234 to which the maximum peak from the maximum peak detection section 231 and the effective pitch from the effective pitch detection unit 235 are supplied, and in which selection between the maximum peak and the effective pitch is controlled in accordance with results of comparison by the comparator 232, for outputting "1" an output terminal 205.

The maximum peak detection section 231 detects the maximum peak among the plural or all the peaks detected by the peak detection section 213.

The comparator 232 compares the predetermined threshold of the threshold setting section 233 and the maximum peak of the maximum peak detection section 231 in terms of size.

The effective pitch detection section 235 detects the effective pitch which is present within a pitch range satisfying a predetermined relation with the pitch found in a frame other than the current frame.

The MPX 234 selects and outputs the pitch in the position of the maximum peak or the effective pitch from the effective pitch detection section 235 on the basis of the results of comparison of the threshold and the maximum peak by the comparator 232.

A flow of concrete processing, which is similar to the one shown in the flowchart of FIG. 14 of the second example of the pitch extraction method, is omitted.

Thus, in the third example of the pitch extraction method of the present invention, the maximum peak is detected from plural or all the peaks of the auto-correlation, and the maximum peak and the predetermined threshold are compared, thereby deciding the pitch of the current frame on the basis of the result of comparison. According to this third example of the pitch extraction method of the present invention, the pitch of the current frame is decided on the basis of pitches calculated in the other frames, and the pitch of the current frame decided from the pitches of the other frames can be precisely set on the basis of the pitches of the other frames and the pitch of the current frames.

Application of the second and third examples of the pitch extraction method to the MBE vocoder explained with reference to FIGS. 1 to 7 is as follows. Plural peaks are found from auto-correlation data of the current frame (the auto-correlation being found for 1-block N-sample data). When the maximum peak among the plural peaks is equal to or larger than a predetermined threshold, the position of the maximum peak is set to be a pitch period. Otherwise, a peak within a pitch range satisfying a predetermined relation with a pitch found in a frame other than the current frame, e.g. preceding and succeeding frames, is found. For instance, a peak present within a ±20% range from a pitch of a preceding frame is found. On the basis of the position of this peak, the pitch of the current frame is decided. Therefore, it is possible to catch a precise pitch.

According to the second example of the pitch extraction method, it is possible to decide the pitch of the current frame on the basis of the position of the peak which is among the plural peaks detected from the auto-correlation data of the current frame of the input voice signal demarcated on the frame-by-frame basis and which is present within the pitch range satisfying the predetermined relation with the pitch found in a frame other than the current frame. Also, it is possible to decide the pitch of the current frame on the basis of the position of the peak which is among all the peaks detected from the auto-correlation data of the current frame of the input voice signal demarcated on the frame-by-frame basis and which is present within the pitch range satisfying the predetermined relation with the pitch found in a frame other than the current frame. Further, as in the third example, it is possible to decide the pitch of the current frame in accordance with the position of the maximum peak if the maximum peak among the plural peaks detected from the auto-correlation data of the current frame of the input voice signal demarcated on the frame-by-frame basis is equal to or larger than the predetermined threshold. Also, it is possible to decide the pitch of the current frame on the basis of the position of the peak present within the pitch range satisfying the predetermined relation with the pitch found in a frame other than the current frame if the maximum peak is smaller than the predetermined threshold. Accordingly, the probability of catching a wrong pitch is lowered. In addition, even after the deletion of the pitch, it is possible to carry out stable tracking with reference to the secure pitch found in the past. Thus, if plural speakers speak simultaneously, the pitch extraction method can be applied to speaker separation for extracting voice sounds only of one speaker.

Meanwhile, in the MBE encoder, the spectral envelope of voice signals in one block or one frame is divided into bands in accordance with the pitch extracted on the block-by-block basis, thereby carrying out voiced/unvoiced decision for every band. Also, in consideration of periodicity of the spectrum, the spectral envelope obtained by finding the amplitude at each of the harmonics is quantized. Therefore, when the pitch is uncertain, the voiced/unvoiced decision and spectral matching become uncertain, leaving a fear of deterioration of sound quality of effectively synthesized voices.

Figure 16:
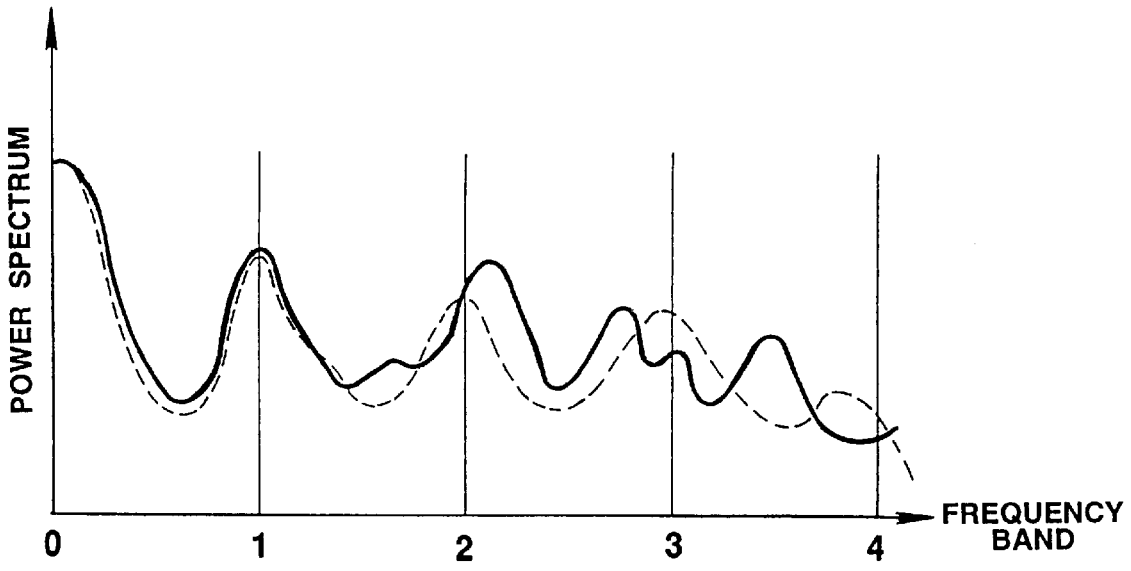
FIG. 16 is a waveform diagram for explaining conventional voice encoding.

In short, when the pitch is unclear, if it is attempted to carry out impossible spectral matching in a first band as indicated by a broken line in FIG. 16, it is impossible to obtain precise spectral amplitude in the following bands. Even if spectral matching can be accidentally carried out in the first band, the first band is processed as a voiced band, thus causing abnormal sounds. In FIG. 16, the horizontal axis indicates frequency and band, and the vertical axis indicates spectral amplitude. The waveform shown by a solid line indicates the spectral envelope of the input voice waveform.

Thus, a voice sound encoding method whereby spectral analysis can be performed by setting a narrow bandwidth of the spectral envelope when the pitch detected from the input voice signal is uncertain is explained hereinafter.

With this voice sound encoding method, the spectral envelope of the input voice signal is found, and is divided into plural bands. With the voice sound encoding method for carrying out quantization in accordance with power of each band, the pitch of the input voice signal is detected. When the pitch is securely detected, the spectral envelope is divided into bands with a bandwidth according to the pitch, and when the pitch is not detected securely, the spectral envelope is divided into bands with the predetermined narrower bandwidth.

When the pitch is detected securely, voiced/unvoiced (V/UV) decision is carried out for each of the bands produced by the division according to the pitch. When the pitch is not detected securely, it is decided that all the bands with the predetermined narrower bandwidth are unvoiced.

According to this voice sound encoding method, when the pitch detected from the input voice signal is secure, the spectral envelope is divided into bands with the bandwidth in accordance with the detected pitch, and when the pitch is not secure, the bandwidth of the spectral envelope is set narrowly, thus carrying out case-by-case encoding.

A concrete example of the voice encoding method is explained hereinafter.

For such a voice encoding method, an encoding method for converting signals on the block-by-block basis into signals on the frequency axis, dividing the signals into plural bands, and performing V/UV decision for each of the bands is can be employed.

Generalization of this encoding method is as follows. A voice signal is divided into block each having a predetermined number of samples, e.g. 256 samples, and is converted by orthogonal transform such as FFT into spectral data on the frequency axis, while the pitch of the voice in the block is detected. When the pitch is certain, the spectrum on the frequency axis is divided into bands with an interval corresponding to the pitch. When the detected pitch is uncertain, or when no pitch is detected, the spectrum on the frequency axis is divided into bands with narrower bandwidth, and it is decided that all the bands are unvoiced.

The flow of encoding of this voice encoding method is explained with reference to a flowchart of FIG. 17.

Figure 17:
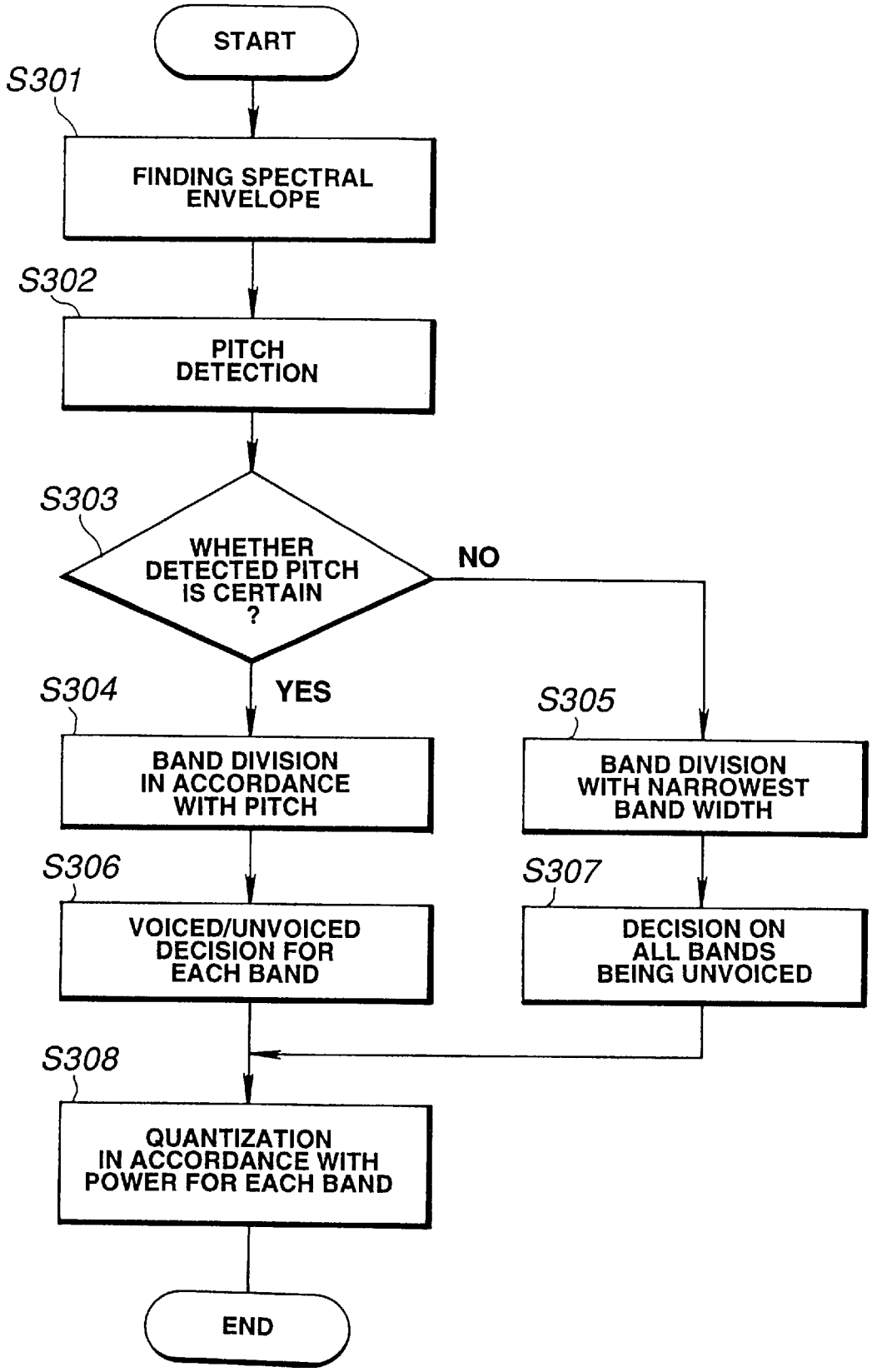
FIG. 17 is a flowchart for explaining movement of encoding of an example of a voice encoding method employed in the high efficiency encoding method of the present invention.

Referring to FIG. 17, the spectral envelope of the input voice signal is found at step S301. For instance, the found spectral envelope is a waveform (so-called original spectrum) indicated by a solid line in FIG. 18.

At step S302, a pitch is detected from the spectral envelope of the input voice signal found at step S301. In this pitch detection, auto-correlation method of center-clip waveform, for example, is employed for secure detection of the pitch. The auto-correlation method of center-clip waveform is a method for auto-correlation processing of a center-clip waveform exceeding the clipping level, and for finding the pitch.

At step S303, whether the pitch detected at step S302 is certain or not is decided. At step S302, there may be uncertainty such as an unexpected failure to take the pitch and detection of a pitch which is wrong by integer times or a fraction. Such uncertainly detected pitches are discriminated at step S303. If the YES is selected, that is, if the detected pitch is certain, the operation proceeds to step S304. If NO is selected, that is, if the detected pitch is uncertain, the operation proceeds to step S305.

At step S304, in accordance with the decision at step S303 that the pitch detected at step S302 is certain, the spectral envelope is divided into bands with a bandwidth corresponding to the certain pitch. In other words, the spectral envelope on the frequency axis is divided into bands at an interval corresponding to the pitch.

At step S305, in accordance with the decision at step S303 that the pitch detected at step S302 is uncertain, the spectral envelope is divided into bands with the narrowest bandwidth.

At step S306, V/UV decision is made for each of the bands produced by the division at the interval corresponding to the pitch at step S304.

Figure 18:
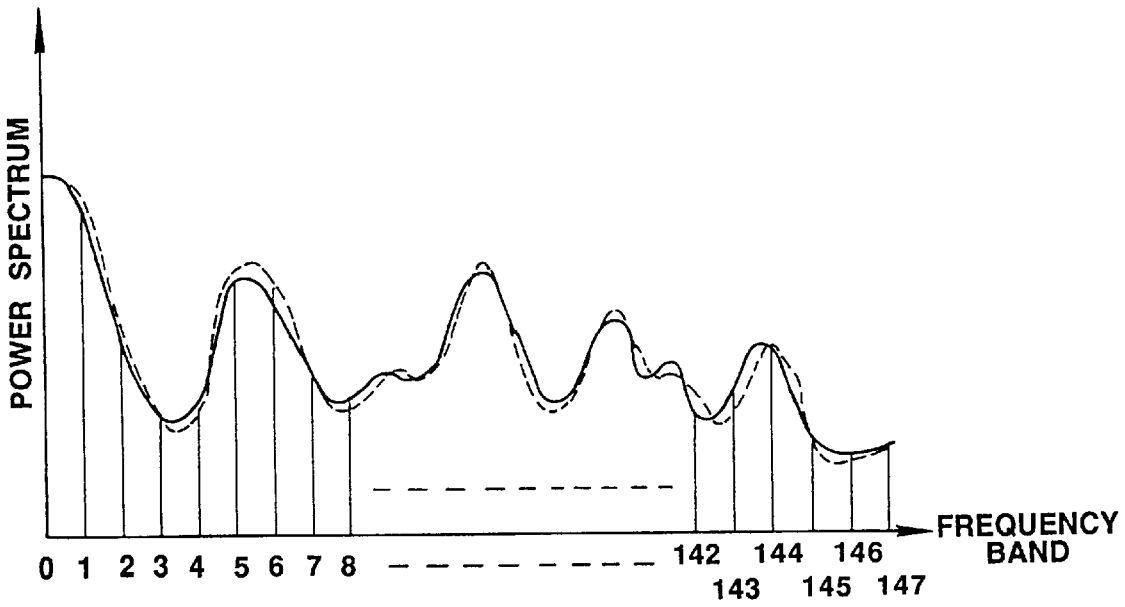
FIG. 18 is waveform diagram for explaining encoding of an example of the voice encoding method.

At step S307, it is decided that all the bands produced by the division with the narrowest bandwidth at step S305 are unvoiced. In the present embodiment, the spectral envelope is divided into 148 bands from 0 to 147 as shown in FIG. 18, and these bands are mandatorily made unvoiced. With thus divided minute 148 bands, it is possible to securely trace the original spectral envelope indicated by a solid line.

At step S308, the spectral envelope is quantized in accordance with the power of each band set at steps S304 and S305. Particularly, when the division carried out with the narrowest bandwidth set at step 305, precision of quantization can be improved. Further, if a white noise is used as an excitation source for all the bands, a synthesized noise becomes a noise colored by a spectrum of the matching indicated by a broken line in FIG. 18, thereby generating no grating noise.

In this manner, in the example of the voice encoding method, the bandwidth of the decision bands of the spectral envelope is changed, depending on whether the pitch detected in the pitch detection of the input voice signal. For instance, if the pitch is certain, the bandwidth is set in accordance with the pitch, and then V/UV decision is carried out. If the pitch is uncertain, the narrowest bandwidth is set (for example, division into 148 bands), making all the bands unvoiced.

Accordingly, if the pitch is unclear and uncertain, spectral analysis of a particular case is carried out, thereby causing no deterioration of the sound quality of the synthesized voice.

With the voice encoding method as described above, the spectral envelope is divided with a bandwidth corresponding to the detected pitch when the pitch detected from the input voice signal is certain, and the bandwidth of the spectral envelope is narrowed when the pitch is uncertain. Thus, case-by-case encoding can be carried out. Particularly, when the pitch does not appear clearly, all the bands are processed as unvoiced bands of the particular case. Therefore, precision of the spectral analysis can be improved, and noises are not generated, thereby avoiding deterioration of the sound quality.

Application of the above-described voice encoding method to the MBE vocoder explained with reference to FIGS. 1 to 7 is as follows. Pitch detection of high precision is needed for the MBE vocoder. However, as the voice encoding method is applied to the MBE vocoder, when the pitch does not appear clearly, the division of the spectral envelope is set to be the narrowest, so as to make all the bands unvoiced. Thus, it is possible to exactly trace the original spectral envelope, and to improved precision of spectral quantization.

Meanwhile, with the voice analysis-synthesis system such as the PARCOR method, since the timing of changing over the excitation source is on the block-by-block (frame-by-frame) basis on the time frequency, voiced and unvoiced sounds cannot be present together in one frame. As a result, voices of high quality cannot be produced.

However, with the MBE encoding, voices in one block (frame) is divided into plural bands, and voiced/unvoiced decision is made for each of the bands, thereby observing improvement in the sound quality. However, since voiced/unvoiced decision data obtained for each band must be transmitted separately, the MBE encoding is disadvantageous in terms of bit rate.

In view of the above-described status of the art, according to the present invention, a high efficiency encoding method whereby voiced/unvoiced decision data obtained for each band can be transmitted with a small number of bits without deteriorating the sound quality is proposed.

The high efficiency encoding method of the present invention comprises the steps of: finding data on the frequency axis by demarcating an input voice signal on the block-by-block basis and converting the signal into a signal on the frequency axis; dividing the data in the frequency axis into plural bands; deciding whether each of the divided bands is voiced or unvoiced; detecting a band of the highest frequency of voiced bands; and finding data in a boundary point for demarcating a voiced region and an unvoiced region on the frequency axis in accordance with the number of bands from a band on the lower frequency side up to the detected band.

When the ration of the number of voiced bands from the lower frequency side up to the detected band to the number of unvoiced bands is equal to or larger than a predetermined threshold, the position of the detected band is considered to be the boundary point between the voiced region and the unvoiced region. It is also possible to reduce the number of bands to a predetermined number in advance and thus to transmit one boundary point with a small fixed number of bits.

According to the high efficiency encoding method as described above, since the voiced region and the unvoiced region are demarcated in one position of plural bands, the boundary point data can be transmitted with a small number of bits. Also, since the voiced region and the unvoiced region are decided for each band in the block (frame), improvement of the synthetic sound quality can be achieved.

An example of such a high efficiency encoding method is explained hereinafter.

For the high efficiency encoding method, an encoding method, such as the aforementioned MBE (multiband excitation) encoding method, wherein a signal on the block-by-block basis is converted into a signal on the frequency axis, then divided into plural bands, thereby making voiced/unvoiced decision for each band, may be employed.

That is, in a general high efficiency encoding method, the voice signal is divided into blocks at an interval of a predetermined number of samples, e.g. 256 samples, and the voice signal is converted by orthogonal transform such as FFT into spectral data on the frequency axis. At the same time, the pitch of the voice in the block is extracted, and the spectrum on the frequency axis is divided into bands at an interval according to the pitch, thus making voiced/unvoiced (V/UV) decision for each of the divided bands. The V/UV decision data is encoded and transmitted along with amplitude data.

If, for example, the voice synthesis-analysis system such as the MBE vocoder is presumed, the sampling frequency $f_S$ for the input voice signal on the time axis is normally 8 kHz, and the entire bandwidth is 3.4 kHz with the effective band being 200 to 3400 Hz. The pitch lag from a higher female voice down to a lower male voice, or the number of samples corresponding to the pitch period, is approximately 20 to 147. Accordingly, the pitch frequency changes in a range from 8000/147≈54 Hz to 8000/20 =400 Hz. Accordingly, about 8 to 63 pitch pulses or harmonics stand in the range up to 3.4 kHz on the frequency axis.

In this manner, in consideration of the change in the number of bands between about 8 to 63 for each band due to the band division at the interval corresponding to the pitch, it is preferable to reduce the number of divided bands to a predetermined number, e.g. 12.

In the present example, the boundary point for demarcating the voiced region and the unvoiced region in one position of all the bands is found on the basis of V/UV decision data for plural bands reduced or produced by division corresponding to the pitch, and then the data or V/UV code for indicating the boundary point is transmitted.

Detection operation of the boundary point between the V region and the UV region is explained with reference to a flowchart of FIG. 19 and a spectral waveform and a V/UV changeover waveform shown in FIG. 20. In the following description, the number of divided bands reduced to, for example, 12 is presumed. However, the similar detection of boundary point can also be applied to a case of the variable number of bands divided in accordance with the original pitch.

Figure 19:
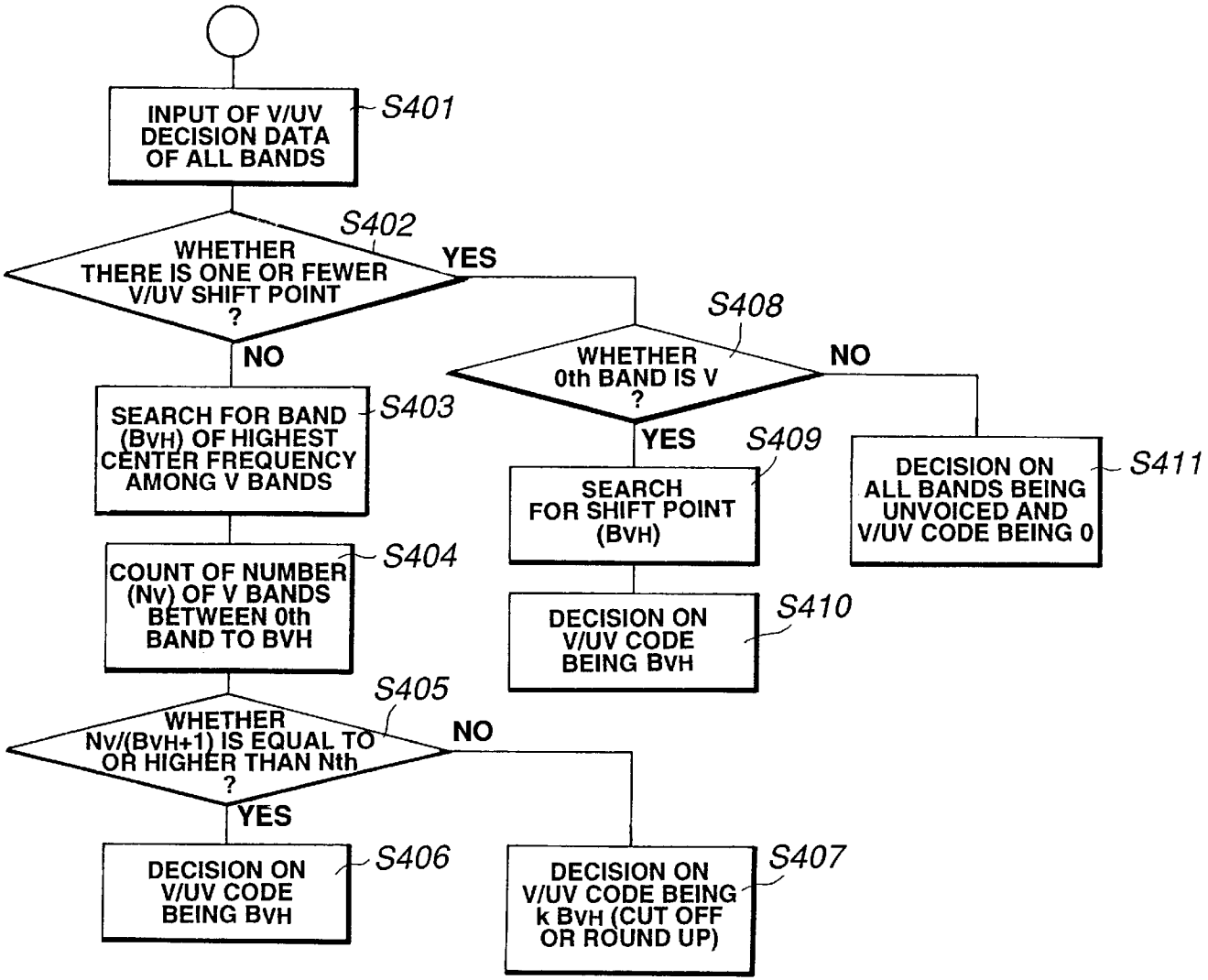
FIG. 19 is a flowchart for explaining essential portions of one embodiment of the high efficiency encoding method of the present invention.
Figure 20A:
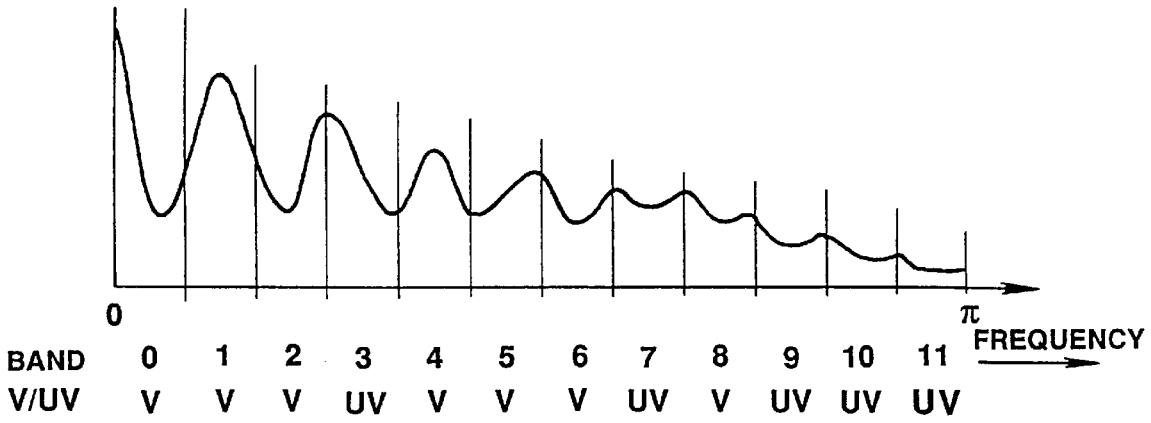
FIG. 20 is a diagram for explaining a decision of a boundary point of voiced (V)/unvoiced (UV) sound demarcation of a band.

Referring to FIG. 19, at the first step S401, V/UV data of all the bands are inputted. For instance, when the number of bands is reduced to 12 from the 0th band to the 11th band as shown in FIG. 20A, each V/UV data for all the 12 bands are taken.

At the next step S402, whether there is not more than one V/UV changeover point or not is decided. If NO is selected, that is, if there are two or more changeover points, the operation proceeds to step S403. At step S403, the V/UV data is scanned from the band on the high frequency side, and thus the band number $B_{VH}$ of the highest center frequency is detected in the V bands. In the example of FIG. 20A, the V/UV data is scanned from the 11th band on the high frequency side toward the 0th band on the low frequency side, and number 8 of the first V band is set to be $B_{VH}$.

At the next step S404, the number of V bands $N_V$ is found by scanning from the 0th band to the $B_{VH}$'th band. In the example of FIG. 20A, since seven bands of the 0th, 1st, 2nd, 4th, 5th, 6th and 8th bands between the 0th band and the 8th band are V bands, the number of V bands is $N_V$=7.

At the next step S405, the ratio $N_V/(B_{VH}+1)$ of the number of V bands $N_V$ to the number of bands from the 0th band to the $B_{VH}$'th band $B_{VH}+1$ is found, and whether this ratio is equal to or larger than a predetermined threshold $N_{th}$ or not is decided. In the example of FIG. 20A, the ratio is $N_V/(B_{VH}+1)=7/9\approx0.78$. If the threshold is set to, e.g. 0.7, the decision on YES is made. If YES is selected at step S405, the operation proceeds to step S406, where the V/UV code for indicating the boundary point between the V region and the UV region is set to be $B_{VH}$. If NO is selected at step S405, the operation proceeds to step S407, where it is decided that an integer value of the value $k \cdot B_{VH}$ produced by multiplying $B_{VH}$ by a constant k (k<1) for the purpose of lowering the V degree up to the $B_{VH}$ band, e.g. a value with decimal fractions dropped or a rounded-up value, is the V/UV code. It is decided that the bands from the 0th band to the band of the integer value of $k \cdot B_{VH}$ are V bands, and that bands on the higher frequency side are UV bands.

On the other hand, if YES is selected at step S402, that is, if it is decided that there is one V/UV changeover point or none, the operation proceeds to step S408, at which whether the 0th band is the V band or not is decided. If YES is selected, that is, if it is decided that the 0th band is the V band, the operation proceeds to step S409, where band number $B_{VH}$ for the first V band from the high frequency side is sought similarly to step S403, and is set as the V/UV code. If NO is selected at step S408, that is, if it is decided that the 0th band is the unvoiced band, the operation proceeds to step S411, where all bands are set to be the UV bands, thus setting the V/UV code to be 0.

That is, if there is one or zero V/UV changeover point with the low frequency side being V, no modification is added. If the low frequency side is UV, all the bands are set to be UV.

In this manner, the V/UV changeover is limited to none or once, and the position in all the bands for the V/UV shift (changeover and region demarcation) is transmitted. The V/UV codes for an example in which the number of bands is reduced to 12 as shown in FIG. 20A are as follows:

| V/UV code | content (from the 0th band to the 11th band) | | |
|---|---|---|---|
| 0 | 0000 | 0000 | 0000 |
| 1 | 1000 | 0000 | 0000 |
| 2 | 1100 | 0000 | 0000 |
| 3 | 1110 | 0000 | 0000 |
| . | | . | |
| . | | . | |
| . | | . | |
| 11 | 1111 | 1111 | 1110 |
| 12 | 1111 | 1111 | 1111 |

where 0 indicates UV, and 1 indicates V. There are 13 types of V/UV codes, which can be transmitted with 4 bits. For all the V/UV decision flags for each of the 12 bands, 12 bits are needed. However, with the above-mentioned V/UV codes, transmitted data volume for V/UV decision can be reduced to $4/12 = 1/3$.

Figure 20B:
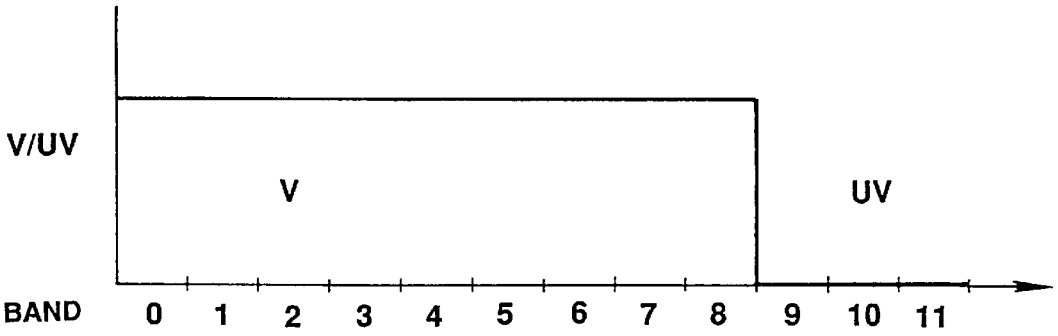

In the example of FIG. 20B, the case of V/UV code 8 is shown, wherein the 0th band to the 8th band are set to be V regions, while the 9th band to the 11th band are set to be UV regions. Meanwhile, with the threshold $N_{th}$ set to e.g. 0.8, when the value of $N_V/(B_{VH}+1)$ is $7/9 \approx 0.78$ as shown in FIG. 20A, the decision on NO is made at step S405. Therefore, the integer value of to be the V/UV code at step S407, thus carrying out demarcation on a lower frequency side than the 8th band.

With the above-mentioned algorithm, the content ratio of V bands determinant of the sound quality among V/UV data of all the original bands, e.g. 12 bands, or in other words, the change of the V band of the highest center frequency, is traced with high precision. Therefore, the algorithm is characterized for causing little deterioration of the sound quality. Further, by setting the number of bands to be small as described above and making V/UV decision for each band, it becomes possible to reduce the bit rate while obtaining voices of higher quality than in the PARCOR method, causing little deterioration of the sound quality compared with the case of the regular MBE. Particularly, if the division number is set to 2 and if a voice sound model wherein the low frequency side is voiced and wherein the high frequency side is unvoiced is presumed, it is possible to achieve both a significant reduction of the bit rate and maintenance of the sound quality.

As is clear from the above description, the input voice signal is demarcated on the block-by-block basis and is converted into the data on the frequency axis, so as to be divided into plural bands. The band of the highest frequency among the voiced bands within each of the divided bands is detected, and the data of the boundary point for demarcating the voiced region and the unvoiced region on the frequency axis in accordance with the number of bands from the band on the low frequency side to the detected band is found. Therefore, it is possible to transmit the boundary point data with a small number of bits, while achieving improvement in the sound quality.

Meanwhile, it is preferable to set, to a predetermined number, amplitude data for expressing the spectral envelope on the frequency axis, in parallel with the reduction of the number of bands. The conversion of the number of samples of the amplitude data is explained with reference to FIG. 21.

If the bit rate is reduced, for example, to 3 to 4 kbps so as to further improve the quantization efficiency, the quantization noise alone is increased in scalar quantization, causing difficulty in practicality. Thus, vector quantization for collecting plural data into a group or vector to be expressed by one code so as to quantize the data, without separately quantizing time-axis data, frequency-axis data and filter coefficient data obtained in encoding, is noted.

However, since the number of spectral amplitude data of MBE, SBE and LPC changes in accordance with the pitch, vector quantization of variable dimension is required, thereby causing complication of arrangement and difficulty in obtaining good characteristics.

Also, in taking inter-block (inter-frame) difference of data before quantization, it is impossible to take the difference without having the numbers of data in the preceding and succeeding blocks (frames) coincident with each other. Thus, though it may be necessary to convert the variable number of data into a predetermined number of data in data processing, conversion of the number of data of good characteristics is preferable. In view of the above-described status of the art, a conversion method for the number of data whereby it becomes possible to convert a variable number of data into a predetermined number of data, and to carry out conversion of the number of data of good characteristics not generating ringing at the terminal point is proposed.

The conversion method for the number of data comprises the steps of: non-linearly compressing data in which the number of waveform data in a block or parameter data expressing the waveform is variable; and using a converter for the number of data which converts a variable number of non-linear compression data into a predetermined number of data for comparing the variable number of non-linear compression data on the block-by-block basis with the predetermined number of reference data on the block-by-block basis in a non-linear region.

It is preferable to append dummy data for interpolating the value from the last data in a block to the first block in the block to the variable number of non-linear compression data for each block, so as to expand the number of data, and then to carry out oversampling of band limiting type. The dummy data for interpolating the value from the last data in the block to first data in the block is data which does not bring about any sudden change of the value at the terminal point of the block, or which avoids intermittent and discontinuous values. A type of change in the value wherein the last data value in the block at a predetermined interval is held and then changed into the first data value in the block, and wherein the first data value in the block is held at a predetermined interval is note. In the oversampling of band limiting type, orthogonal transform such as fast Fourier transform (FFT) and 0 data insertion at an interval corresponding to the multiple of oversampling (or low-pass filter processing) may be carried out, and then inverse orthogonal transform such as IFFT may be carried out.

For the non-linearly compressed data, audio signals such as voice signals and acoustic signals converted into the data on the frequency axis can be used. Specifically, spectral envelope amplitude data in the case of multiband excitation (MBE) encoding, spectral amplitude data and its parameter data (LSP parameter, a parameter and k parameter) in single-band excitation (SBE) encoding, harmonic encoding, sub-band coding (SBC), linear predictive coding (LPC), discrete cosine transform (DCT), modified DCT (MDCT) or fast Fourier transform (FFT), can be used. The data converted into the predetermined number of data may be vector-quantized. Before the vector quantization, inter-block difference of the predetermined number of data for each block may be taken, and the inter-block difference data may be processed with vector quantization.

It become possible to compare the converted predetermined number of non-linear compression data with the reference data in the non-linear region, and to vector-quantized the inter-block difference. In addition, it is possible to increase continuity of data values in the block before conversion of the number of data, thereby carrying out conversion of the number of data of high quality which does not generate linking at the block terminal point.

An example of the above-described conversion method for the number of data is explained with reference to the drawings.

Figure 21:
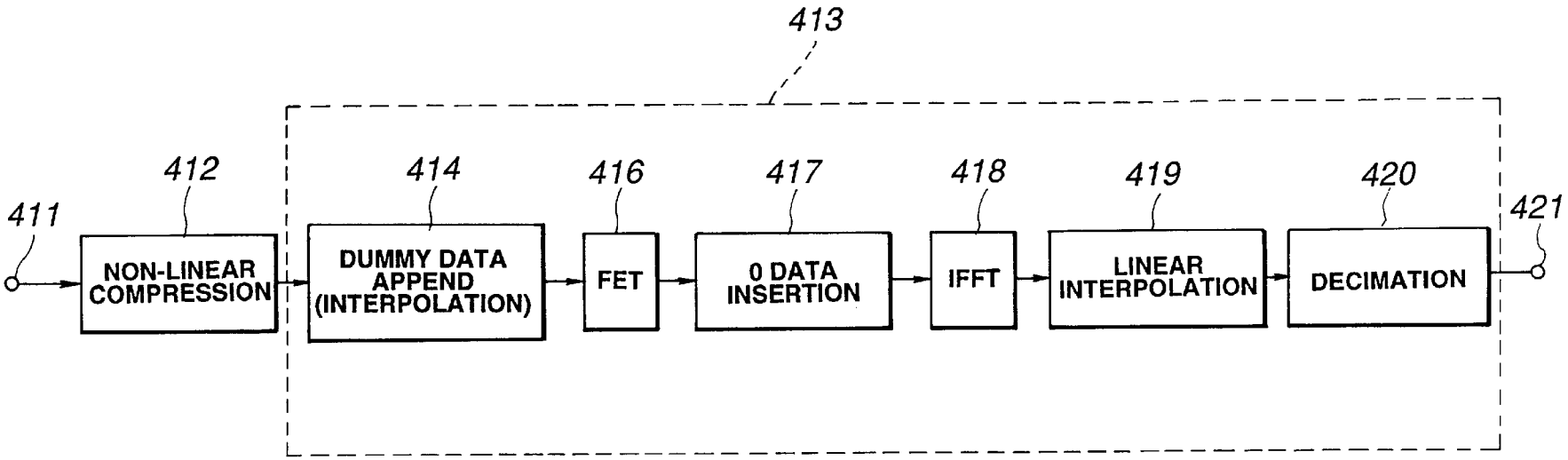
FIG. 21 is a block diagram showing a schematic arrangement for explaining transform of the number of data.

FIG. 21 shows a schematic arrangement of the conversion method for the number of data as described above.

Figure 22A:
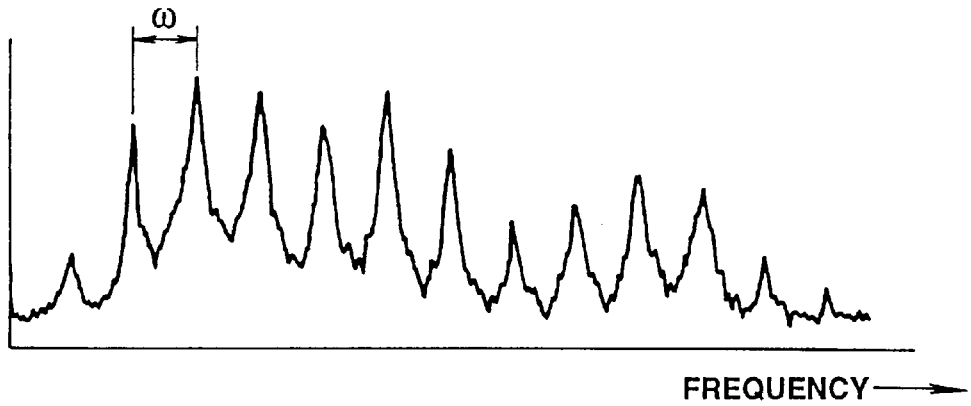
FIG. 22 is a waveform diagram for explaining an example of transform of the number of data.
Figure 22B:
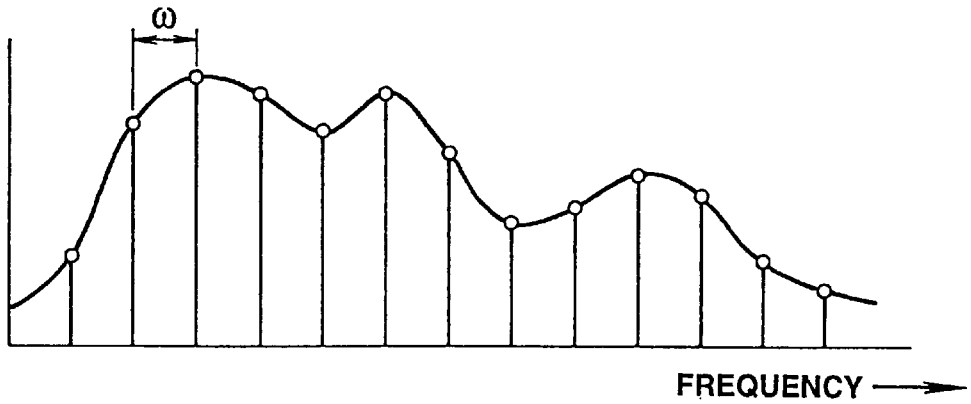

Referring to FIG. 21, amplitude data of the spectral envelope calculated by the MBE vocoder is supplied to an input terminal 411. When the amplitude in the position of each harmonics is found, so as to find the amplitude data expressing the spectral envelope as shown in FIG. 22B, in consideration of periodicity of the spectrum corresponding to the pitch frequency ω found by analyzing the voice signal having the spectrum as shown in FIG. 22A, the number of the amplitude data within a predetermined effective band, e.g. 200 to 3400 Hz, changes, depending on the pitch frequency ω. Thus, a predetermined fixed frequency $\omega_C$ is presumed, and the amplitude data of the spectral envelope in the position of the harmonics of the predetermined frequency $\omega_C$ is found, thereby making the number of data constant.

In the example of FIG. 21, a variable number ($m_{MX}$+1) of the input data from the input terminal 411 are compressed with logarithmic compression into e.g. a dB region by a non-linear compression section 412, and then are converted into a predetermined number (M) of data by a data number conversion main body 413. The data number conversion main body 413 has a dummy data append section 414 and a band limiting type oversampling section 415. The band limiting type oversampling section 415 is constituted by an orthogonal transform e.g. FFT processing section 416, a 0 data insertion processing section 417, and an inverse orthogonal transform e.g. IFFT processing section 418. Data processed with band limiting type oversampling is linearly interpolated by a linear interpolation section 419, then curtailed by a decimation processing section 420, so as to be a predetermined number of data, and is taken out form an output terminal 421.

An amplitude data array consisting of ($m_{MX}$+1) data calculated in the MBE vocoder is set to be a(m). m indicates a succeeding number of the harmonics or a band number, and $m_{MX}$ is the maximum value. However, the number of amplitude data in all the bands is ($m_{MX}$+1) including the amplitude data in the band of m=0. The amplitude data a(m) is converted into a dB region by the non-linear compression section 414. That is, with the produced data $a_{dB}$(m), the following formula holds:

$$a_{dB}(m)=20\log_{10}a(m) \tag{21}$$

Since the number ($m_{MX}$+1) of the amplitude data $a_{dB}$(m) converted with logarithmic conversion changes in accordance with the pitch, the amplitude data is converted into the predetermined number (M) of amplitude data $b_{dB}$(m). This conversion is a kind of sampling rate conversion. Meanwhile, the compression processing by the non-linear compression section 412 may be pseudo-logarithmic compression processing, such as so-called μ-law or α-law, other than the logarithm compression into the dB region. With the compression of the amplitude in this manner, efficient encoding can be realized.

Figure 22C:
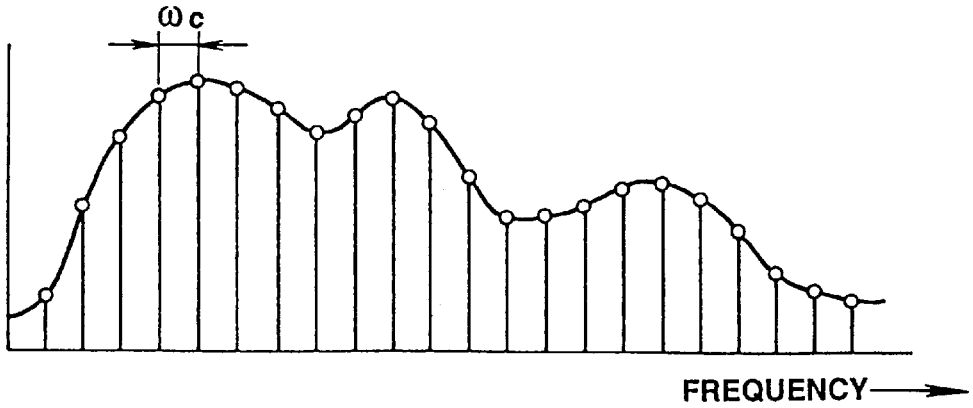

The sampling frequency $f_S$ for the voice signal on the frequency axis inputted to the MBE vocoder is normally 8 kHz, and the entire bandwidth is 3.4 kHz with the effective bandwidth of 200 to 3400 Hz. The pitch lag, or the number of samples corresponding to the pitch period, from a high female voice to a low male voice is about 20 to 147. Accordingly, the pitch (angular) frequency is changed within a range from 8000/147≈54 Hz to 8000/20=400 Hz. Therefore, about 8 to 63 pitch pulses (harmonics) are to stand in a range up to 3.4 kHz on the frequency axis. That is, as a waveform of the dB region on the frequency axis, data consisting of 8 to 63 samples is processed with sample conversion into a predetermined number of samples, e.g. 44 samples. This sample conversion corresponds to finding samples in the position of the harmonics for each predetermined pitch frequency $\omega_C$, as shown in FIG. 22C.

Then, ($m_{MX}$+1) compression data $a_{dB}$(m) is extended by the dummy data append section 414 to the number $N_F$ for facilitating FFT, e.g. $N_F$=256. That is, with data from ($m_{MX}$+1) to $N_F$ being regarded as dummy data $a'_{dB}$(m), the compression data is extended, using the following formula.

$$\begin{aligned}
&m_{MX}+1 \le m < N_F/2 : a'_{dB}(m) = a_{dB}(m_{MX}) \\
&N_F/2 \le m < 3N_F/4 : \\
&\qquad a'_{dB}(m) = a_{dB}(m_{MX})\times k_1 + a_{dB}(0)\times k_2 \\
&\qquad \text{where} \quad k_1 = (3N_F/4 - N)/(N_F/4) \\
&\qquad\qquad\quad\ \ k_2 = (n - N_F/2)/(N_F/4) \\
&3N_F/4 \le m < N_F : a'_{dB}(m) = a_{dB}(0)
\end{aligned} \tag{22}$$

Figure 23:
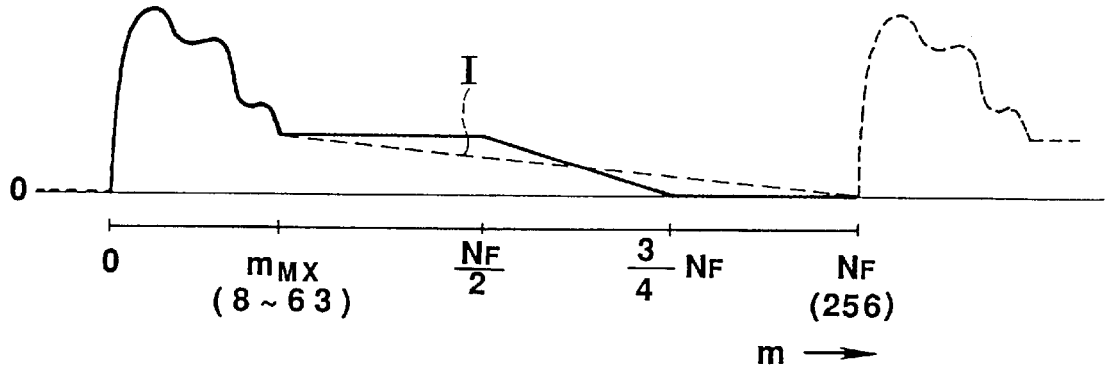
FIG. 23 is a diagram showing an example of a waveform for an expanded number of data before FFT.

As shown in FIG. 23, the original amplitude data $a_{dB}$(m) is placed in a section of 0 to $m_{MX}$, and the last data $a_{dB}$($m_{MX}$) in the block is held in a section of $m_{MX}$+1≦m<$N_F$/2. A section of $N_F$/ 2≦m<3$N_F$/4 is linearly interpolated. A section of 3$N_F$/4≦m<$N_F$ is a folded line such that the first data $a_{dB}$(0) in the block is held.

That is, data is produced and crammed so that left and right edges of the original waveform for rate conversion as shown in FIG. 23 are gradually connected to each other. In FFT, since the waveform before conversion is regarded as a repeat waveform as shown by a broken line in FIG. 23, the point of $m=N_F$ is to be connected to m=0.

Figure 24:
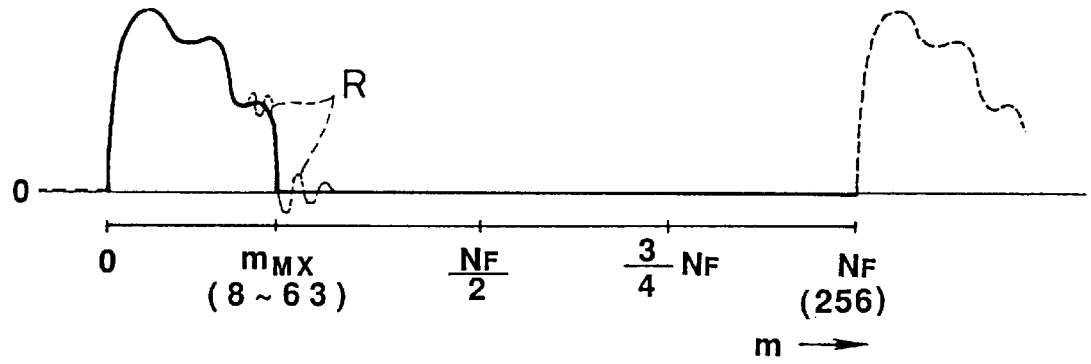
FIG. 24 is a diagram showing a comparative example of the waveform for the expanded number of data before FFT.

If filtering for performing multiplication on the frequency axis is carried out after FFT, convolution is performed on the original axis shown in FIG. 23. Therefore, if 0 cramming is simply carried out in a section ($m_{MX}<m<N_F$) other than the original waveform as shown in FIG. 24, ringing as indicated by a broken line R in FIG. 24 is generated at a discontinuous point, thereby disturbing normal rate conversion. In order to prevent such inconvenience, the dummy data is crammed so as not to bring about sudden changes of the value at the block terminal point, as shown in FIG. 23. Besides the concrete example of the dummy data, it is also considered that the entire data from the last data of the block to the first data of the block may be linearly interpolated, as indicated by a broken line I in FIG. 23, or may be curvedly interpolated.

Figure 25A:
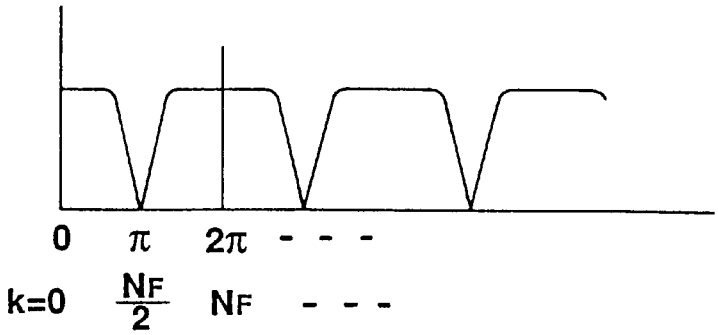
FIG. 25 is a diagram for explaining a waveform after FFT and an oversampling operation.
Figure 25B:
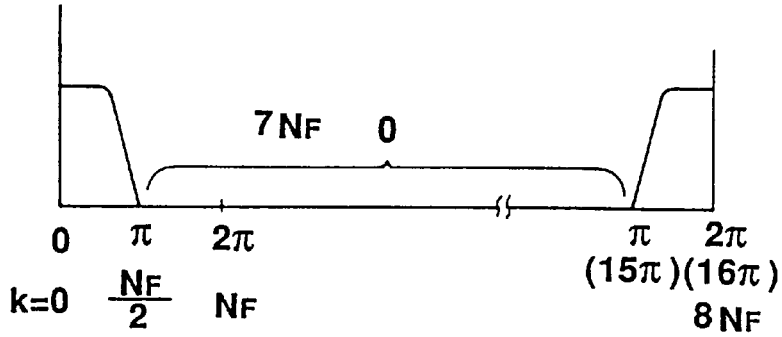

Next, the progression or data sequence extended to $N_F$ points ($N_F$ samples) is processed with $N_F$-point FFT by the FFT processing section 416 of the band limiting type oversampling section 415, thereby producing a progression (spectrum) of 0 to $N_F$ as shown in FIG. 25A. The $(O_S-1)\,N_F$ number of Os are crammed into a space between a portion of the progression corresponding to 0 to $\pi$ and a portion corresponding to $\pi$ to $2\pi$, by the 0 data insertion processing section 417. $O_S$ at this time is the oversampling ratio. For example, in the case of $O_S=8$, $7N_F$ Os are crammed into the space between the section corresponding to 0 to $\pi$ and the section corresponding to $\pi$ to $2\pi$ in the progression, thereby producing an $8N_F$-point progression, e.g. 2048 points in the case of $N_F=256$.

Figure 26A:
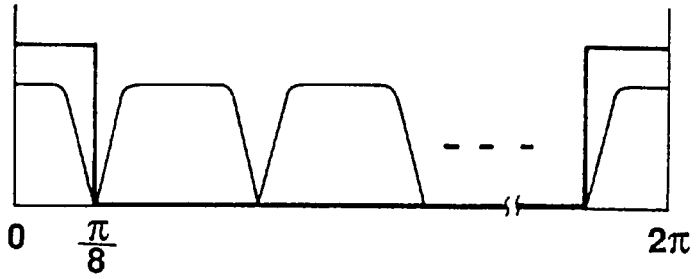
FIG. 26 is a diagram for explaining a filtering operation to the waveform after FFT.
Figure 26B:
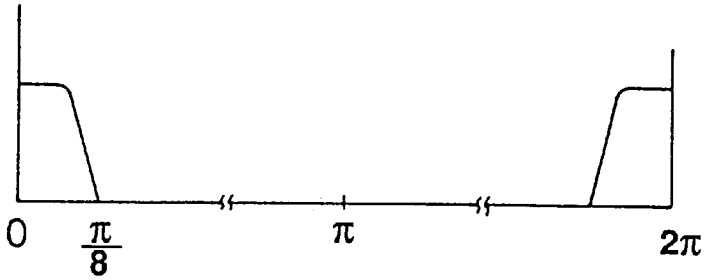

The O data insertion may be LPF processing. That is, a progression of $O_SN_F$ as the sampling rate is processed with low-pass processing with a cut-off of $\pi/8$ as shown by the bold line in FIG. 26A, by a digital filter operating at $O_SN_F$, thereby producing a sequence of samples as shown in FIG. 26B. In this filter operation, there is a fear that ringing as indicated by broken line R in FIG. 24 might be generated. In the present embodiment, for avoiding generation of the ringing, left and right edges of the original waveform are gently connected to each other so as not to cause a sudden change in differential coefficient.

Figure 27:
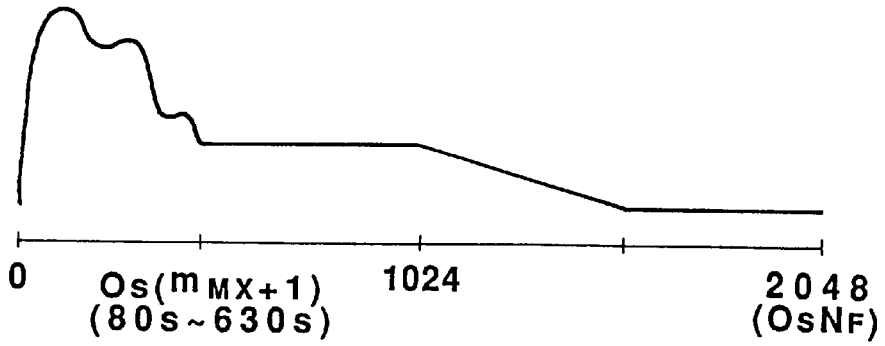
FIG. 27 is a diagram showing a waveform after IFFT.

Next, if $O_SN_F$ points, e.g. 2048 points, are processed with inverse FFT by the IFFT processing unit 418, the amplitude data including the dummy data as shown in FIG. 27 which is oversampled by $O_S$ can be obtained. If the effective section of this data sequence, that is, O to $O_S\times(m_{MX}+1)$ is taken out, the original waveform (original amplitude data $a_{dB}(m)$) which is oversampled to have a density $O_S$ times larger can be obtained. This is a data sequence still dependent on the variable number $(m_{MX}+1)$ in accordance with the pitch.

Figure 28A:
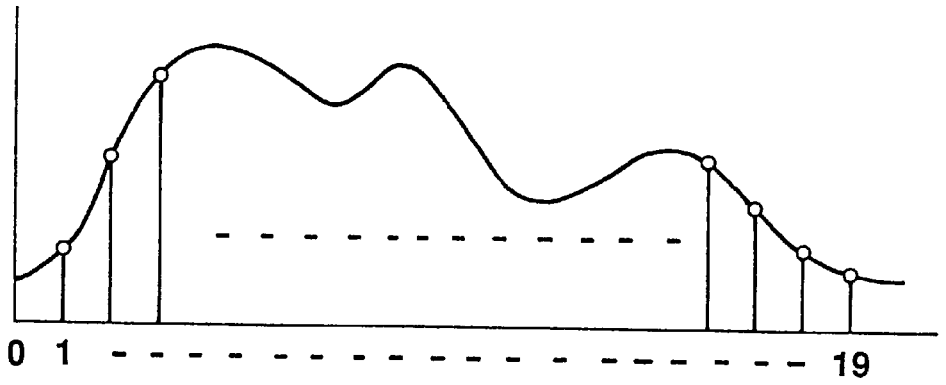
FIG. 28 is a diagram showing an example of transform of the number of samples by oversampling.
Figure 28B:
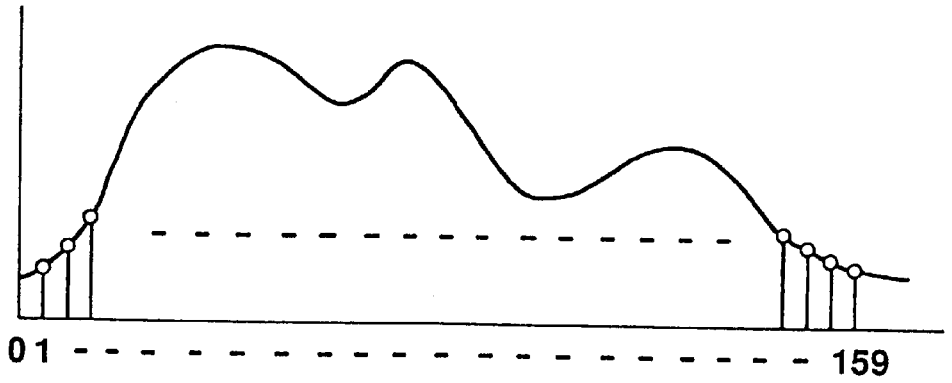

Next, in order to convert the data sequence into a fixed number of data, linear interpolation is carried out. For example, FIG. 28A shows a case of $m_{MX}=19$ (with the number of all the bands before conversion and the amplitude data being 20). By performing 8-time oversampling with $O_S=8$, $O_S\times(m_{MX}+1)=160$ sample data are produced between 0 and $\pi$. The 160 sample data are then linearly interpolated by the linear interpolation unit 419 into a predetermined number $N_M$ e.g. 2048 of data.

Figure 29A:
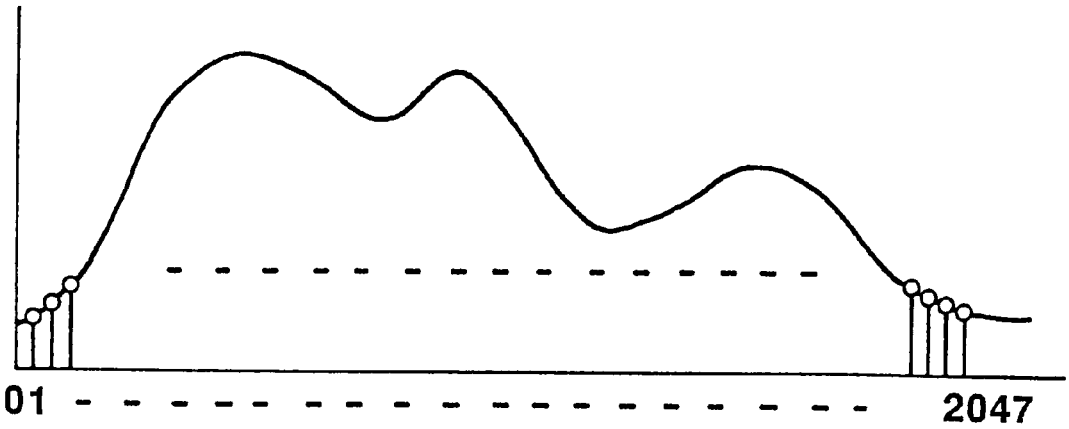
FIG. 29 is a diagram for explaining linear compensation and curtailment processing.
Figure 29B:
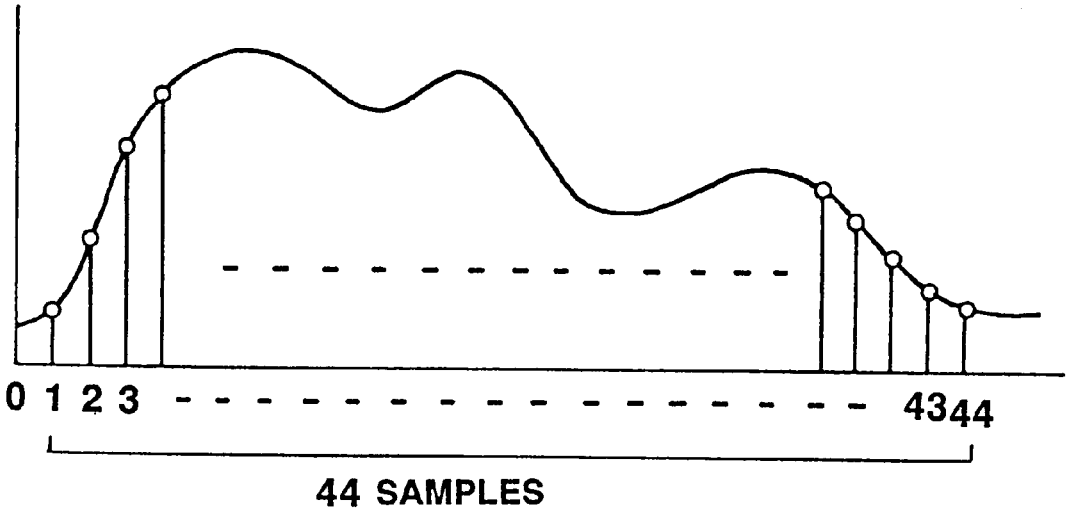

FIG. 29A shows the predetermined number $N_M$ e.g. 2048 of data produced by linear interpolation of the linear interpolation unit 419. In order to convert these 2048 sample data into a predetermined number of, that is, M samples, e.g. 44 samples, the 2048 sample data are curtailed by the curtailing processing section 420. Thus, 44-point data are obtained. Since it is not necessary to transmit a DC value (direct current data value or the 0th data value) among the 0th to 2047th samples, 44 data may be produced, using the value of $$\text{nint}\,(2048/44)\cdot i$$

as the curtailment value. However, since $1\leqq i<44$ holds, "nint" is a function indicating the nearest integer.

In this manner, the progression $b_{dB}(n)$ converted into the predetermined number M of samples are obtained, where $1\leqq n<M$ holds. It suffices to take the inter-block or inter-frame difference if necessary, to process the progression of the fixed number of data with vector quantization, and to transmit its index.

On the receiving side (synthesis side or decoder side), M-point waveform data which is a vector-quantized and inversely quantized progression $b_{VQdB}(n)$ is produced from the index. The data sequence is similarly processed by inverse operations of band limiting oversampling, linear interpolation and curtailment, respectively, and is thereby converted into the $(m_{MX}+1)$ point progression of the necessary number of points. Meanwhile, $m_{MX}$ (or $m_{MX}+1$) can be found by separately transmitted pitch data. For example, if the pitch period standardized for the sampling period is set to p, the pitch frequency $\omega$ can be found by $2\pi/p$, and can be calculated as $m_{MX}+1=\text{inint}\,(p/2)$ since $\pi/\omega=p/2$. Decoding processing is carried out on the basis of the amplitude data of $m_{MX}+1$ points.

According to the conversion method for the number of data described above, since the variable number of data are non-linearly compressed in the block and are converted into the predetermined number of data, it is possible to take inter-block (inter-frame) difference and to perform vector quantization. Therefore, the conversion method is very effective for improving encoding efficiency. Also, in performing the band limiting type oversampling processing for the data number conversion (sample number conversion), the dummy data such as to interpolate between the last data value in the block before processing and the first data value is added to expand the number of data. Therefore, it is possible to avoid such inconvenience as generation of ringing at the terminal point due to the later filter processing, and to realize good encoding, particularly high efficiency vector quantization.

If the bit rate is reduced to about 3 to 4 kbps so as to further improve quantization efficiency, the quantization noise in scalar quantization is increased causing difficulty in practicality.

Thus, employment of vector quantization can be considered. However, when the number of bits of vector quantization output (index) is set to b, the size of codebook of the vector quantizer increases in proportion to $2^b$, and the operation volume for codebook search also increases in proportion to $2^b$. However, if the number of output bits b is made too small, the quantization noise is increased. Therefore, it is preferable to reduce the size of the codebook and the operation volume at the time of search, with the number of bits b maintained to a certain degree. Also, if the data converted into data on the frequency axis is vector-quantized in this state, encoding efficiency may not be improved sufficiently. Therefore, a technique for further improving the compression ratio is needed.

Thus, a high efficiency encoding method whereby it is possible to reduce the size of the codebook of the vector quantizer and the operation volume at the time of search without lowering the number of output bits of vector quantization, and to improve the compression ratio in vector quantization is proposed.

According to the present invention, there is provided a high efficiency encoding method comprising the steps of: dividing input audio signals into blocks and converting the block signals into signals on the frequency axis to find data on the frequency axis as an M-dimensional vector; dividing the M-dimensional data on the frequency axis into plural groups and finding a representative values for each of the groups to lower the M dimension to an S dimension, where S<M; processing the S-dimensional data by first vector quantization; processing output data of the first vector quantization by inverse vector quantization to find corresponding S-dimensional code vector; expanding the S-dimensional code vector to an original M-dimensional vector; and processing data representing the relation between data on the frequency axis of the expanded M-dimensional vector and the original M-dimensional vector with a second vector quantization.

The data converted into data on the frequency axis on the block-by-block basis and compressed in a non-linear fashion may be used as the data on the frequency axis of the M-dimensional vector.

According to another aspect of the present invention, the high efficiency encoding method comprises the steps of: non-linearly compressing data obtained by dividing input audio signals into blocks and converting resulting block data into signals on the frequency axis to find data on the frequency axis as the M-dimensional vector; and processing the data on the frequency axis of the M-dimensional vector with vector quantization.

In these high efficiency encoding method, the inter-block difference of data to be vector-quantized may be taken and processed with vector quantization.

According to still another aspect of the present invention, a high efficiency encoding method comprises: taking an inter-block difference of data obtained by dividing input audio signal on the block-by-block basis and by converting into signals on the frequency axis to find inter-block difference data as the M-dimensional vector; and processing the inter-block difference data of the M-dimensional vector with vector quantization.

According to still another aspect of the present invention, a high efficiency encoding method comprises the steps of: dividing input audio signals into blocks and converting the block signals into signals on the frequency axis to convert amplitude of the spectrum into dB region amplitude, thus finding data on the frequency axis as an M-dimensional vector; dividing the M-dimensional data on the frequency axis into plural groups and finding average values for the groups to lower the M dimension to an S dimension, where S<M; processing mean-value data of the S dimensional with first vector quantization; processing output data of the first vector quantization with inverse vector quantization to find corresponding S-dimensional code vector; expanding the S-dimensional code vector to an original M-dimensional vector; and processing difference data between data on the frequency axis of the expanded M-dimensional vector and the original M-dimensional vector with a second vector quantization.

With such a high efficiency encoding method, by vector quantization having a hierarchical codebook for lowering the M dimension to the S dimension and performing vector quantization, where S<M, it becomes possible to diminish the operation volume of the codebook search or the codebook size. Thus, it becomes possible to make effective utilization of the error correction code. On the other hand, the quantization quality can be improved by performing vector quantization after non-linear compression of data on the frequency axis, while the compression efficiency can be further improved by taking the inter-block difference.

A preferred embodiment of the high efficiency encoding method as described above is explained with reference to the drawings.

Figure 30:
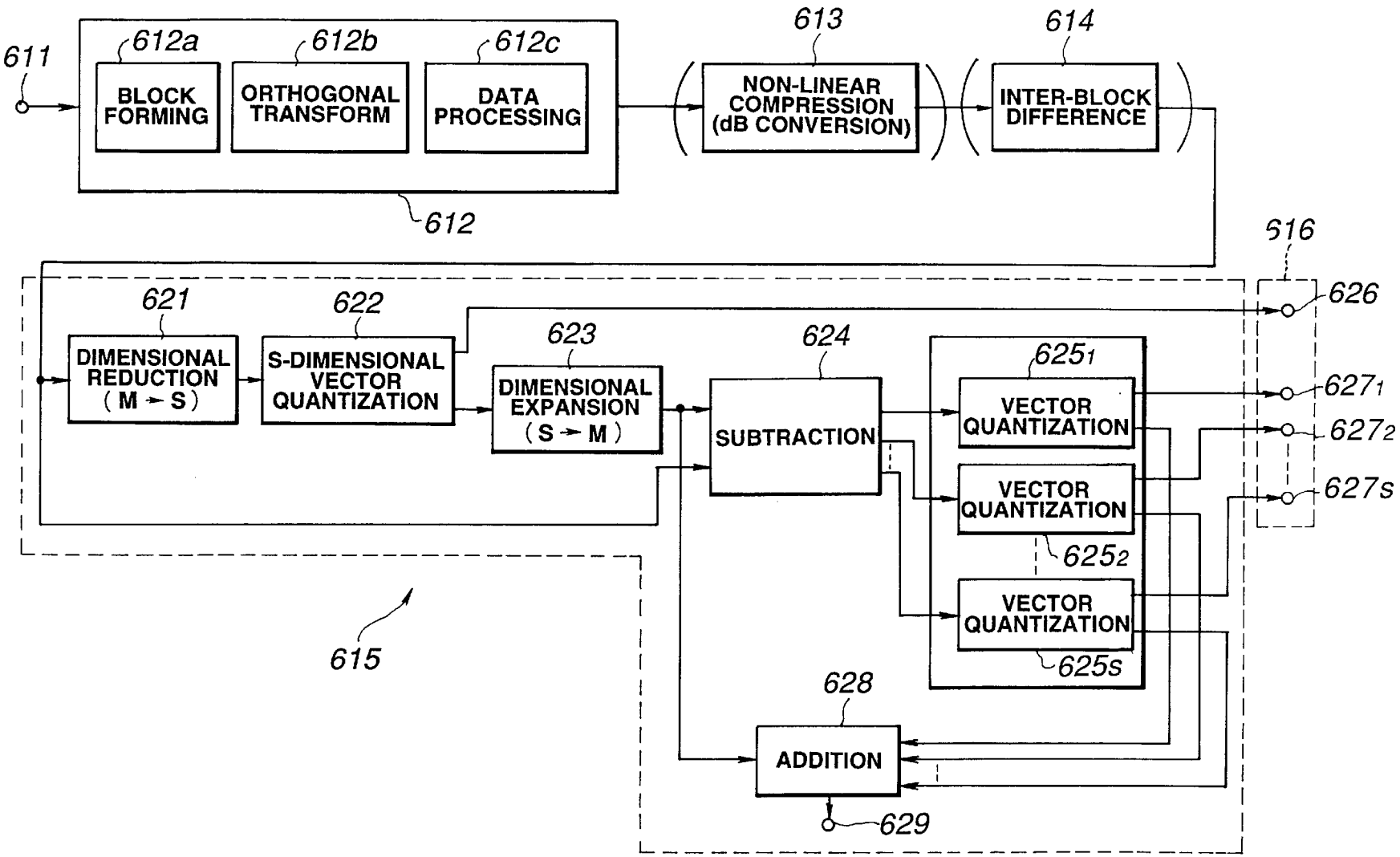
FIG. 30 is a block diagram showing a schematic arrangement of an encoder to which the high efficiency encoding method of the present invention is applied.

FIG. 30 shows a schematic arrangement of an encoder for explaining the high efficiency encoding method according to an embodiment of the present invention.

In FIG. 30, voice or acoustic signals are supplied to an input terminal 611 so as to be converted by a frequency axis transform processor 612 into spectral amplitude data on the frequency axis. The frequency axis transform processor 12 includes: a block-forming section 612*a* for dividing input signals on the time axis into blocks each consisting of a predetermined number of, herein N, samples; an orthogonal transform section 612*b* for e.g. fast Fourier transform (FFT); and a data processor 612*c* for finding the amplitude information representative of features of a spectral envelope. An output from the frequency axis transform processor 612 is supplied to a vector quantizer 615 via an optional non-linear compressing section 613 for conversion into a dB region data and an optional processor 614 for taking the inter-block difference. In the vector quantizer 615, a predetermined number of samples, herein M samples, are taken and grouped into an M dimensional vector and are processed with vector quantization. In general, the M-dimensional vector quantization is an operation of searching for a code vector having the shortest distance on the M-dimensional space to the input dimensional vector from a code book to take out an index of the searched code vector from an output terminal 616. The vector quantizer 615 of the embodiment shown in FIG. 30 has a hierarchical structure such that two-stage vector quantization is performed on the input vector.

Figure 31:
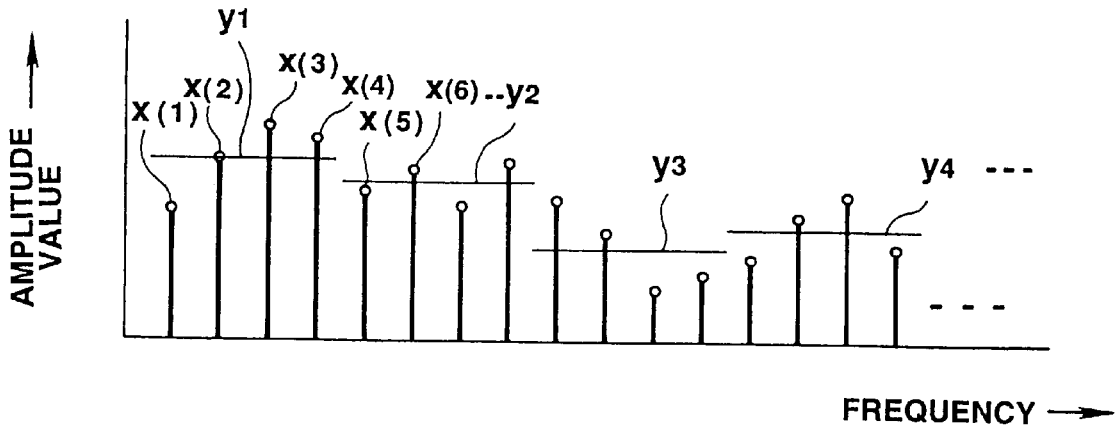
FIGS. 31 to 36 are diagrams for explaining movement of vector quantization of hierarchical structure.
Figure 32:
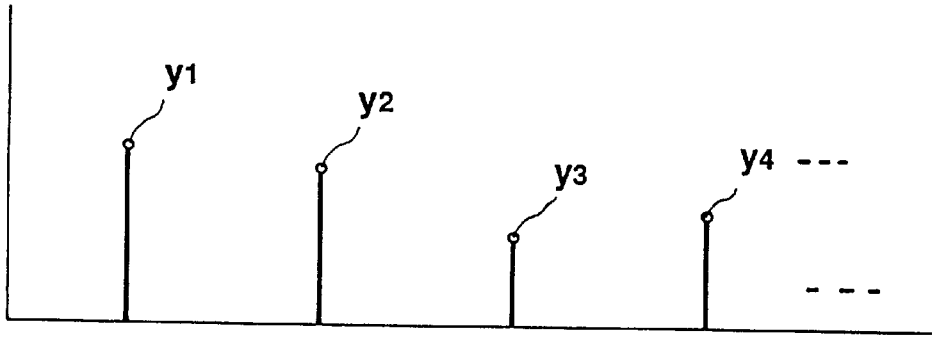

That is, in the vector quantizer 615 shown in FIG. 30, data of the M-dimensional vector (data on the frequency axis), as a unit for vector quantization, are transmitted to a dimension diminishing section 621 in which the data is divided into plural groups and a representative value is found in each group for diminishing the number of the dimension to S, where S<M. FIG. 31 shows a concrete example of elements of an M-dimensional vector X entered to the vector quantizer 615, that is, M units of amplitude data x(n) on the frequency axis, where $1 \leqq n \leqq M$. These M units of the amplitude data x(n) are grouped into e.g. four samples, and a representative value, such as an average value $y_i$, is found for each of these four samples. Then, an S-dimensional vector Y consisting of S units of the average value data $y_1$ to $y_S$, where S=M/4, as shown in FIG. 32.

Figure 33:
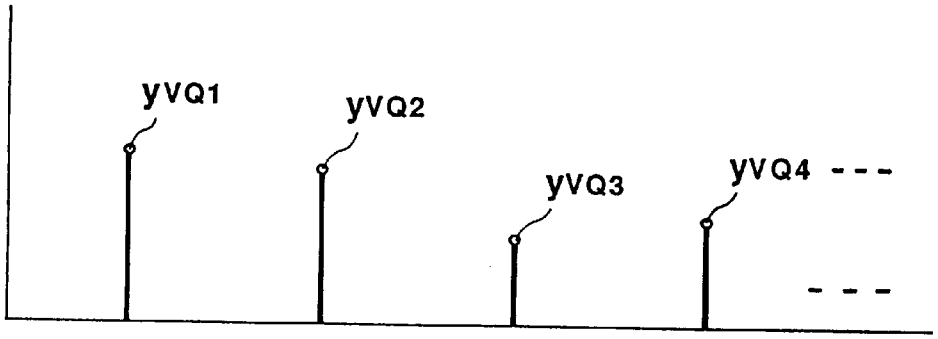

These S-dimensional vector data are processed with vector quantization by an S-dimensional vector quantizer 622. That is, the code vector being closest to the input S-dimensional code vector on the S-dimensional space on the S-dimensional space, among the S-dimensional code vectors in the code book of the S-dimensional vector quantizer 622, is searched. Index data of the thus searched code vector is taken out from an output terminal 626. The code vector thus searched, that is the code vector obtained by inverse vector quantization of the output vector, is transmitted to a dimension expansion section 623. FIG. 33 shows elements $Y_{VQ1}$ to $Y_{VQS}$ of the S-dimensional vector $Y_{VQ}$, as a local decoder output, obtained by vector quantization and then inverse quantization of the S-dimensional vector Y consisting of S units of average value data $y_1$ to $y_S$ shown in FIG. 32, in other words, by taking out the code vector searched in quantization by the codebook of the vector quantizer 622.

Figure 34:
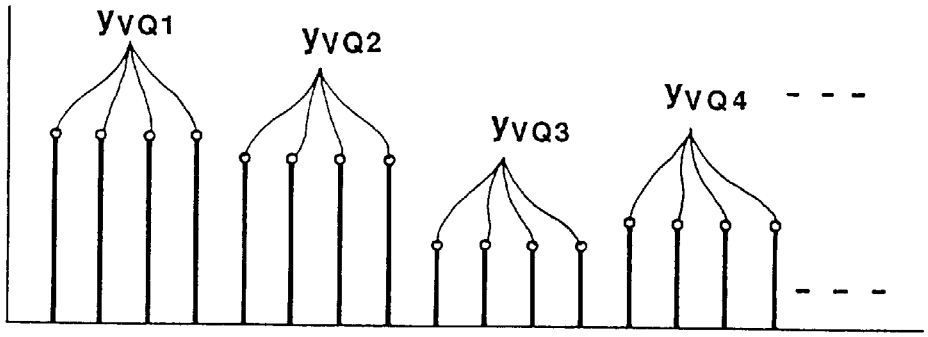

The dimension expansion section 623 expands the above-mentioned S-dimensional code vector to an original M-dimensional vector. FIG. 34 shows an example of the elements of the expanded M-dimensional vector. It is clear from FIG. 34 that the M-dimensional vector consisting of 4S=M elements is obtained by increasing the elements $Y_{VQ1}$ to $Y_{VQS}$ of the inverse vector-quantized S-dimensional vector $Y_{VQ}$. The second vector quantization is carried out on data indicating the relation between the expanded M-dimensional vector and the data on the frequency axis of the original M-dimensional vector.

Figure 35:
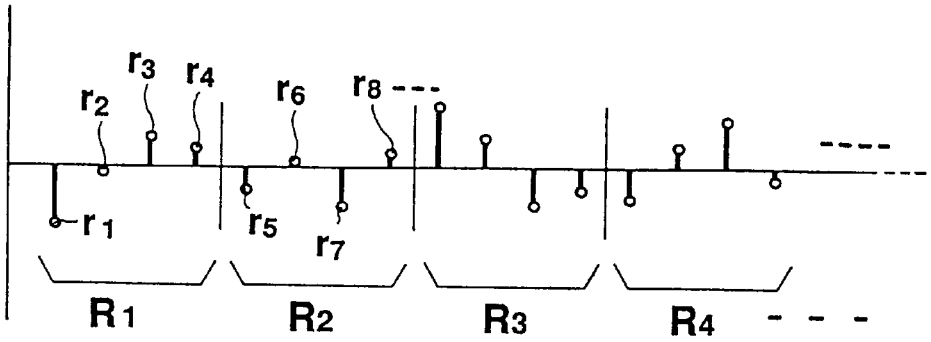

In the embodiment of FIG. 30, the expanded M-dimensional vector data from the dimension expansion section 623 is transmitted to a subtractor 624 for subtraction from the data on the frequency axis of the original M-dimensional vector, thereby producing S units of vector data indicating the relation between the M-dimensional vector expanded from the S dimension and the original M-dimensional vector. FIG. 35 shows M units of data $r_1$ to $r_M$ obtained on subtraction of the elements of the expanded M-dimensional vector shown in FIG. 34 from the M units of amplitude data x(n) on the frequency axis which are respective elements of the M-dimensional vector X shown in FIG. 31. Four samples each of these M units of data $r_1$ to $r_M$ are grouped as sets or vectors to produce S units of the four-dimensional vectors $R_1$ to $R_S$.

Figure 36:
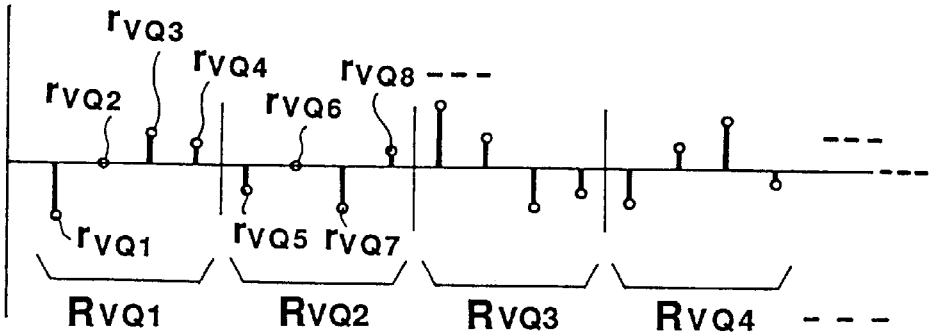

The S units of vectors, obtained from the subtractor 624, is processed with vector quantization by S units of vector quantizers $\mathbf{625}_1$ to $\mathbf{625}_S$ of a vector quantizer group 625. An index outputted from each of the vector quantizers $\mathbf{625}_1$ to $\mathbf{625}_S$ is outputted from output terminals $\mathbf{627}_1$ to $\mathbf{627}_S$. FIG. 36 shows elements $r_{VQ1}$ to $r_{VQ4}$, $r_{VQ5}$ to $r_{VQ8}$, . . . $r_{VQM}$ of the respective four-dimensional vectors $R_{VQ1}$, to $R_{VQS}$ resulting from vector quantization of the four-dimensional vectors $R_1$ to $R_S$ shown in FIG. 35, using the vector quantizers $\mathbf{625}_1$ to $\mathbf{625}_S$ as the respective four-dimensional vector quantizers.

By the above-described hierarchical two-stage vector quantization, it becomes possible to diminish the operation volume for codebook search and the memory space for the codebook, such as the ROM capacity. Also, it becomes possible to make effective application of the error correction codes by preferential error correction coding for the more crucial upper order indices obtained from the output terminal 626. Meanwhile, the hierarchical structure of the vector quantizer 615 is not limited to two stages but may also comprise three or more stages of vector quantization.

Meanwhile, the respective components of FIG. 30 need not be arranged as a hardware, and may be implemented by software techniques using a so-called digital signal processor (DSP). The vector quantizer 615 includes an adder 628 for summing the elements of the quantized data from the first and second vector quantizers 622, 625, so as to produce M units of the quantized data. That is, the M units of the expanded M-dimensional data from the dimension expanding section 623 are added to the M units of the element data of each of the S units of the code vectors from the vector quantizers $\mathbf{625}_1$ to $\mathbf{625}_S$ to output M units of data from an output terminal 629. The adder 628 is used for taking an inter-block or inter-frame difference as later explained, and may be omitted in case of not taking such a inter-block difference.

Figure 37:
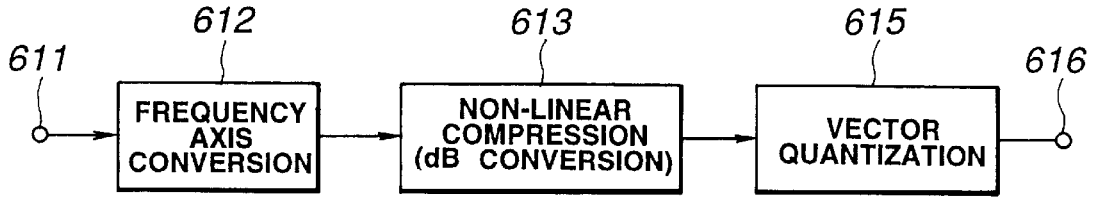
FIG. 37 is a block diagram showing a schematic arrangement of an encoder to which another example of the high efficiency encoding method is applied.

FIG. 37 shows a schematic arrangement of an encoder for illustrating the high efficiency encoding method as a second embodiment of the present invention.

Figure 38:
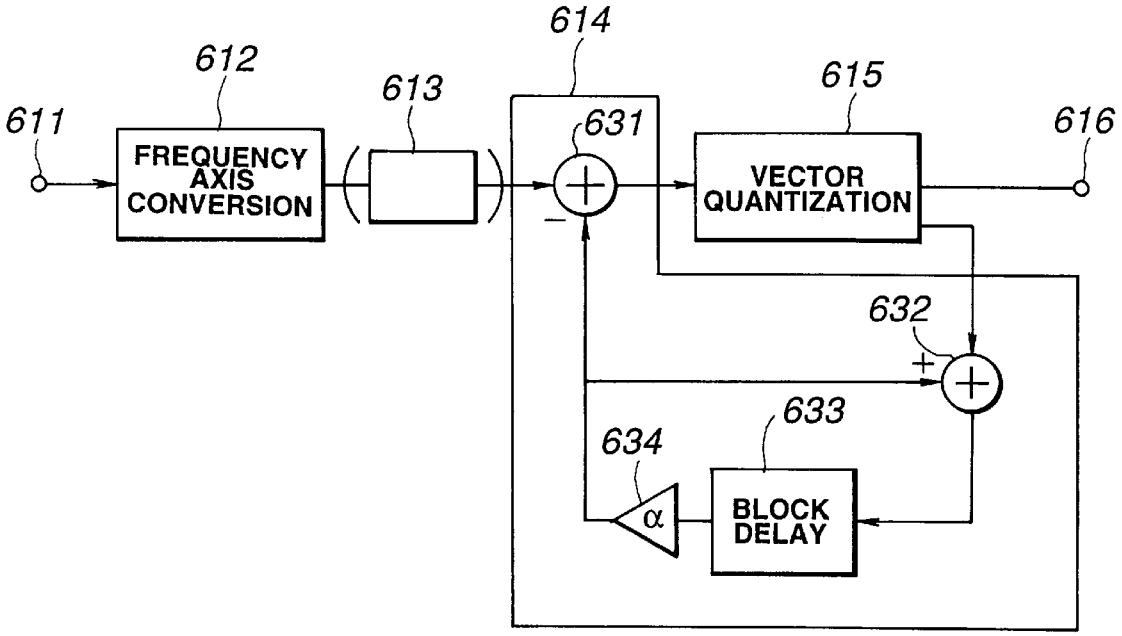
FIG. 38 is a block diagram showing a schematic arrangement of an encoder to which still another example of the high efficiency encoding method is applied.

In FIG. 38, audio signals, such as voice signals or acoustic signals, supplied to an input terminal 611, are divided by a frequency axis transform processor 612 into blocks each consisting of N units of samples, and the produced data are transmitted to a non-linear compression section 613, where non-linear compression of converting the data into e.g. dB region data is performed. M units of the produced non-linear compressed data are collected into an M-dimensional vector, which is then processed with vector quantization by a vector quantizer 615 and is outputted from an output terminal 616. The vector quantizer 615 may have a hierarchial structure of two stages, or three or more stages, or may be designed to perform ordinary one-stage vector quantization without having the hierarchical structure. The non-linear compressing section 613 may be designed to perform so-called $\mu$-law or A-law pseudo-logarithmic compression instead of log compression (logarithmic compression) of converting the data into dB region data. Thus, efficient encoding can be realized by logarithmic amplitude transform, compression, and linear encoding.

FIG. 38 shows a schematic arrangement of an encoder for explaining the high efficiency encoding method as a third embodiment of the present invention.

In FIG. 38, audio signals supplied to an input terminal are divided by a frequency axis transform processor 612 into block-by-block data, and are changed into data on the frequency axis. The resulting data are transmitted via an optional non-linear compression section 613 to a processor 614 for taking the inter-block difference. Meanwhile, if the blocks of the N units of samples are partially overlapped with adjacent blocks and arrayed on the time axis on the frame-by-frame basis with each frame consisting of L units of samples, where L<N, an inter-frame difference is taken by the processor 612. The M units of data, in which the inter-block difference or the inter-frame difference has been taken, is transmitted to an M-dimensional vector quantizer 615. The index data quantized by the M-dimensional vector quantizer 615 is taken out from an output terminal 616. The vector quantizer 615 may be or may not be of a multi-layered structure.

The processor 614 for taking the inter-block or inter-frame difference may be designed to delay input data by one block or by one frame to take the difference from the original data which are not delayed. However, in the example of FIG. 38, a subtractor 631 is connected to an input side of the vector quantizer 615. A code vector from the M-dimensional vector quantizer 615, consisting of M units of element data, is delayed by one block or frame and is subtracted from the input data (M-dimensional vector). Since the differential data of the vector quantized data is taken in this case, the code vector from the vector quantizer 615 is transmitted to an adder 632. An output from the adder 632 is delayed by a block delay or frame delay circuit 633, and is multiplied by a coefficient $\alpha$ by a multiplier 634, which is then transmitted to the adder 632. An output from the multiplier 634 is transmitted to the subtractor 631. Meanwhile, if the two-stage hierarchical structure shown in FIG. 30 is employed in the M-dimensional vector quantizer 615, the data from an output terminal 629 are transmitted to the adder 632 as an M-dimensional code vector for vector quantization.

By taking the inter-block or inter-frame difference, a region of presence of the input amplitude data on the frequency axis in the M-dimensional space can be made narrower. This is because the amplitude changes of the spectrum are usually small and exhibit strong correlation between the block or frame intervals. Consequently, the quantization noise can be reduced, and thus the data compression efficiency can be improved further.

Next, a concrete embodiment of the present invention in which data on the frequency axis, obtained by a frequency axis transform processor 612, has its spectral amplitude data converted by a non-linear compressing section 613 into amplitude data in a dB region, to find an inter-block or inter-frame difference as shown in FIG. 38, and in which the resulting data is processed by a multi-layered vector quantizer 615 with M-dimensional vector quantization as shown in FIG. 30, is hereinafter explained. Although a variety of encoding systems may be adopted in the frequency axis transform processor 612, multiband excitation (MBE) analytic processing as later explained may be employed. In block formation by the frequency axis transform processor 612, the N-sample block data are arrayed on the time axis on the frame-by-frame basis with each frame consisting of L units of samples. The analysis is performed for a block consisting of N units of samples, and the results of the analysis is obtained (or updated) at an interval of L units of samples for each frame.

It is assumed that the value of data, such as data for the spectral amplitude, as the results of the MBE analysis obtained from the frequency axis transform processor 612, is a(m), and that a $(m_{MK}+1)$ number of samples, where $0 \leqq m \leqq m_{MX}$, is obtained for each frame.

If data obtained by converting the $(m_{MX}+1)$ number of samples of amplitude values a(m) into dB region values is $a_{dB(m)}$, $$a_{dB(m)}=20 \log_{10} a(m) \tag{23}$$

holds similarly to the above-mentioned formula (21). In the MBE analysis, the number of samples $(m_{MK}+1)$ is changed for each frame, depending on the pitch period. For the inter-frame difference and vector quantization, it is desirable that the number of the dB amplitude values $a_{dB}(m)$ present in each frame or block be kept constant. For this reason, the $(m_{MK}+1)$ number of the dB amplitude values $a_{dB}(m)$ are converted into a constant number M of data $b_{dB}(n)$. The number of samples n is designed to take a value $1 \leqq n \leqq M$ for each frame or each block. The data for n=0, corresponding to the dB amplitude value $a_{dB}(0)$ for m=0, has an amplitude corresponding to the DC component and hence is not transmitted. That is, it is perpetually set to 0.

By taking the inter-frame difference after conversion into dB region data, it becomes possible to narrow the region of presence of the above-mentioned data $b_{dB}(n)$. It is because the spectral amplitude, only on rare occasions, is changed significantly in the course of a frame interval, such as about 20 msec, and thus exhibits strong correlation. That is, vector quantization is performed on the following value $c_{dB}(n)$, $$c_{dB}(n)=b_{dB}(n)-b'_{dB}(n) \tag{24}$$

from which the difference has been taken. In this formula, $b_{dB}(n)$ is a predicted value of $b_{dB}(n)$, and means $$b'_{dB}(n)=\alpha \cdot b''_{dB}(n)p \tag{25}$$

which is obtained by multiplying an output $b''_{dB}(n)p$ by a coefficient α by a multiplier 634, $b''_{dB}(n)p$ being obtained by delaying the inversely quantized output $b''_{dB}(n)$ from the vector quantizer 615 (local decoder output equivalent to the above-mentioned code vector) by one frame by a delay circuit 633, where p indicates the state of being the preceding frame.

If the inter-frame amplitude difference is taken in this manner, code errors are more likely to occur, although the quantization noise may be reduced further. This is because an error in a given frame is propagated to successively adjoining frames. Consequently, α is set to about 0.7 to 0.8, so as to take a so-called leaky difference. If the system is to be stronger against code errors, it is possible to reduce α even to zero, that is, without taking the inter-frame difference, to proceed to the next processing step. In such a case, it is necessary to take account of balanced performance of the entire system.

An embodiment in which the inter-frame difference data $c_{dB}(n)$ is quantized, that is, in which an array $c_{dB}(n)$ is vector-quantized as the M-dimensional vector having M units of elements, is hereinafter explained. Even the case of not taking the difference may be included in $c_{dB}(n)$ if α=0 is considered. The M units of data which are to be M-dimensional vector quantized are replaced by x(n). In the present embodiment, $x(n) \equiv c_{dB}(n)$ and $1 \leqq n \leqq M$. With the number of bits b of the index of the M-dimensional vector quantization output, it is logically possible to perform straight vector quantization of directly searching a codebook having an M-dimension$\times 2^b$ number of code vector. However, the operation volume of the codebook search in vector quantization increases in proportion to $M\ 2^b$, and so does the table ROM size. It is therefore more practical to use vector quantization having a structured codebook. In the present embodiment, the M-dimensional vector is divided into plural low-dimensional vectors, and an average value of each of the low-dimensional vectors is calculated. The low-dimensional vectors are divided into vectors consisting of these average values (upper order layer) and vectors freed of the average values (lower order layers), each of which is then processed with vector quantization.

The M units of data x(n), such as the differential data $c_{dB}(n)$, is divided into S units of vectors.

$$\begin{aligned} X_1 &= (x(1), x(2), \cdots, x(d_1))^t \\ X_2 &= (x(d_1+1), x(d_1+2), \cdots, x(d_1+d_2))^t \\ &\vdots \\ X_s &= (x(d_1+d_2+\cdots+d_{s-1}+1), x(d_1+d_2+\cdots+d_{s-1}+2), \vdots, \\ &\quad x(d_1+d_2+\cdots+d_s))^t \end{aligned} \tag{26}$$

In the above formula (26), $X_1, X_2, \ldots X_S$ express vectors of $d_1, d_2, \ldots d_S$ dimensions, respectively, where $d_1+d_2+\ldots+d_S=M$. t indicates vector transposition. The aforementioned concrete example shown in FIG. 31 corresponds to the case in which the dimensions of each of the vectors $X_1, X_2, \ldots, X_S$ are all set to 4, that is, $d_1=d_2=\ldots=d_S=4$.

If average values of the elements of the S units of vectors $X_2, X_2, \ldots, X_S$ are $y_1, y_2, \ldots, y_S$, respectively, $y_i$ $(1 \leqq i \leqq S)$ may be expressed by $$y_i = \frac{1}{d_i}\sum_{k=1}^{d_i} x(g_i+k) \tag{27}$$

where $$g_i = \sum_{k=1}^{i-1} d_i \quad (i>1)$$

$$g_i = 0 \quad (i=1)$$

The S-dimensional average values having these average values as elements are defined by formula (28).

$$Y=(y_1, y_2, \ldots, y_S) \tag{28}$$

This corresponds to FIG. 32. This S-dimensional vector Y is first vector-quantized. While a variety of the methods may be considered for vector quantization of the vector Y, such as straight vector quantization, shape-gain vector quantization, etc., the shape-gain vector quantization is employed in the present embodiment. The shape-gain vector quantization is described in M. J. Sabin, R. M. Gray, "Product Code Vector Quantizer for Waveform and Voice Coding," IEEE Trans. on ASSP, vol. ASSP-32, No.3, June 1984.

The result of the vector-quantized S-dimensional vector Y is assumed to be $Y_{VQ}$, which can be expressed by formula (29).

$$Y_{VQ}=(y_{VQ1}, y_{VQ2}, \ldots, y_{VQS}) \tag{29}$$

$Y_{VQ}$ can be regarded as a schematic shape or characteristic volume of the original array x(n) ($\equiv c_{dB}(n)$, $1 \leqq n \leqq M$). Accordingly, it needs relatively strong protection against transmission errors.

Then, based on the S-dimensional vector $Y_{VQ}$, the input array x(n) of the original M-dimensional vector (5 $c_{dB}(n)$) is presumed or dimensional expanded in some way or another. An error signal between the presumed value and the original input array is to be an input signal to vector quantization on the next stage. As typical methods for presumption, there are non-linear interpolation as described in A. Gersho, "Optimal Non-linear Interpolative Vector Quantization,"IEEE Trans. on Comm., vol.38, No.9, Sept. 1990, spline interpolation, multi-term interpolation, straight interpolation (first-order interpolation), 0th-order holding, etc. If excellent interpolation is performed at this stage, the region of presence of the input vector for the next-stage vector quantization is made narrower, thereby allowing quantization with less distortion. In the present embodiment, the simplest 0th-order holding, shown in FIG. 34, is employed.

If the average value-freed vectors, corresponding to S units of vectors, that is the residual vectors freed of pre-quantized average values, are indicated by $R_1, R_2, \ldots, R_S$, these vectors $R_1, R_2, \ldots, R_S$ are found by the following formula.

$$\begin{aligned} R_1 &= X_1 - y_{VQ1} I_1 & x(1) - y_{VQ1} \\ &= & x(2) - y_{VQ1} \\ \vdots & \quad \vdots & \quad \vdots \\ R_s &= X_s - y_{VQS} I_s & x(d_1) - y_{VQ1} \end{aligned} \tag{30}$$

The vector $I_i$ in the formula (30), where $1 \leqq i \leqq S$, is a unit string vector which is of the $d_i$ dimension and in which all elements are 1. FIG. 35 shows a concrete example for this case.

These residual vectors $R_1, R_2, \ldots, R_S$ are vector-quantized using separate codebooks. Although straight vector quantization is used herein for vector quantization, it is also possible to use other structured vector quantization, it is also possible to use other structured vector quantization. That is, for the following formula (31) in which the residual vectors $R_1, R_2, \ldots, R_S$ are expressed by elements, $$\begin{aligned} R_1 &= (r_1, r_2, \cdots, r_{d1})^t \\ \vdots & \quad \vdots \\ R_i &= (r_{gi+1}, \cdots, r_{gi+di})^t \end{aligned} \tag{31}$$

vector-quantized data are represented by $R_{VQ1}, R_{VQ2}, \ldots, R_{VQS}$, and in general by $R_{VQi}$.

$$R_{VQi}=(r_{VQ(gi+1)}, \ldots, r_{VQ(gi+di)})^t \tag{32}$$

These data can be regarded as the residual vector $R_i$ to which is appended a quantization error $\epsilon_i$. That is, $$r_{VQi}=R_i+\epsilon_i \tag{33}$$

That is, $$\begin{aligned} r_{VQ(gi+1)} & \quad r_{gi+1} + \epsilon_{gi+1} \\ \vdots & = \vdots \\ R_{VQ(gi+di)} & \quad r_{gi+di} + \epsilon_{gi+di} \end{aligned} \tag{34}$$

FIG. 36 shows a concrete example of the elements of the residual vectors $R_{VQ1}, R_{VQ2}, \ldots, R_{VQS}$ after the quantization.

An index output to be transferred on the encoder side is an index indicating $Y_{VQ}$ and S units of indices indicating the S units of the residual vectors $R_{VQ1}, R_{VQ2}, \ldots, R_{VQS}$. Meanwhile, in shape-gain vector quantization, an output index is represented by an index for shaping and an index for gain.

For producing a decoded value of vector quantization, the following operation is performed. After $Y_{VQ}$, $R_{VQ1}$, where $1 \leqq i \leqq S$, are obtained by table lookup from the transmitted index, the following operation is carried out. That is, $y_{VQi}$ is found from formula (29) and $X_{VQi}$ is found as follows.

$$\begin{aligned} X_{VQi} &= R_{VQ1} + y_{VQi} I_i \quad (1 \le i \le S) \\ &= R_i + \epsilon_i + y_{VQi} I_i \\ &= X_i - y_{VQi} I_i + \epsilon_i + y_{VQi} I_i \\ &= X_i - \epsilon_i \end{aligned} \tag{35}$$

Therefore, the quantization noise appearing in a decoder output is only $\epsilon_i$ generated during quantization of $R_i$. The quality of quantization of Y on the first stage is not presented directly in the ultimate noise. However, such quality affects the properties of the vector quantization of $R_{VQi}$ on the second stage, ultimately contributing to the level of the quantization noise in the decoder output.

By the hierarchical structure of the codebook of the vector quantization, it becomes possible:

(i) to reduce the number of times of multiplication and addition for codebook search;

(ii) to reduce the ROM capacity for codebook; and (iii) to make effective utilization of the hierarchical error correction codes.

A concrete example is given hereinbelow concerning the effects of (i) and (ii).

It is now assumed that M=44, S=7, $d_1=d_2=d_3=d_4=5$, and $d_5=d_6=d_7=8$. It is also assumed that the number of bits employed for quantization of the data x(n) ($\equiv c_{dB}(n)$) and $1 \leqq n \leqq M$ is 48.

If M=44-dimensional vector is vector-quantized with a 48-bit output, the table size of the codebook is $2^{48} \approx 2.81 \times 10^{14}$. This is then multiplied by a word width (=44) to give approximately $1.238 \times 10^{16}$, which is the number of words of the table required. The operation volume for table search is also a value of the order of $2^{48} \times 44$.

The following bit allocation is contemplated:

Y→13 bits (8 bits: shape, 5 bits: gain), dimension S=7

$X_1$→6 bits, dimension $d_1=5$ $X_2$→5 bits, dimension $d_2=5$ $X_3$→5 bits, dimension $d_3=5$ $X_4$→5 bits, dimension $d_4=5$ $X_5 \rightarrow 5$ bits, dimension $d_5=8$
$X_6 \rightarrow 5$ bits, dimension $d_6=8$
$X_7 \rightarrow 4$ bits, dimension $d_7=8$
total: 48 bits, (M=) 44 dimensions For the table capacity at this time, Y: shape: $7\times2^8=1792$, gain: $2^5=32$
$X_1$: $5\times2^6=320$
$X_2$: $5\times2^5=160$
$X_3$: $5\times2^5=160$
$X_4$: $5\times2^5=160$
$X_5$: $8\times2^5=256$
$X_6$: $8\times2^5=256$
$X_7$: $8\times2^4=128$ That is, a total of 3264 words is required. Since the operation volume for table search is basically of the same order of magnitude as the total of the table size, it is of the order of approximately 3264. This value is practically unobjectionable.

As for (iii), a method in which the upper 3, 3, 2, 2, 2 and 1 bits of the indices of $X_1$ to $X_7$ are protected and the lower bits are used without error correction may be employed for $X_1$ to $X_7$, for protecting the 13 bits of the quantization output indices of the first-stage vector Y by the forward error correction (FEC) such as convolution coding. More effective FEC may be applied by maintaining a relation between the binary data hamming distance indicating the index of the vector quantizer and the Euclid distance of the code vector referenced by the index, that is, by allocating the smaller hamming distance to the smaller Euclid distance of the code vector.

As is clear from the foregoing description, according to the above-mentioned high efficiency encoding method, the structured codebook is used and the M-dimensional vector data is divided into plural groups, for finding the representative value for each group, thereby lowering the M dimension to the S dimension. Then, the S-dimensional vector data are processed with the first vector quantization, and the S-dimensional code vector to be the local decoder output in the first vector quantization. The S-dimensional code vector is expanded into the original M-dimensional vector, thereby finding the data indicating the relation with the data on the frequency axis of the original M-dimensional vector, then performing the second vector quantization. Therefore, it is possible to reduce the operation volume for codebook search and the memory capacity for the codebook, and to effectively apply the error correction encoding to the upper and lower sides of the hierarchical structure.

In addition, according to another high efficiency encoding method, the data on the frequency axis is non-linearly compressed in advance, and then is vector-quantized. Thus, it is possible to realize efficient encoding and to improve the quality of quantization.

Further, according to the other high efficiency encoding method, the inter-block difference of preceding and succeeding blocks is taken for the data on the frequency axis obtained for each block, and the inter-block difference data is vector-quantized. Thus, it is possible to further reduce the quantization noise, and to improve the compression ratio.

Meanwhile, in consideration of the voiced/unvoiced degree or the pitch of the voice already being extracted as characteristic volumes in the case of the voice synthesis-analysis coding such as the above-mentioned MBE, it becomes possible to change over the codebook for vector quantization depending on these characteristic volumes, particularly, the results of the voiced/unvoiced decision. That is, the spectral shape differs significantly between the voiced sound and the unvoiced sound so that it is highly desirable to have separately trained codebooks for the respective states. In the case of the hierarchically structured vector quantization, the vector quantization for the upper-order layer may be carried out with a fixed codebook, whereas the codebook for the lower-order layer vector quantization may be changed over between the voiced and the unvoiced sounds. On the other hand, bit allocation on the frequency axis may be changed over so that the low-pitch sound is emphasized for the voiced sound and that the high-pitch sound is emphasized for the unvoiced sound. For the changeover control, the presence or absence of the pitch, proportion of the voiced sound/unvoiced sound, the level or the tilt of the spectrum, etc. can be utilized.

Meanwhile, in the case of vector quantization for quantizing plural data grouped into a vector expressed by one code instead of separately quantizing time axis data, frequency axis data and filter coefficient data in the encoding, the fixed codebook is used for vector quantization of the spectral envelope of the MBE, SBE and LPC, or parameters thereof such as LSP parameter, a parameter and k parameter. However, if the number of usable bits is reduced, that is, if the bit rate is lowered, it becomes impossible to obtain sufficient performance with the fixed codebook. Therefore, it is desirable to vector-quantize the input data which is classified by clustering so that the region of its presence in the vector space is narrowed.

It is considered that even when the transmission bit rate is sufficiently high, the structured codebook is used for reducing the operation volume for the search. In this case, it is desirable to divide the codebook into two codebooks each having an output index length of n bits, instead of using one codebook of (n+1) bits.

In view of the above-mentioned status of the art, a high efficiency encoding method, whereby it is possible to carry out efficient vector quantization in accordance with the properties of input data, to reduce the size of the codebook of the vector quantizer and the operation volume for the search, and to carry out encoding of high quality, is proposed.

The high efficiency encoding method comprises the steps of: finding data on the frequency axis as an M-dimensional vector on the basis of data obtained by dividing input audio signals such as voice signals and acoustic signals on the block-by-block basis and converting the signals into data on the frequency axis; and performing quantization, by using a vector quantizer having plural codebooks depending on states of audio signals for performing vector quantization on the data on the frequency axis of the M dimension, and by changing over and quantizing the plural codebooks in accordance with parameters indicating characteristics of the input audio signals for each block.

The other high efficiency encoding method comprises the steps of: finding data on the frequency axis as the M-dimensional vector on the basis of data obtained by dividing input audio signals on the block-by-block basis and by converting the signals into data on the frequency axis; reducing the M dimension to an S dimension, where S<M, by dividing the data on the frequency axis of the M dimension into plural groups and by finding representative values for each of the groups; performing first vector quantization on the data of the S-dimensional vector; finding a corresponding S-dimensional code vector by inversely vector-quantized the output data of the first vector quantization; expanding the S-dimensional code vector to the original M-dimensional vector; and performing quantization, by using a vector quantizer for second vector quantization having plural codebooks depending on states of the audio signals for performing second vector quantization on data indicating relations between the expanded M-dimensional vector and the data on the frequency axis of the original M-dimensional vector, and by changing over the plural codebooks in accordance with parameters indicating characteristics of the input audio signals for each block.

In vector quantization according to these high efficiency encoding methods, when a voice signal is used as the audio signal, it is possible to use plural codebooks depending on a voiced/unvoiced state of the voice signal as the codebook to use parameters indicating whether the input voice signal for each block is voice or unvoiced as the characteristics parameter. Also, it is possible to use, as the characteristics parameters, the pitch value, strength of the pitch component, proportion of voiced and unvoiced sounds, the tilt and the level of the signal spectrum, etc., and it is basically preferable to change over the codebook in accordance with whether the voice signal is voiced or unvoiced. Such characteristics parameters can be separately transmitted, while originally transmitted parameters as prescribed in advance by the encoding system can be used instead. As the data on the frequency axis of the M-dimensional vector, data converted on the block-by-block basis into data on the frequency axis and non-linearly compressed can be used. Further, before the vector quantization, an inter-block difference of data to be vector-quantized may taken so that vector quantization may be performed on the inter-block difference data.

Since quantization is performed by changing over the plural codebooks in accordance with the parameters indicating characteristics of the input audio signal for each block, it is possible to carry out effective quantization, to reduce the size of the codebook of the vector quantizer and the operation volume for the search, and to carry out encoding of high quality.

An embodiment of the high efficiency encoding method is explained with reference to the drawings hereinafter.

Figure 39:
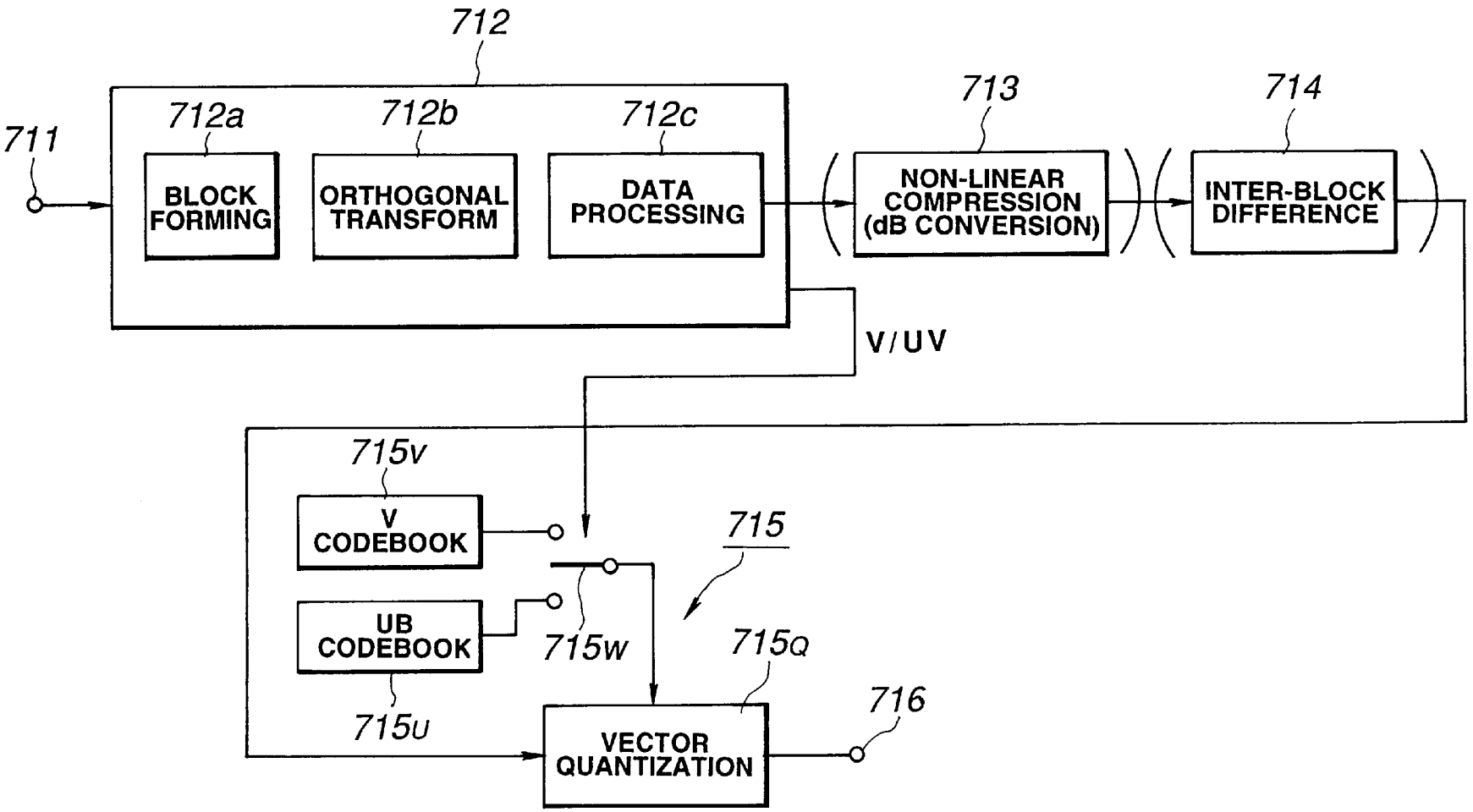
FIG. 39 is a block diagram showing a schematic arrangement of an encoder to which a high efficiency encoding method for changing over a codebook of vector quantization in accordance with input signals is applied.

FIG. 39 shows a schematic arrangement of an encoder for illustrating the high efficiency encoding method as an embodiment of the present invention.

In FIG. 39, an input signal such as a voice signal or an acoustic signal is supplied to an input terminal 711, and is then converted into spectral amplitude data on the frequency axis by a frequency axis converting section 712. Inside the frequency axis converting section 712, a block forming section 712*a* for dividing the input signal on the time axis into blocks each having a predetermined number of samples, e.g. N samples, an orthogonal transform section 712*b* for fast Fourier transform (FFT) etc., and a data processor 712*c* for finding amplitude data indicating characteristics of the spectral envelope are provided. An output from the frequency axis converting section 712 is transmitted, via an optional non-linear compressor 713 for conversion into, for instance, a dB region, and via an optional processor for taking the inter-block difference, to a vector quantization section 715. By the vector quantization section 715, a predetermined number of, e.g. M samples of, the input data are grouped as the M-dimensional vector, and are processed with vector quantization. In general, in the M-dimensional vector quantization processing, the codebook is searched for a code vector at the shortest distance from the input dimensional vector in the M-dimensional space, and the index of the code vector searched for is taken out from an output terminal 716. The vector quantization section 715 of the embodiment shown in FIG. 39 includes plural kinds of codebooks, which are changed over in accordance with characteristics of the input signal from the frequency axis converting section 712.

In the example of FIG. 39, it is assumed that the input signal is a voice signal. A voiced (V) codebook $\mathbf{715}_V$ and an unvoiced codebook $\mathbf{715}_U$ are changed over by a changeover switch $\mathbf{715}_W$, and are transmitted to a vector quantizer $\mathbf{715}_Q$. The changeover switch $\mathbf{715}_W$ is controlled in accordance with voiced/unvoiced (V/UV) decision signal from the frequency axis converting section 712. The V/UV signal or flag is a parameter to be transmitted from the analysis side (encoder) to the synthesis side (decoder) in the case of a multiband excitation (MBE) vocoder (voice analysis-synthesis device) as later described, and need not to be transmitted separately.

Referring to the example of the MBE, the V/UV decision flag as one kind of the transmitted data may be utilized for the parameter for changing over the codebooks $\mathbf{715}_V$, $\mathbf{715}_U$. That is, the frequency axis converting decision 712 carries out band division in accordance with the pitch, and makes V/UV decision for each of the divided bands. The number of V bands and the number of UV bands are assumed to be $N_V$ and $N_{UV}$, respectively. If $N_V$ and $N_{UV}$ hold the following relation with a predetermined threshold $V_{th}$, $$\frac{N_V}{N_V + N_{UV}} \geq V_{th} \tag{36}$$

the V codebook $\mathbf{715}_V$ is selected. Otherwise, the UV codebook $\mathbf{715}_U$ is selected. The threshold $V_{th}$ may be set to, for example, about 1.

Also, on the decoder (synthesis) side, the similar changeover and selection of the two kinds of V and UV codebooks are carried out. In the MBE vocoder, since the V/UV decision flag is side information to be transmitted in any case, it is not necessary to transmit separate characteristics parameters for the codebook changeover in this example, thereby causing no increase in the transmission bit rate.

Production or training of the V codebook $\mathbf{715}_V$ and the UV codebook $\mathbf{715}_U$ is made possible simply by dividing training data by the same standards. That is, it is assumed that a codebook produced from the group of amplitude data judged to be voiced (V) is the V codebook $\mathbf{715}_V$, and that a codebook produced from the group of amplitude data judged to be unvoiced (UV) is the UV codebook $\mathbf{715}_U$.

In the present example, since the V/UV information is used for the change over of the codebook, it is necessary to secure the V/UV flag, that is, to have high reliability of the V/UV flag. For example, in a section clearly regarded as a consonant or a background noise, all the bands should be UV. As an example of the above decision, it is noted that minute inputs of high power are made UV in the high frequency range.

The fast Fourier transform (FFT) is performed on the N points of the input signal (256 samples), and power calculation is carried out in each of the sections of 0 to N/4 and N/4 to N/2, between effective 0 to π (0 to N/2).

$$P_L = \sum_{i=0}^{(N/4)-1} \mathrm{rms}^2(i) \tag{37}$$

$$P_H = \sum_{i=N/4}^{(N/2)-1} \mathrm{rms}^2(i)$$

where rms(i) is $$\sqrt{\mathrm{Re}^2(i)+\mathrm{Im}^2(i)}$$

with Re(i) and Im(i) being the real part and imaginary part of FFT of the input progression, respectively. Using $P_L$ and $P_H$ of the formula (37), the following formula is created.

$$R_d = \frac{P_L}{P_H} \tag{38}$$

$$L = \sqrt{\frac{P_L + P_H}{N/2}}$$

When $Rd<R_{th}$ and $L<L_{th}$, all the bands are unconditionally made UV.

This operation has effects of avoiding the use of a wrong pitch detected in the minute input. In this manner, production of a secure V/UV flag in advance is convenient for the changeover of the codebook in vector quantization.

Next, the training in producing the V and UV codebooks is explained with reference to FIG. 40.

Figure 40:
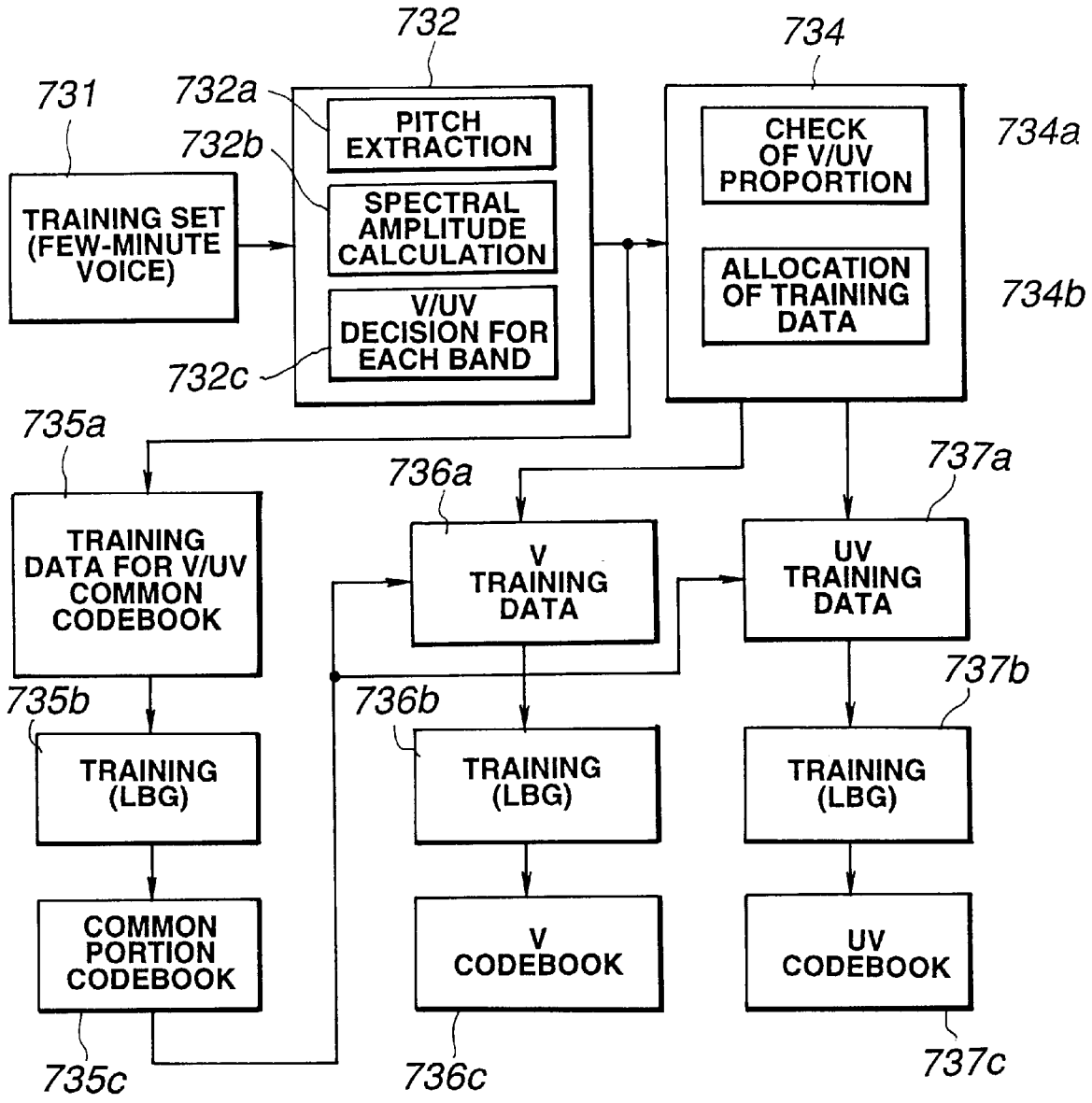
FIG. 40 is a diagram for explaining a forming or training method of the codebook.

In FIG. 40, a signal from a training set 731 consisting of a training voice signal for several minutes is sent to a frequency axis converting section 732, where pitch extraction is carried out by a pitch extraction section 732*a*, and calculation of the spectral amplitude is carried out by a spectral amplitude calculating section 732*b*. Also, V/UV decision is made for each band by a V/UV decision section 732*c* for each band. Output data from teh frequency axis converting section 732 is transmitted to a pre-training processing section 734.

In the pre-training processing section 734, conditions of the formulas (36) and (38) are checked by a checking section 734*a*, and in accordance with the resulting V/UV information, the spectral amplitude data is allocated by a training data allocating section 734*b*. The amplitude data is transmitted to a V training data output section 736*a* for voiced (V) sounds, and to a UV training data output section 737*a* for unvoiced (UV) sounds.

The V spectral amplitude data outputted from the V training data output section 736*a* is sent to a training processor 736*b*, where training processing is carried out by e.g. the LBG method, thereby producing a V codebook 736*c*. The LBG method is a training method for the codebook in algorithm for designing a vector quantizer, proposed in Linde, Y., Buzo, A. and Gray, R. M., "An Algorithm for Vector Quantizer Design," IEEE Trans. Comm., COM-28, January 1980, pp.84–95. This LBG method is to design a locally optimum vector quantizer by using a so-called training chain for an information source with the probability density function being unknown. Similarly, the UV spectral amplitude data outputted from the UV training data output section 737*a* is sent to a training processor 737*c*, where training processing is carried out by, for example, the LBG method, thereby producing a UV codebook 737*c*.

If the vector quantization section has a hierarchical structure in which a codebook of a portion for V/UV common use is used for the upper layer while only the codebook for the lower layer is changed over in accordance with V/UV, as later to be described, it is necessary to produce the codebook of a portion for V/UV common use. In this case, it is necessary to send the output data from the frequency axis converting section 732 to a training data output section 735*a* for codebook of V/UV common use portion.

The spectral amplitude data outputted from the training data output section 735*a* for codebook of V/UV common use portion is sent to a training processor 735*b*, where training processing is carried out by, for example, the LBG method, thereby producing a V/UV common use codebook 735*c*. It is necessary to send the code vector from the produced V/UV common use codebook 735*c* to the V training data output section 736*a* and to the UV training data output section 737*a*, to carry out vector quantization for the upper layer on the V and UV training data by using the V/UV common use codebook, and to produce V and UV training data for the lower layer.

A concrete arrangement and operation of the hierarchically structured vector quantization unit are explained with reference to FIG. 41 and FIGS. 31 to 36. The vector quantization unit 715 shown in FIG. 41 is hierarchically structured to have two layers, e.g. upper and lower layers, in which two-stage vector quantization is carried out on the input vector, as explained with reference to FIGS. 31 to 36.

Figure 41:
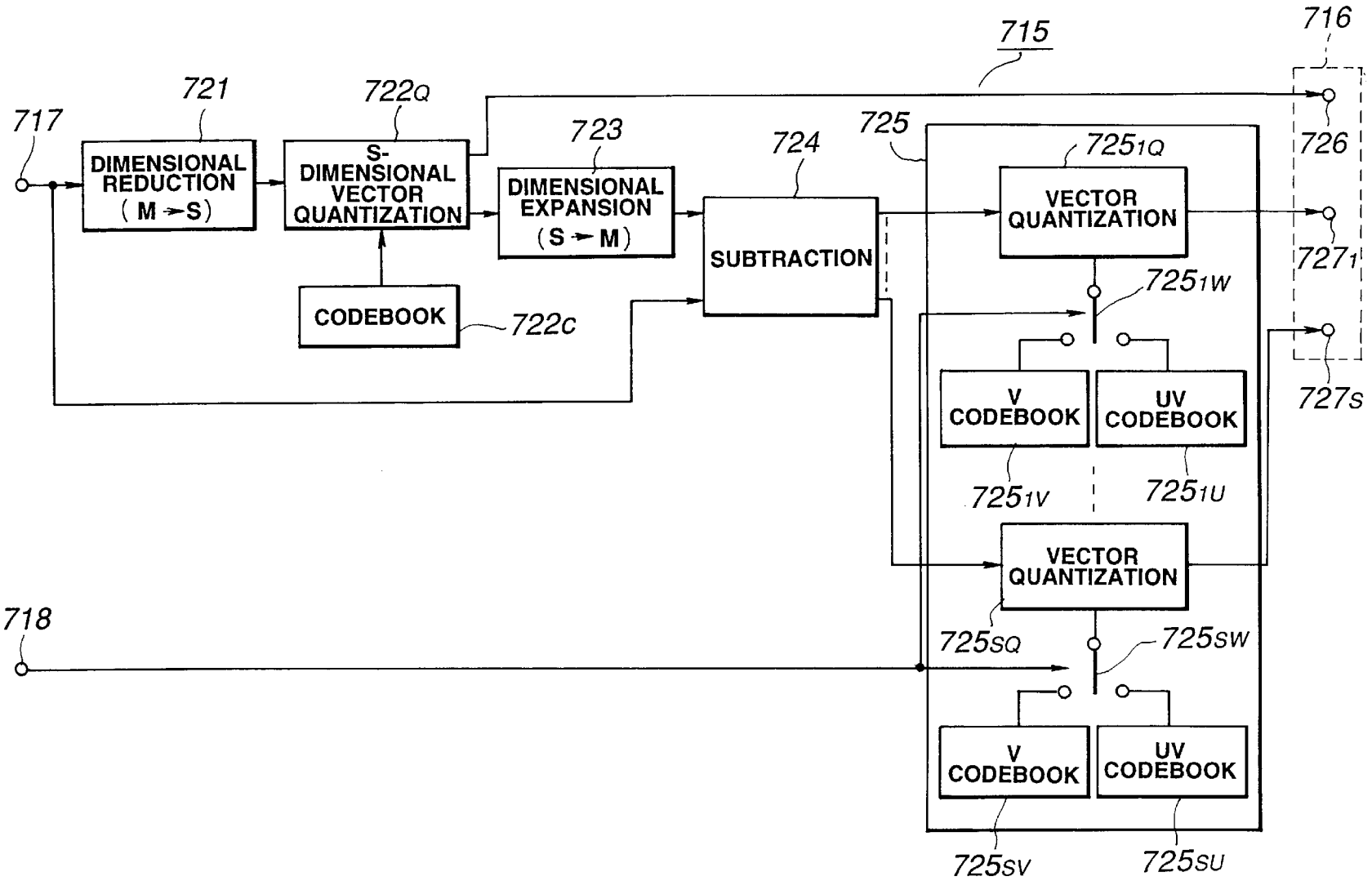
FIG. 41 is a block diagram showing a schematic arrangement of essential portions of an encoder for explaining another example of the high efficiency encoding method for changing over the codebook.
Figure 42:
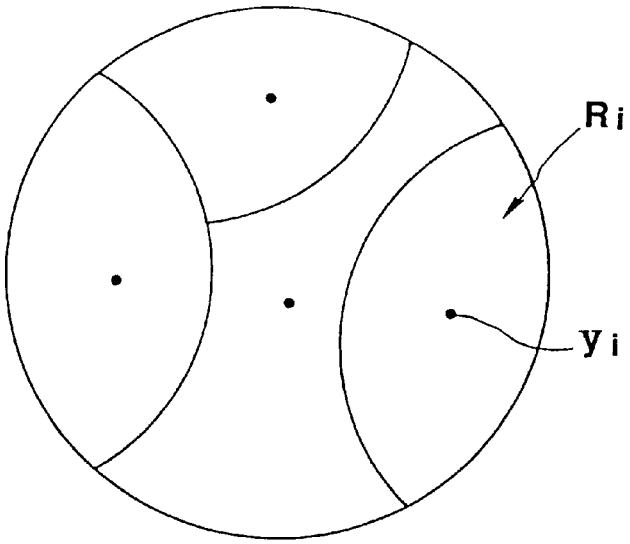
FIG. 42 is a schematic view for explaining a conventional vector quantizer.

The amplitude data on the frequency axis from the frequency axis converting section 712 of FIG. 39 is supplied, via the optional non-linear compressor 713 and the optional inter-block difference processing section 714, to an input terminal 717 of the vector quantization unit 715 shown in FIG. 41, as the M-dimensional vector to be the unit for vector quantization. The M-dimensional vector is transmitted to a dimension reduction section 721, where it is divided into plural groups and the dimension there of is reduced to an S dimension (S<M) by finding the representative value for each of the groups, as shown in FIGS. 31 and 32.

Next, the S-dimensional vector is processed with vector quantization by an S-dimensional vector quantizer $\mathbf{722}_Q$. That is, among the S-dimensional code vectors in a codebook $\mathbf{722}_C$ of the S-dimensional vector quantizer $\mathbf{722}_Q$, the codebook is searched for the code vector of the shortest distance from the input S-dimensional vector in the S-dimensional space, and the index data of the searched code vector is taken out from an output terminal 726. The searched code vector (a code vector obtained by inversely vector-quantizing the output index) is sent to a dimension expanding section 723. For the codebook $\mathbf{722}_C$, the V/UV common use codebook $\mathbf{735}_C$ explained in FIG. 40 is used, as shown in FIG. 33. The dimension expanding section 723 expands the S-dimensional code vector to the original M-dimensional vector, as shown in FIG. 34.

In the example of FIG. 41, the expanded M-dimensional vector data from the dimension expanding section 723 to a subtractor 724, where S units of vectors, indicating relations between the M-dimensional vector expanded from the S-dimensional vector and the original M-dimensional vector, are produced by subtracting from the data on the frequency axis of the original M-dimensional vector, as shown in FIG. 35.

The S vectors thus obtained from the subtractor 724 are each processed with vector quantization, respectively, by S units of vector quantizers $\mathbf{725}_{1Q}$ to $\mathbf{725}_{SQ}$ of a vector quantizer group 725. Indices outputted from the vector quantizers $\mathbf{725}_{1Q}$ to $\mathbf{725}_{SQ}$ are taken out from output terminals $\mathbf{727}_{1Q}$ to $\mathbf{727}_{SQ}$, respectively, as shown in FIG. 36.

For the vector quantizers $\mathbf{725}_{1Q}$ to $\mathbf{725}_{SQ}$, V codebooks $\mathbf{725}_{1V}$ to $\mathbf{725}_{SV}$ and UV codebooks $\mathbf{725}_{1U}$ to $\mathbf{725}_{SU}$ are used, respectively. These V codebooks $\mathbf{725}_{1V}$ to $\mathbf{725}_{SV}$ and UV codebooks $\mathbf{725}_{1U}$ to $\mathbf{725}_{SU}$ are changed over to be selected by changeover switches $\mathbf{725}_{1W}$ to $\mathbf{725}_{SW}$ controlled in accordance with V/UV information from an input terminal 718. These changeover switches $\mathbf{725}_{1W}$ to $\mathbf{725}_{SW}$ may be controlled for changeover simultaneously or interlockingly for all the bands. However, in consideration of the different frequency bands of the vector quantizers $\mathbf{725}_{1Q}$ to $\mathbf{725}_{SQ}$, the changeover switches $725_{1W}$ to $725_{SW}$ may be controlled for changeover in accordance with V/UV flag for each band. It is a matter of course that the V codebooks $725_{1V}$ to $725_{SV}$ correspond to the V codebook 736*c* in FIG. 40 and that the UV codebooks $725_{1U}$ to $725_{SU}$ correspond to the UV codebook 737*c*.

By carrying out the hierarchically structured two-stage vector quantization, it becomes possible to reduce the operation volume for the codebook search and to reduce the memory volume (e.g. ROM capacity) for the codebook. Also, by carrying out error correction coding on a more important index on the upper layer obtained from the output terminal 726, it becomes possible to adopt the error correction code effectively. Meanwhile, the hierarchical structure of the vector quantization unit 715 is not limited to the two stage, but may be a multi-layer structure of three or more stages.

Each portion of FIGS. 39 to 41 need not to be constituted all by hardware, but may be realized with software using, for example, a digital signal processor (DSP).

As described above, in the case of the voice synthesis-analysis encoding, for example, in consideration of the voiced/unvoiced degree and the pitch being extracted in advance as the characteristics volumes, good vector quantization can be realized by changing over the codebook in accordance with the characteristics volumes, particularly the result of the voiced/unvoiced decision. That is, the shape of the spectrum differs greatly between the voiced sound and the unvoiced sound, and thus it is highly preferable, in terms of improvement of characteristics, to have the codebooks separately trained in accordance with the respective states. Also, in the case of hierarchically structured vector quantization, a fixed codebook may be used for vector quantization on the upper layer while changeover of two codebooks, that is, voiced and unvoiced codebooks, may be used only for the vector quantization on the lower layer. Also, in bit allocation on the frequency axis, the codebook may be changed so that the low-tone sound is emphasized for the voiced sound while the high-tone sound is emphasized for the unvoiced sound. For the changeover control, the presence or absence of the pitch, the voiced/unvoiced proportion, the level and tilt of the spectrum, etc. can be utilized. Further, three or more codebooks may be changed over. For instance, two or more unvoiced codebooks may be used for consonants and for background noises, etc.

Next, a concrete example of the vector quantization method in which quantization is carried out by grouping the waveform of the sound and the plural sample values of the spectral envelope parameters into a vector expressed by one code is explained.

The above-mentioned vector quantization is to carry out mapping Q from an input vector X present in a k-dimensional Euclid space $R^k$ to an output vector y. The output vector y is selected from a group of N units of reproduction vectors, $Y=\{y_1, y_2, \ldots, y_N\}$. That is, the output vector y can be expressed by $$y=Q(X) \tag{39}$$

where $y \epsilon Y$. The set Y is called the codebook, having N units (level) of code vectors $y_1, Y_2, \ldots, y_N$. This N is called the codebook size.

For example, an N-level k-dimensional vector quantizer has a partial space of the input space consisting of N units of regions or cells. The N cells are expressed by $\{R_1, R_2, \ldots, R_N\}$. The cell $R_i$, for example, is a set of input vector X selecting $y_i$ as the representative vector, and can be expressed by, $$R_i=Q^{-1}(y_i)=\{x\ R^k:Q(X)=y_i\} \tag{40}$$

where $1 \leqq i < N$.

The sum of all the divided cells corresponds to the original k-dimensional Euclid space $R^k$, and these cells have no overlapped portion. This is expressed by the following formula.

$$\bigcup_{i=1}^{N} = R^k,\ R_i \cap R_j = 0, \quad \text{for } i \neq j \tag{41}$$

Accordingly, the cell division $\{R_i\}$ corresponding to the output set Y determines the vector quantizer Q.

It is possible to consider that the vector quantizer is divided into a coder C and decoder De. The coder C carries out the mapping of the input vector X to an index i. The index i is selected from a set of N units, $I=\{1, 2, \ldots, N\}$, and expressed by $$i=C(X) \tag{42}$$

where $i \epsilon I$.

The decoder De carries out the mapping of the index i to a corresponding reproduction vector (output vector) $y_i$. The reproduction vector $y_i$ is selected from the codebook Y. This is expressed by $$y_i=De(i) \tag{43}$$

where $y_i \epsilon Y$.

The operation of the vector quantizer is that of the combination of the coder C and the decoder De, and can be expressed by the formulas (39), (40), (41), (42) and (43), and the following formula (44).

$$y=Q(X)=De(i)=De(C(X)) \tag{44}$$

The index i is a binary number, and the bit rate Bt as the transmission rate of the vector quantizer and the resolution of the vector quantizer b are expressed by the following formulas.

$$Bt=\log_2 N(\text{bit/vector}) \tag{45}$$

$$b=Bt/k(\text{bit/sample}) \tag{46}$$

Next, a distortion measure as the evaluation scale of an error is explained.

The distortion measure d (X, y) is a scale indicating the degree of discrepancy (error) between the input vector X and the output vector y. The distortion measure d (X, y) is expressed by $$d(X, y) = \|X, y\|^2 = (X-y)^t(X-y) = \sum_{i=1}^{k} (X_i - y_i)^2 \tag{47}$$

where $X_i$, $y_i$ are the i'th elements of the vectors X, y, respectively.

That is, performance of the vector quantizer is defined by the total average distortion given by $$Da=E[d(X, y)] \tag{48}$$

where E is the expectation value.

Normally, the formula (48) indicates the average value of a number of samples, and can be expressed by $$Da = \lim_{M \to \infty} 1/M \sum_{n=1}^{M} d(X_n, y_n) \quad (49)$$

where $\{X_n\}$ is an input vector array, with $y_n$=Q ($X_n$). M is the number of samples.

Next, the LBG algorithm used for production of the codebook of the vector quantizer is explained.

Originally, it is difficult to perform concrete design the codebook of the vector quantizer without knowing the distortion measure and the probability density function (PDF) of the input data. However, the use of training data makes it possible to design the codebook of the vector quantizer without the PDF. For example, with the dimension k, the codebook size N and the training data x(n) being determined, it is possible to produce the optimum codebook from these elements. This method is an algorithm called the LBG method. That is, on the assumption that training data of all kinds of size express the PDF of the voice, it is possible to produce codebook of the vector quantizer by optimization for the training data.

The characteristics of the LBG algorithm consists of repeat of the nearest-neighbor condition (optimum division condition) for division and the centroid condition (representative point condition) for determining a representative point. That is, the LBG algorithm focuses on how to determine the division and the representative point. The optimum division condition means the condition for the optimum coder at the time when the decoder is provided. The representative point condition means the condition for the optimum decoder at the time when the coder is provided.

Under the optimum division condition, the cell $R_j$ is expressed by the following formula, when the representative point is provided.

$$R_j = \{X : d(X, y_j) \le d(X, y_i) \text{ for all } i \ne j, i, j \in I\} \quad (50)$$

In the formula (50), the j'th cell R is a set of input signal X such that the j'th representative $y_i$ is the nearest. In short, the set of input X such as to seek the nearest representative point when the input signal is provided determines the space $R_j$ constituting the representative point. In other words, this is an operation for selecting the code vector closest to the present input in the codebook, that is, the operation of the vector quantizer or the operation of the coder itself.

If the decoder is determined as described above, the optimum coder such as to give the minimum distortion can be found. The coder C becomes $$C(X)=j \text{ iff } d(X, y_j) \le d(X, y_i) \text{ for all } i \in I \quad (51)$$

where iff means "as long as . . . . " This means that the index j is outputted when the distance between the input signal X and $y_j$ is shorter than the distance from any $y_i$. That is, it is the optimum coder that finds the nearest representative point and outputs the index thereof.

The representative point condition is a condition under which when a space $R_i$ is determined, that is, when the coder is decided, the optimum vector $y_1$ is the center of gravity in the space of the i'th cell $R_i$, and the center of gravity is assumed to be the representative vector. This $y_1$ is indicated as follows.

$$y_1 = \text{cent } (R_i) \in R_i \quad (52)$$

However, the center of gravity of $R_i$, that is, cent ($R_i$) is defined as follows.

$$y_c = \text{cent } (R_i) \text{ if } E[d(X, y_c) \mid X \in R_i] \le E[d(X, y) \mid X \in R_i] \text{ for all } y \in R_i \quad (53)$$

This formula (53) indicates that $y_c$ becomes the representative point in the space $R_i$ when the expectation value of distortion between the input signal X within the space and $y_c$ is minimized. The optimum code vector $y_i$ minimizes the distortion in the space $R_i$. Accordingly, if the coder is decided, the optimal decoder is to output the representative point of the space and can be expressed by the following formula (54).

$$De(i) = \text{cent } (R_i) \quad (54)$$

Normally, the average value (weighted average value or simple average) of the input vector X is assumed to be the representative point.

Figure 43:
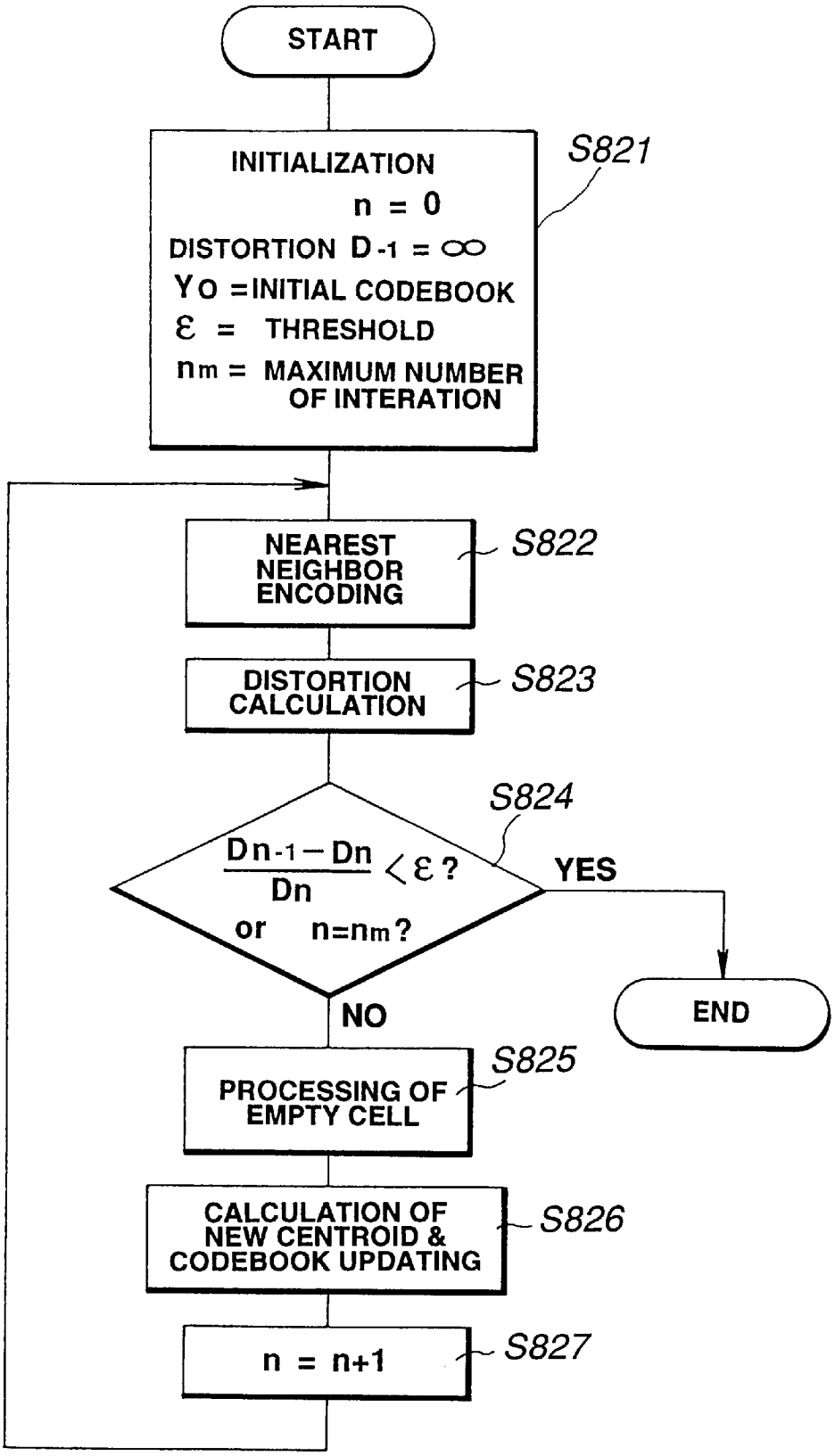
FIG. 43 is a flowchart for explaining LBG algorithm.

When the nearest neighbor condition and the representative point condition for determining the division and the representative point, respectively, are decided, the LBG algorithm is implemented according to a flowchart shown in FIG. 43.

First, at step S821, initialization is carried out. Specifically, the distortion $D_{-1}$ is set to infinity, and the number of iteration n is set to "0" (n=0). Also, $Y_0$, $\epsilon$, and $n_m$ are defined as the initial codebook, the threshold, and the maximum number of iteration, respectively.

At step S822, with the initial codebook $Y_0$ provided at step S821, the training data are encoded under the nearest neighbor condition. In short, the initial codebook is processed with mapping.

At step 823, distortion calculation for calculating the square sum of the distance between the input data and the output data is carried out.

At step S824, whether the reduction rate of distortion found from the previous distortion $D_{n-1}$ and the present distortion $D_n$ found at step S823 is smaller than the threshold value $\epsilon$, or whether the number of iteration n has reached the maximum number of iteration $n_m$ which is decided in advance, is judged. If YES is selected the implementation of the LBG algorithm ends, and if NO is selected the operation proceeds to the next step S825.

The step S825 is to avoid the code vector with the input data being not processed with mapping at all which is created in case an improper initial codebook is set at step S821. Normally, the code vector with the input data being not mapped at all is moved to the vicinity of a cell having the greatest distortion.

At step S826, a new center of gravity is found by calculation. Specifically, the average value of the training data present in the provided cell is calculated to be a new code vector, which is then updated.

The operation proceeding to step S827 returns to step S822, and this flow of operation is repeated until YES is selected at step S824.

It is found that the above-mentioned flow converges the LBG algorithm in a direction of diminishing the distortion between the input and the output, for suspending the operation at a certain stage.

Meanwhile, in the trained vector quantizer, the conventional LBG algorithm has given no relation between the Euclid distance of the code vector and the hamming distance of the index thereof. Therefore, there are fears that an irrelevant codebook might be selected because of code errors in the transmission path.

On the other hand, though a setting method for vector quantization in consideration of the code error in the transmission path is proposed, it has a drawback such as deterioration of characteristics in the absence of errors.

Thus, in view of the above-described status of the art, a vector quantization method which has strength against the transmission path errors without causing deterioration of characteristics in the absence of the errors is proposed.

According to the first aspect of the present invention, there is provided a vector quantization method for searching a codebook consisting of plural M-dimensional code vectors with M units of data as M vectors and for outputting an index of a codebook searched for, the method comprising having coincident size relations of a distance between code vectors in the codebook and a hamming distance with the index being expressed in a binary manner.

According to the second aspect of the present invention, there is also provided the vector quantization method for searching a codebook consisting of plural M-dimensional code vectors with M units of data as M vectors and for outputting an index of a codebook searched for, wherein part of bits of binary data expressing the index is protected with an error correction code, and size relations of a hamming distance between remaining bits and a distance between code victors in the codebook coincide with each other.

According to the third aspect of the present invention, there is further provided the vector quantization method, wherein a distance found by weighting with a weighted matrix used for defining distortion measure is used as a distance between the code vectors.

With the vector quantization method of the first aspect of the present invention, by having coincident size relations of a distance between code vectors in the codebook consisting of the plural M-dimensional code vectors with M units of data as the M-dimensional vectors and a hamming distance with the index, of the searched code vector, being expressed in a binary manner, it is possible to prevent effects of the code error in the transmission path.

With the vector quantization method of the second aspect of the present invention, by protecting part of bits of binary data expressing the index of the searched code vector with an error correction code, and by having the coincident size relations of a hamming distance between remaining bits and a distance between code vectors in the codebook, it is possible to prevent the effects of the code error in the transmission path.

With the vector quantization method of the third aspect of the present invention, using, as a distance between the code vectors, a distance found by weighting with a weighted matrix used for defining distortion measure, it is possible to prevent the effects of the code error in the transmission path without causing characteristics deterioration in the absence of the error.

Preferred embodiments of the above-described vector quantization method are explained hereinafter, with reference to the drawings.

The vector quantization method of the first aspect of the present invention is a vector quantization method which has the coincident size relations of the distance between code vectors in the codebook and the hamming distance with the index being expressed in a binary manner, and which is strong against the transmission error.

Meanwhile, production of a general initial codebook as a basis for the above-mentioned codebook is explained.

With the above-mentioned LBG, the centers of gravity in cells are only minutely arranged to be optimized, but are not changed in the relative positional relations. Therefore, the quality of the codebook produced on the basis of the initial codebook is determined under the influence of the method of producing the initial codebook. In this first example, splitting algorithm is used for production of the initial codebook.

First, in the production of the initial codebook using the splitting algorithm, the representative point of all training data is found from the average of all the training data. Then, the representative point is given a small lag to produce two representative points. The LBG is carried out, and then, the two representative points are divided with a small lag into four representative points. As the conversion of the LBG is repeated a number of times, the number of representative points in increased in such a manner as 2, 4, 8, . . . , $2^n$. This operation is expressed by the following formula (55)

$$y_{(N/2)+i}=\text{modify}\ (y_i, L) \tag{55}$$

where $1 \leqq i \leqq N/2$, with L indicating the L'th element.

Accordingly, the production of the initial codebook using the splitting algorithm is a method of obtaining an N-level initial codebook by the formula (55) from the code vector $Y=\{y_1, y_2, \ldots, y_{N/2}\}$ of an N/2-level vector quantizer.

The right side of the formula (55), modify ($y_i$, L) means that the L'th element of ($y_1, y_2, \ldots, y_L, y_k$) is modified, and can be expressed by ($y_1, y_2, \ldots, y_L+\epsilon_0, y_k$). That is, modify ($y_i$, L) is a function for shifting the L'th element of the code vector $y_i$ by a small amount $\epsilon_0$ (or, in other words, adding modification of $+\epsilon_0$ to the L'th element of the code vector $y_i$).

Then, the modified code vector $Y_L+\epsilon_0$ as a new start code vector is processed with training by the LBG, and is divided.

In the production of the initial codebook using the splitting algorithm, the later the division is, the shorter the Euclid distance is. The first example is realized by utilizing the above-mentioned characteristics, which is explained hereinafter with reference to FIG. 44.

FIG.44 shows a series of states in which one representative point found from the average of training data in one cell becomes 8 representative points in an 8-divided cell by repeating conversion of the LBG. FIGS. 44A to 44D show the change and direction of the division, such as one representative point in FIG. 44A, two in FIG. 44B, four in FIG. 44C and eight in FIG. 44D.

Figure 44A:
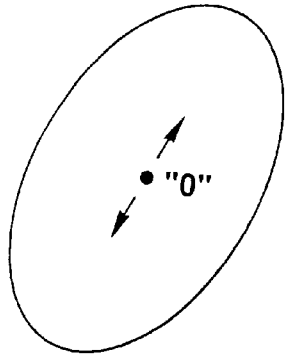
FIG. 44 is a schematic view for explaining a first example of a vector quantization method.
Figure 44B:
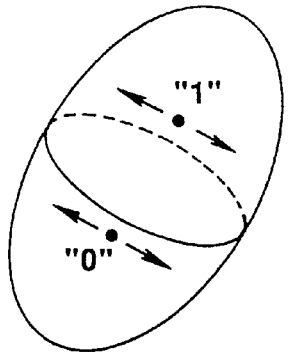
Figure 44C:
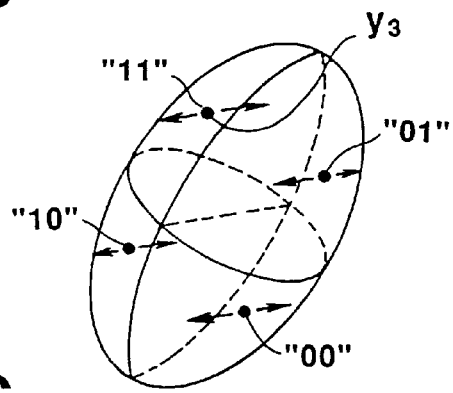
Figure 44D:
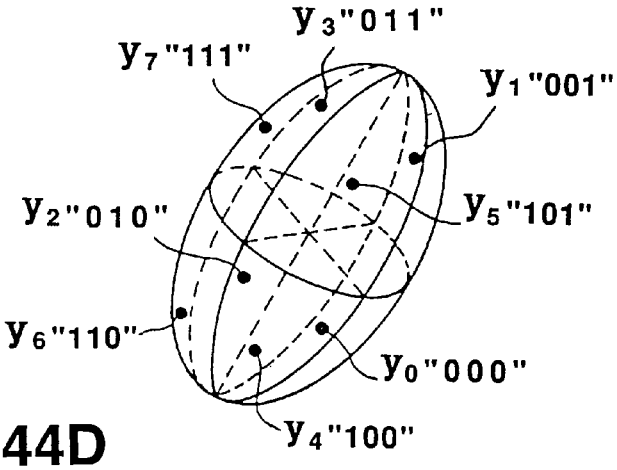

The representative points $y_3$ and $y_7$ in FIG. 44D are produced by dividing $Y'_3$ in FIG. 44C. $y_3$ is "11" in the binary expression, and $y_3$ and $y_7$ are "011" and "111", respectively in the binary expression. This indicates that the difference between $y_{(N/2)+i}$ and $y_i$ is only the polarity (1 or 0) of the MBS (uppermost digit) of the index. Accordingly, the distance between the code vectors of $y_{(N/2)+i}$ and $y_i$ is quite short. In other words, as the division proceeds, the distance of movement of the code vector due to the division is reduced. This means that the correct lower bit can overcome even a wrong upper bit of the index. Therefore, the effect of the wrong upper bit of the index becomes relatively insignificant.

Since it is convenient, in terms of later processing, to emphasize the upper bit, the MSB and LSB (lowermost digit) in the bit array of the index of the codebook expressed in the binary manner are replaced with each other. Table 1 shows the eight indices along with the code vectors of FIG. 44D, and Table 2 shows the replacement of the MSB and LSB with each other in the bit array of the index with the code vectors constant.

TABLE 1

| index | | |
|---|---|---|
| binary number | decimal number | code vector |
| 000 | 0 | $y_0$ |
| 001 | 1 | $y_1$ |
| 010 | 2 | $y_2$ |
| 011 | 3 | $y_3$ |
| 100 | 4 | $y_4$ |
| 101 | 5 | $y_5$ |
| 110 | 6 | $y_6$ |
| 111 | 7 | $y_7$ |

TABLE 2

| index | | |
|---|---|---|
| binary number | decimal number | code vector |
| 000 | 0 | $y_0$ |
| 001 | 4 | $y_1$ |
| 010 | 2 | $y_2$ |
| 011 | 6 | $y_3$ |
| 100 | 1 | $y_4$ |
| 101 | 5 | $y_5$ |
| 110 | 3 | $y_6$ |
| 111 | 7 | $y_7$ |

In Table 2, the code vectors $y_3$ and $y_7$ correspond to "6" and "7", respectively, in the decimal expression, and the code vectors $y_0$ and $y_4$ correspond to "0" and "1". The code vectors $y_3$, $y_7$ and the code vectors $y_0$, $y_4$ are pairs of nearest code vectors, as seen in FIG. 44D.

Accordingly, the difference between "0" and "1" of the LSB of the index in the binary expression is the difference between "0" and "1", "2" and "3", "4"and "5", and "6" and "7". For example, even if "110" is mistaken for "111", the code vector $y_3$ is only mistaken for $y_7$. Also, even if "000" is mistaken for "001", the code vector $y_0$ is mistaken for $y_4$. These pairs of code vectors are the pairs of nearest code vectors in FIG. 44D. In short, even with a mistake on the LSB side of the indices, the error in the distance of code vectors corresponding to the indices is small.

In the binary data of the index, the hamming distance on the LSB side is given a coincident size relation with the distance between the code vectors. Accordingly, only by protecting the MSB side alone of the binary data of the index with the error correction code, it becomes possible to control the effect of the error in the transmission path to the minimum.

Next, an example of the vector quantization method of the second aspect of the present invention is explained.

The vector quantization method of the second aspect of the present invention is a method in which the hamming distance is taken into account at the time of training the vector quantizer.

Figure 45:
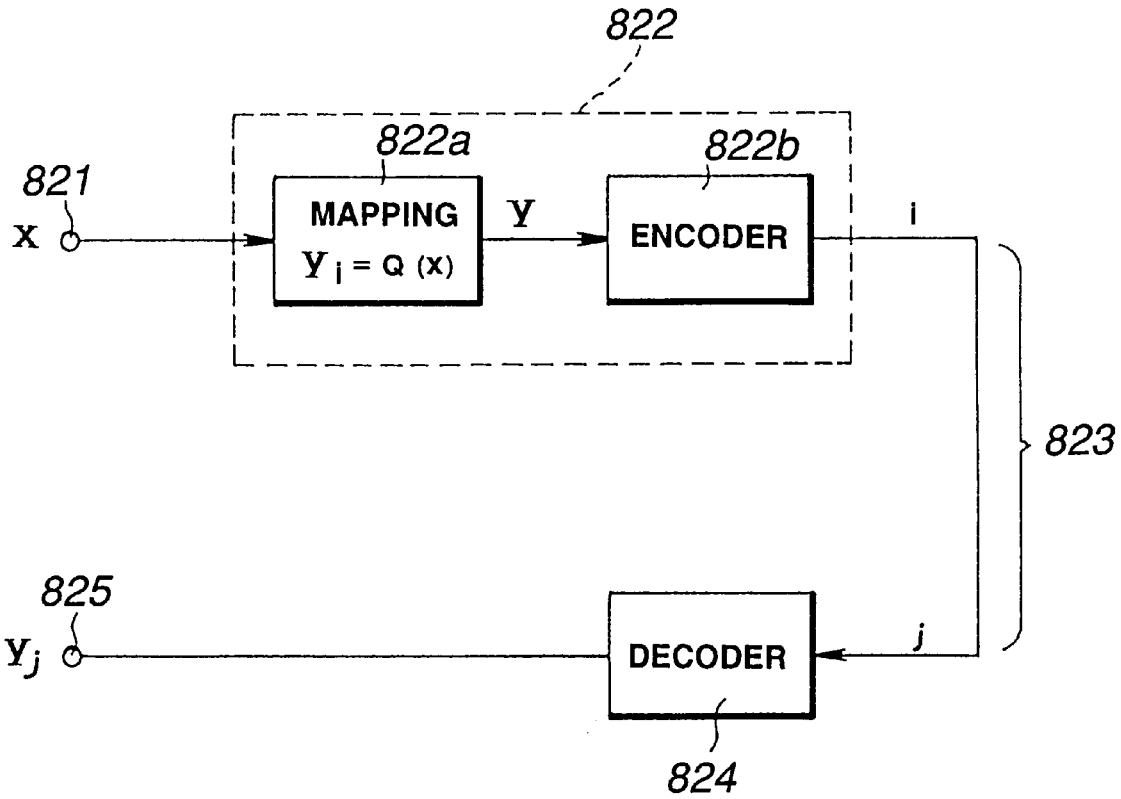
FIG. 45 is a diagram for explaining communications mistakes in a general communications system used for explaining a second example of the vector quantization method.

First, prior to the explanation of the vector quantization method of the second aspect, a vector quantization method wherein the vector quantizer is matched with a communications path, and wherein a communication system shown in FIG. 45 in consideration of communication errors is used, thus causing deterioration of characteristics in the absence of errors, is explained.

In the communication system shown in FIG. 45, an input vector X inputted to a vector quantizer 822 from an input terminal 821 is processed with mapping by a mapping section 822*a* to output $y_i$. The index i is transmitted as binary data from an encoder 822*b* to a decoder 824 via a communication path 823. The decoder 824 inversely quantizes the transmitted index, and outputs data from an output terminal 825. The probability that the index i changes into j during by the time when an error is added to the index i through the communication path 823 and when the index i with the error is supplied to the decoder 824 is assumed to be the probability P (j|i). That is, the probability P (j|i) is the probability that the transmission index i is received as the receiving index j. In a binary symmetrical communication path (binary data communication path) in which the bit error rate is e, the probability P (j|i) can be expressed by $$P(j|i)=e^{d_{ij}}(1-e)^{s-d_{ij}} \tag{56}$$

where $d_{ij}$ indicates the hamming distance with the transmission index i and the receiving index j in the binary expression, and S indicates the number of digits (number of bits) with the transmission index i and the receiving index j in the binary expression.

Under the condition that the communication path error is generated with the probability P (j|i) shown by the formula (56), the optimum centroid (representative point) $y_u$ at the time when the cell division $\{R_i\}$ is provided is expressed as follows.

$$y_u = \frac{\sum_{i=1}^{N} P(u \mid i) \sum_{j:x_{Ri}} X_j}{\sum_{i=1}^{N} P(u \mid i)|R_i|} \tag{57}$$

In the formula (57), $|R_i|$ indicates the number of training vectors in the partial space $R_i$. Normally, a representative point is the average found by the sum of training vectors X in a partial space divided by the number of the training vectors X. However, in the formula (57), the weighted average is found, which is produced by weighting, with the error probability of P (u|i), the sum of the average of the training vectors X in all the partial spaces. Accordingly, the formula (57) can be said to express the weighted average in the centroid weighted with the probability of the transmission index i changing into the receiving index u.

The optimum division $R_u$ at the time when a codebook $\{y_i: i=1, 2, \ldots, N\}$ can be expressed by the following formula.

$$R_u = \left\{ X : \sum_{j=1}^{N} P(j \mid u) d(X, y_j) \le \sum_{j=1}^{N} P(j \mid i) d(X, y_j) \text{forall } i \ne u \right\} \tag{58}$$

In short, the formula (58) expresses a partial space formed by a set of input vectors X selecting an index u with the minimum weighted average of distortion measures d (X, $y_j$) taken with the probability that the index u outputted by the encoder changes into j in the transmission path. At this time, the optimum division condition can be expressed as follows.

$$C(X) = U \text{iff} \sum^{N} P(j \mid u) d(X, y_j) \le \sum_{j=1}^{N} P(j \mid i) d(X, y_j) \text{forall } i \in I \tag{59}$$

As is described above, the optimum codebook for the bit error rate is produced. However, since this is a codebook produced in consideration of the bit error rate, characteristics in the absence of the error is deteriorated more than in the conventional vector quantization method.

Thus, the present inventor has considered a vector quantization method, as the second embodiment of the vector quantization method, which takes account of the hamming distance in the training of the vector quantizer and does not cause deterioration of characteristics in the absence of the error.

Specifically, the bit error rate e is set to 0.5, a value of no reliability in the communication path. In short, both P (u|i) and P (i|u) are set to be constant. This makes an unstable state in which where the cell is moved to is unknown. In order to avoid this unstable state, it is most preferable to output the center point of the cell on the decoder side. This means that in the formula (57) $y_u$ is concentrated on one point (the centroid of the entire training set). On the encoder side, all input vectors X are processed with mapping to the same code vector, as shown by the formula (59). In short, the codebook is in a state of a high energy level for any transformation.

If the bit error rate e is gradually reduced from 0.5 to 0, thereby gradually fixing the structure to reduce the bit error rate ultimately to 0, a partial space such as to cover the entire base training data X can be created. That is, the effect of the hamming distance of the indices of the adjacent cells in the LBG training process is reflected through P (i|j). Particularly, at the representative point indicated by the formula (57), the updating thereof is influenced by the representative point of another cell while weighting is carried out in accordance with the hamming distance. In this manner, the process of gradually reducing the error rate from 0.5 to 0 corresponds to a process of cooling by gradual removal of heat.

Figure 46:
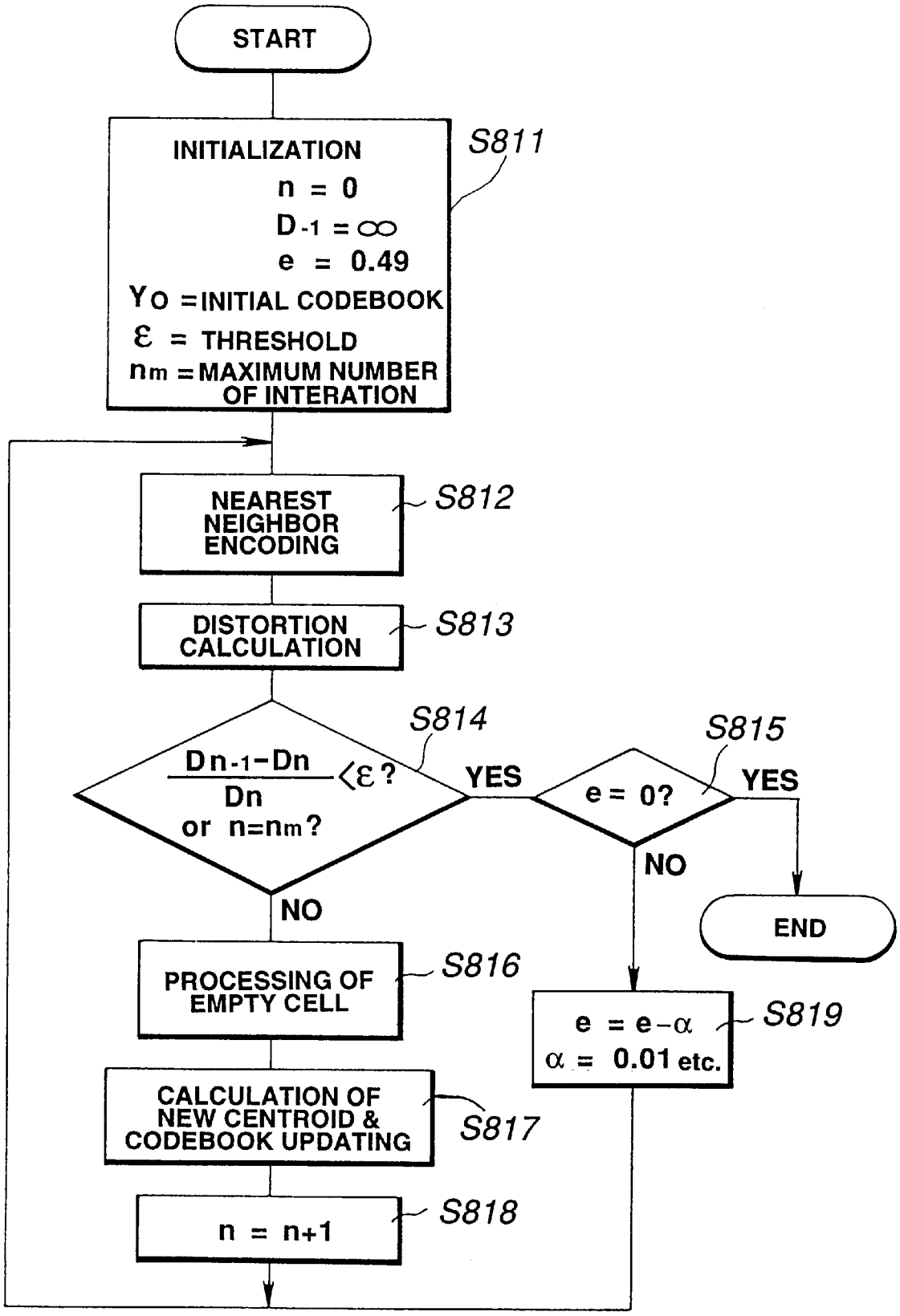
FIG. 46 is a flowchart for explaining the second example of the vector quantization method.

At this stage, a flow of processing of the above-mentioned second example, that is, the vector quantization method which does not cause deterioration of characteristics even in the absence of the error, taking account of the hamming distance at the time of training of the vector quantization, is explained with reference to FIG. 46.

First, at step S811, initialization is carried out. Specifically, distortion $D_{-1}$ is set to infinity, and the number of repeating n is set to "0" (n=0) while the bit error rate e is set to 0.49. Also, $Y_0$, $\epsilon$, and $n_m$ are defined as the initial codebook, the threshold, and the maximum number of iteration, respectively.

At step S812, with the initial codebook $Y_0$ given at step S811, all the training data provided at this stage are encoded under the nearest neighbor condition. In short, the initial codebook is processed with mapping.

At step S813, distortion calculation for calculating the square sum of the distance between the input data and the output data is carried out.

At step S814, whether the reduction rate of distortion found form the previous distortion $D_{-1}$ and the present distortion $D_n$ at step S813 becomes smaller than the threshold $\epsilon$ or not, or whether the number of iteration n has reached the maximum number of iteration $n_m$ which is determined in advance, is judged. If YES is selected the operation proceeds to step S815, and if NO is selected the operation proceeds to step S816.

At step S815, whether the bit error rate e becomes 0 or not is judged. If YES is selected the flow of operation ends, and if NO is selected the operation proceeds to step S819.

Step S816 is to avoid the code vector with the input data not processed with mapping at all, which is present when an improper initial codebook is set at step S811. Normally, the code vector with the input data not processed with mapping is shifted to the vicinity of a cell with the greatest distortion.

At step S817, a new centroid is found by calculation based on the formula (57).

The operation proceeding to step S818 returns to step S812, and this flow of operation is repeated until YES is selected at step S815.

At step S819, $\alpha$ (e.g. $\alpha$=0.01) from the bit error rate e is reduced for every flow until the decision on the bit error rate e=0 is made at step S815.

In the present second embodiment, the optimized codebook can be ultimately produced with the error rate e=0 by the above-mentioned flow of operation, and little deterioration of vector quantization characteristics in the absence of the error is generated.

Also, when an upper g bit is protected with error correction while a lower W-g bit is not processed with the error correction in an index expressed by W bits, P (i|j) may be found by reflecting only the hamming distance of the lower W-g bit by the formula (56). That is, if the index has the same upper g bits, the hamming distance is considered. If there is even one different bit among the upper g bits, the index is set to P (i|j)=0. In short, the upper g bit, which is protected with the error correction, is assumed to be error-free.

Next, the third example of the vector quantization method, which is of the third aspect of the present invention, is explained.

In the third example of the vector quantization method, an N-point initial codebook is provided with a desired structure. If an initial codebook having an analogous relation between the hamming distance and the Euclid distance is produced, the structure does not collapse, even though it is trained by the conventional LBG.

In production of the initial codebook in this third example, the representative point is updated every time one sample of training data is inputted. Normally, the representative point updated by the input training data X in a cell of $m_j$ is $m_j$ only, as shown in FIG. 47. $m_{j\ new}$ such as $m_{j+1}$ and $m_{j+2}$ are updated as follows.

$$m_{j\ new}=m_{j\ old}+\Delta m_j \text{ where } \Delta m_j=(X=m_{j\ old})\cdot\alpha\alpha<1 \tag{60}$$

In short, scanning is carried out with all the training data X. Then, the same scanning is carried out with $\alpha$ being diminished. Ultimately, with a being further reduced, conversion to 0 is carried out, thereby producing the initial codebook.

In this third example, the input training data X is reflected not only on $m_j$ but also on $m_{j+1}$ and $m_{j+2}$ so as to influence all the peripheral cells. For example, in the case of $m_{j+1}$, $m_{j+1\ new}$ becomes as follows.

$$m_{j+1\ new}=m_{j+1\ old}+\Delta m_{j+1} \text{ where } \Delta m_{j+1}=(X-m_{j+1\ old})\cdot\alpha\cdot f(j+1, j)\alpha\leq 1 \tag{61}$$

In the formula (61), f (j+1, j) is a function for returning a value proportional to the reciprocal of the hamming distance of j and j+1, such as f (j+1, j)=P (j+1|j).

A more general form of the formula (61) is as follows.

$$m_{j\ new}=m_{j\ old}+\Delta m_j \text{ where } \Delta m_j=(X-m_j)\cdot\alpha\cdot f(j, C(X))\alpha<1 \tag{62}$$

C(X) in the formula (62) returns an index u of a cell having the center of gravity nearest to the input X. C(X) can be defined as follows.

$$C(X)=U \text{ iff } d(X, y_u)\leq d(X, y_j) \text{ for all } i\epsilon I \tag{63}$$

As an example of the function of f, $$f(j, C(X))=P(j|C(X))$$

can be used. Thus, in the third embodiment, the initial codebook is produced by the above-described updating method, and then the LBG is carried out.

Accordingly, in the third embodiment of the present invention, if the N-point initial codebook having the analogous relation between the hamming distance and the Euclid distance is produced, the structure does not collapse even though training is carried out with the conventional LBG.

According to the vector quantization method as described above, the distance of code vectors in the codebook consisting of plural M-dimensional code vectors with M units of data as M-dimensional vectors and the hamming distance at the time of expressing the indices of the searched code vectors in the binary manner are made coincident in size. Also, part of bits of the binary data expressing the indices of the searched vectors are protected with the error correction code while the hamming distance of the remaining bits and the distance between the code vectors in the codebook are made coincident in size. By way of this, it is possible to control the effect of the code error in the transmission path. Further, by setting the distance found by weighing by the weighted matrix used for defining the distortion measure as the distance between the code vectors, it is possible to control the effect of the code error in the transmission path without causing deterioration of characteristics in the absence of the error.

Next, application of the voice analysis-synthesis method to the voice signal analysis-synthesis encoding device is explained.

In the voice analysis-synthesis method employed in the voice analysis-synthesis device, it is necessary to match the phase on the analysis side with the phase on the synthesis side. In this case, linear prediction by the angular frequency and modification by the white noise may be used for obtaining phase information on the synthesis side. However, it is impossible with the white noise to perform control of noises or errors by the real value of the phase and the prediction.

Also, the level of the white noise is changed at a proportion of unvoiced sounds in the entire band so as to be used in the modification term. Therefore, in case blocks containing a large proportion of voiced sounds exist consecutively, modification cannot be carried out only by prediction. As a result, when strong vowels continue long, errors are accumulated, deteriorating the sound quality.

Thus, a voice analysis-synthesis method whereby improvement in the sound quality can be realized by using noises capable of controlling the size and diffusion for modification due to prediction is proposed.

That is, the voice analysis-synthesis method comprises the steps of: dividing an input voice signal on the block-by-block basis and finding pitch data in the block; converting the voice signal on the block-by-block basis into the signal on the frequency axis and finding data on the frequency axis; dividing the data on the frequency axis into plural bands on the basis of the pitch data; finding power information for each of the divided bands and decision information on whether the band is voiced or unvoiced; transmitting the pitch data, the power information for each band and the voiced/unvoiced decision information found in the above processes; predicting a block phase at frame boundaries on the basis of the pitch data for each block obtained by transmission and a block initial phase; and modifying the predicted block phase at frame boundaries using a noise having diffusion according to each band. It is preferable that the above-mentioned noise is a Gaussian noise.

According to such a voice analysis-synthesis method, the power information and the voiced/unvoiced decision information are found on the analysis side and then transmitted, for each of the plural bands produced by dividing the data on the frequency axis obtained by converting the block-by-block voice signal into the signal on the frequency axis on the basis of the pitch data found from the block-by-block voice signal, and the block phase at frame boundaries is predicted on the synthesis side on the basis of the pitch data for each block obtained by transmission and the block initial phase. Then, the predicted terminal edge phase is modified, using the Gaussian noise having diffusion according to each band. By way of this, it is possible to control error or difference between the predicted phase value and the real value.

A concrete example in which the above-described voice analysis-synthesis method is applied to the voice signal analysis-synthesis encoding device (so-called vocoder) is explained with reference to the drawings. The analysis-synthesis encoding device carries out modelling such that a voiced section and an unvoiced section are present in a coincident frequency axis region (in the same block or the same frame).

Figure 48:
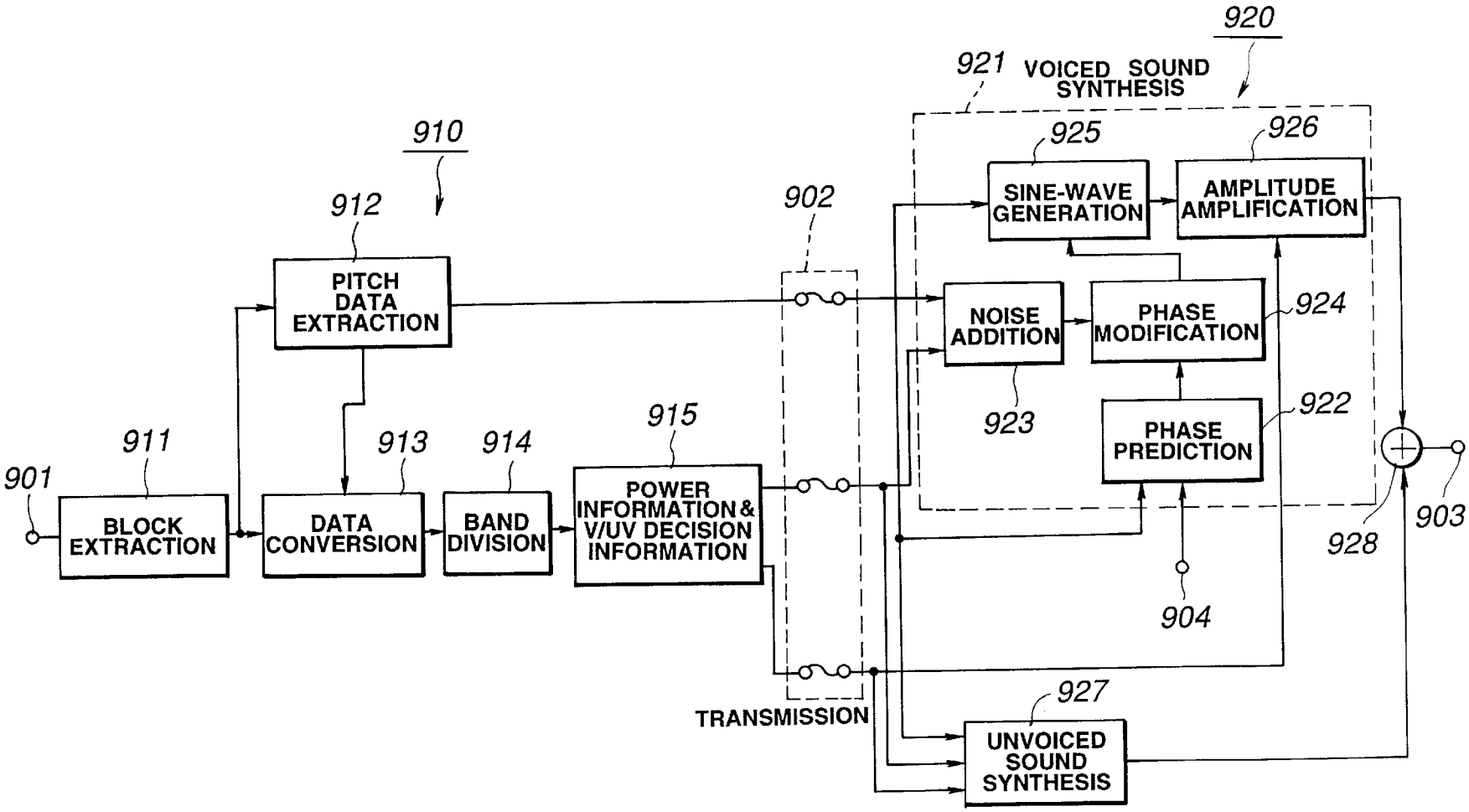
FIG. 48 is a functional block diagram of a concrete example in which a voice analysis-synthesis method is applied to a so-called vocoder.

FIG. 48 is a diagram showing a schematic arrangement of an entire example in which the voice analysis-synthesis method is applied to the voice signal analysis-synthesis encoding device.

In FIG. 48, the voice analysis-synthesis encoding device comprises an analysis section 910 for analyzing pitch data, etc., from an input voice signal, and a synthesis section 920 for receiving various types of information such as the pitch data transmitted from the analysis section 910 by a transmission section 902, synthesizing voiced and unvoiced sounds, respectively, and synthesizing the voiced and unvoiced sounds together.

The analysis section 910 comprises: a block extraction section 911 for taking out a voice signal inputted from an input terminal 1 on the block-by-block basis with each block consisting of a predetermined number of samples (N samples); a pitch data extraction section 912 for extracting pitch data from the input voice signal on the block-by-block basis from the block extraction section 911; a data conversion section 913 for finding data converted onto the frequency axis from the input voice signal on the block-by-block basis from the block extraction section 911; a band division section 914 for dividing the data on the frequency axis from the data conversion section 913 into plural bands on the basis of the pitch data of the pitch data extraction section 914; and an amplitude data and V/UV decision information detection section 915 for finding power (amplitude) information for each band of the band division section 914 and decision information on whether the band is voiced (V) or unvoiced (UV).

The synthesis section 920 receives the pitch data, V/UV decision information and amplitude information transmitted by the transmission section 902 from the analysis section 910. Then, the synthesis section 920 synthesizes the voiced sound by a voiced sound synthesis section 921 and the unvoiced sound by an unvoiced sound synthesis section 927, and adds the synthesized voiced and unvoiced sounds together by an adder 928. Then, the synthesis section 920 takes out the synthesized voice signal from an output terminal 903.

The above-mentioned information is obtained by processing the data in the block of the N samples, e.g. 256 samples. However, since the block advances on the basis of a frame of L samples as a unit on the time axis, the transmitted data is obtained on the frame-by-frame basis. That is, the pitch data, V/UV information and amplitude information are updated with the frame cycle.

The voiced sound synthesis section 921 comprises: a phase prediction section 922 for predicting a frame phase at frame boundaries (starting edge phase of the next synthesis frame) on the basis of the pitch data and a frame initial phase supplied from an input terminal 904; a phase modification section 924 for modifying the prediction from the phase prediction section 922, using a modification term from a noise addition section 923 to which the pitch data and the V/UV decision information are supplied; a sine-wave generating section 925 for reading out and outputting a sine wave from a sine-wave ROM, not shown, on the basis of the modification phase information from the phase modification section 924; and an amplitude amplification section 926 to which the amplitude information is supplied, for amplifying the amplitude of the sine wave from the sine-wave generating section 925.

The pitch data, V/UV decision information and amplitude information are supplied to the unvoiced sound synthesis section 927, where the white noise, for example, is processed with filtering by a band pass filter, not shown, so as to synthesize an unvoiced sound waveform on the time axis.

The adder 928 adds, with a fixed mixture ratio, the voiced sound and the unvoiced sound synthesized by the voiced sound synthesis section 921 and the unvoiced sound synthesis section 927, respectively. The added voice signal is outputted as the voice signal from the output terminal 903.

In the phase prediction section 922 in the voiced sound synthesis section 921 of the synthesis section 920, if the phase (frame initial phase) of the m'th harmonic at time 0 (head of the frame) is assumed to be $\psi_{0m}$, the phase at the end of the frame $\psi_{Lm}$ is predicted as follows.

$$\psi_{Lm}=\psi_{0m}+m(\omega_{01}+\omega_{L1})L/2 \tag{64}$$

The phase of each band $\phi_m$ is found as follows.

$$\phi_m+\psi_{Lm}+\epsilon_m \tag{65}$$

In the formulas (64) and (65), $\omega_{01}$ indicates the fundamental angular frequency at the starting edge (n=0) of the synthesis frame, and $\omega_{L1}$ indicates the fundamental angular frequency at the terminal edge of the synthesis frame (n=L, starting edge of the next synthesis frame), while $\epsilon_m$ indicates the prediction modification term in each band.

By the formula (64), the phase prediction section 922 finds a phase as the prediction phase at the time L by multiplying the average angular frequency of the m'th harmonic with the time and by adding the initial phase of the m'th harmonic thereto. From the formula (65), it is found that the phase $\psi_m$ of each band is a value produced by adding the prediction modification term $\epsilon_m$ to the prediction phase.

For the prediction modification term $\epsilon_m$, because of its random distribution between the bands, a random number can be used. However, a Gaussian noise is employed in the present embodiment. The Gaussian noise is a noise the diffusion of which increases toward the higher frequency band (e.g. from $\epsilon_1$ to $\epsilon_{10}$), as shown in FIG. 49. The Gaussian noise properly approximates the prediction value of the phase to the real value of the phase.

If the diffusion as shown in FIG. 49 is simply in proportion to m, the prediction modification term $\epsilon_m$ is indicated by $$\epsilon_m=h_1N(0, k_i) \tag{66}$$

where $h_1$, $k_i$, and 0 indicate a constant, a fraction, and an average, respectively.

If the entire band is divided into two bands of a voiced band and an unvoiced band with the unvoiced portion being larger, the phases of frequency components constituting the voice become even more random. Therefore, the prediction modification term $\epsilon_m$ can be expressed by $$\epsilon_m=h_2n_{uj}N(0, k_i) \tag{67}$$

where $h_2$, $k_i$, 0, and $n_{uj}$ indicate a constant, a fraction, an average, and the number of unvoiced bands in a block j, respectively.

When there is no random distribution between bands, as described above, particularly due to long continuous vowels, or when vowels are shifted into consonants and unvoiced sounds, the prediction modification term shown in the formulas (66) and (67) rather deteriorates the quality of the synthetic sound. Therefore, if a delay is allowable, the amplitude information (power) S level of a preceding frame or a reduction of the voiced sound portion is examined, thereby setting the modification term $\epsilon_m$ by $$\epsilon_m=h_3 \max(a, S_j-S_{j+1})N(0, k_i) \tag{68}$$

$$\epsilon_m=h_4 \max(b, n_{vj}-n_{v(j+1)})N(0, k_i) \tag{69}$$

where a, b, $h_3$ and $h_4$ are constants.

Further, when the pitch data at the pitch data extraction section 912 is low, the number of the frequency band is increased, and the adverse effect of alignment of the phases is increased. In consideration of this, the modification term $\epsilon_m$ is expressed by $$\epsilon_m=f(S_j, h_j)N(0, k_i) \tag{70}$$

where f indicates frequency.

In the embodiment applying the present invention to the voice signal analysis-synthesis encoding device, the size and diffusion of the noise used for phase prediction modification can be controlled by using a Gaussian noise.

In the example in which such a voice analysis-synthesis method to the MBE explained with reference to FIGS. 1 to 7, the size and diffusion of the noise used for phase prediction can be controlled by using the Gaussian noise.

With the voice analysis-synthesis method described above, the power information and the V/UV decision information is found on the analysis side and transmitted for each of the plural bands produced by dividing the frequency axis data obtained by converting the block-by-block voice signal into the signal on the frequency axis on the basis of the pitch data found from the block-by-block voice signal, and the block terminal end phase is predicted on the synthesis side on the basis of the pitch data for each block obtained by transmission and the block initial phase. Then, the predicted phase at frame boundaries is modified, using the Gaussian noise having diffusion according to each band. By way of this, it is possible to control the size and diffusion of the noise, and thus to expect improvement in the sound quality. Also, by utilizing the signal level of the voice and temporal changes thereof, it is possible to prevent accumulation of errors and to prevent deterioration of the sound quality in a vowel portion or at a shift point from the vowel portion to a consonant portion.

Meanwhile, the present invention is not limited to the above embodiments. For example, not only the voice signal but also an acoustic signal can be used as the input signal. The parameter expressing characteristics of the input audio signal (voice signal or acoustic signal) is not limited to the V/UV decision information, and the pitch value, the strength of pitch components, the tilt and level of the signal spectrum, etc. can be used. Further, for these characteristics parameters, part of parameter information to be originally transmitted in accordance with the encoding method may be used instead. Also, the characteristics parameters may be separately transmitted. In the case of using other transmission parameters, these parameters can be regarded as an adaptive codebook, and in the case of separately transmitting the characteristics parameters, the parameters can be regarded as a structured codebook.

What is claimed is:

1. A method for processing an audio signal, comprising the steps of:

generating frequency domain data by dividing an input audio signal on a block-by-block basis thereby determining blocks of data, and performing time domain to frequency domain conversion on each of the blocks thereby generating the frequency domain data;

dividing the frequency domain data for at least one of the blocks into plural bands;

deciding, for each of the bands for one of the blocks, whether said each of the bands is voiced or unvoiced;

if at least one of the bands for said one of the blocks is voiced, identifying as a highest frequency voiced band a voiced band whose center frequency is F, where F is the highest center frequency among said at least one of the bands for said one of the blocks which are voiced; and generating boundary point data indicative of a boundary point between a voiced sound region and an unvoiced sound region of said one of the blocks in accordance with the number $B_{VH}$ of bands of the frequency domain data for said one of the blocks which have center frequency less than the center frequency F.

2. The method of claim 1, wherein the step of generating the boundary point data includes the steps of:

determining a ratio $R=N_V/(B_{VH}+N)$, where $N_V$ is the number of voiced bands for said one of the blocks, and N is an integer; and generating the boundary point data to be indicative of the voiced band whose center frequency is F, if the ratio R is not less than a predetermined threshold.

3. The method of claim 2, wherein N=1.

4. The method of claim 2, wherein the step of generating the boundary point data includes the step of:

generating the boundary point data to be indicative of the voiced band including frequency $F_2$, if the ratio R is less than the predetermined threshold, where $F_2=kF$ and k is a constant satisfying $0<k<1$.

* * * * *